US007347806B2

(12) United States Patent
Nakano et al.

(10) Patent No.: US 7,347,806 B2
(45) Date of Patent: Mar. 25, 2008

(54) ROCKING TYPE EXERCISING APPARATUS

(75) Inventors: Toshio Nakano, Osaka (JP); Izumi Mihara, Daito (JP); Hideki Sasaki, Kobe (JP); Naoto Shirasawa, Hirakata (JP); Minoru Kawamoto, Hikone (JP); Yuritugu Toyomi, Hikone (JP); Kouiti Ishino, Hikone (JP); Hiroyuki Hojo, Hikone (JP); Keiko Tsuji, Nagahama (JP); Ryusuke Nakanishi, Nagoya (JP)

(73) Assignee: Matsushita Electric Works, Ltd., Osaka (JP)

( * ) Notice: Subject to any disclaimer, the term of this patent is extended or adjusted under 35 U.S.C. 154(b) by 0 days.

(21) Appl. No.: 11/188,666

(22) Filed: Jul. 26, 2005

(65) Prior Publication Data

US 2006/0025226 A1 Feb. 2, 2006

(30) Foreign Application Priority Data

Jul. 27, 2004 (JP) ..... 2004-218151
Feb. 21, 2005 (JP) ..... 2005-044579

(51) Int. Cl.
*A63B 22/00* (2006.01)
*A63B 69/00* (2006.01)
*A63G 13/06* (2006.01)

(52) U.S. Cl. ..... 482/51; 472/95; 434/247

(58) Field of Classification Search ..... 472/95–97, 472/130, 59–61; 446/7, 29, 396; 434/55, 434/62, 64, 65, 247; 482/51; 297/260.1–260.2
See application file for complete search history.

(56) References Cited

U.S. PATENT DOCUMENTS 2,173,691 A * 9/1939 Marlowe ..... 472/99

(Continued)

FOREIGN PATENT DOCUMENTS

DE 20013487 6/2001

(Continued)

OTHER PUBLICATIONS

English Language Abstract of JP 11-4911.

(Continued)

*Primary Examiner*—Stephen R. Crow
*Assistant Examiner*—Allana Lewin
(74) *Attorney, Agent, or Firm*—Greenblum & Bernstein, P.L.C.

(57) ABSTRACT

A wedge-shaped tilt provider is attached in contact with the bottom surface of a seat and the upper surface of a seat connection member of a rocking mechanism to set the seat to an initial inclined position relative to a reference position. By setting the seat to a forwardly inclined position from a horizontal position where the seated surface of the seat is set horizontal, the user straddling the seat can increase the amount of muscle activity of his or her rectus muscle of abdomen, or abdominal muscle. Further, by setting the seat to a rearwardly inclined position, the user straddling the seat can increase the amount of muscle activity of his or her back muscle such as paraspinal muscle. With use of a rocking type exercising apparatus having the above construction, a stress of exercise simulating horseback riding is given to the user by changing the position of the seat relative to the reference position by a certain degree of inclination, while rocking the seat which the user straddles, whereby the user is selectively provided with an exercising effect onto a specific site of his or her body.

14 Claims, 44 Drawing Sheets

U.S. PATENT DOCUMENTS

| | | | | |
|---|---|---|---|---|
| 2,241,465 | A * | 5/1941 | Krempler | 472/105 |
| 2,915,311 | A | 12/1959 | Delano | |
| 5,085,425 | A * | 2/1992 | Collins et al. | 472/97 |
| 5,098,089 | A * | 3/1992 | Harrington et al. | 482/140 |
| 5,403,251 | A * | 4/1995 | Belsito et al. | 482/4 |
| 5,785,631 | A * | 7/1998 | Heidecke | 482/5 |
| 6,210,286 | B1 * | 4/2001 | Ohara et al. | 472/97 |
| 6,666,802 | B1 * | 12/2003 | Rasmussen | 482/148 |
| 7,070,415 | B2 * | 7/2006 | Hojo et al. | 434/247 |
| 2002/0014741 | A1 | 2/2002 | Greenwood | |
| 2002/0115536 | A1 | 8/2002 | Hojo et al. | |
| 2004/0198553 | A1 | 10/2004 | Hojo et al. | |

FOREIGN PATENT DOCUMENTS

| | | |
|---|---|---|
| EP | 1438990 | 7/2004 |
| JP | 61-142069 | 9/1986 |
| JP | 2-132455 | 11/1990 |
| JP | 11-4911 | 1/1999 |
| JP | 11-155836 | 6/1999 |
| JP | 2001-79113 | 3/2001 |
| JP | 2001-286578 | 10/2001 |
| JP | 3394890 | 1/2003 |
| JP | 2003-235917 | 8/2003 |
| KR | 200344972 | 3/2004 |
| WO | 01/89649 | 11/2001 |

OTHER PUBLICATIONS

English language Abstract of JP 2001-286578.
English language Abstract of JP 11-155836.
English language partial translation of JP 2-132455.
English language partial translation of JP 61-142069.
English language Abstract of JP 2001-79113.
English language Abstract of JP 2003-235917.

* cited by examiner

| | | | | | |
|---|---|---|---|---|---|
| CONTROL SIGNAL FOR MOTOR 62a | + | 0 | − | 0 | − |
| CONTROL SIGNAL FOR MOTOR 63a | − | 0 | + | 0 | + |
| ANGULAR POSITION OF SEAT RELATIVE TO HORIZONTAL POSITION | | | | | |

FIG.21

| | FORWARD INCLINATION | REARWARD INCLINATION | LEFTWARD INCLINATION | RIGHTWARD INCLINATION |
|---|---|---|---|---|
| HEIGHT OF ELEVATING MECHANISM 62 | + | − | 0 | 0 |
| HEIGHT OF ELEVATING MECHANISM 63 | − | + | 0 | 0 |
| HEIGHT OF ELEVATING MECHANISM 72 | 0 | 0 | − | + |
| HEIGHT OF ELEVATING MECHANISM 73 | 0 | 0 | + | − |

FIG.22

| | FORWARD INCLINATION | REARWARD INCLINATION | LEFTWARD INCLINATION | RIGHTWARD INCLINATION |
|---|---|---|---|---|
| HEIGHT OF ELEVATING MECHANISM A | − | + | 0 | 0 |
| HEIGHT OF ELEVATING MECHANISM B | + | − | + | − |
| HEIGHT OF ELEVATING MECHANISM C | + | − | − | + |

33
112
137
114
FORWARD
FORWARD INCLINED POSITION
REFERENCE POSITION
REARWARD INCLINED POSITION
60 SEC
15 SEC
30 SEC
30 SEC
15 SEC
60 SEC
EXERCISING CYCLE OF STRENGTHENING ABDOMINAL MUSCLE
EXERCISING CYCLE OF STRENGTHENING BACK MUSCLE

FIG.41

| ADDRESS NO. | ELAPSED TIME (MIN:SEC) | WAIST MUSCLE EXERCISING | | HIP MUSCLES EXERCISING | |
|---|---|---|---|---|---|
| | | SPEED SETTING VALUE | INCLINATION SETTING VALUE | SPEED SETTING VALUE | INCLINATION SETTING VALUE |
| 1 | 00:00 | 1 | 0 | 1 | 0 |
| 2 | 00:05 | 1 | 0 | 1 | 0 |
| 3 | 00:10 | 1 | 0 | 1 | 0 |
| 4 | 00:15 | 1 | 1 | 1 | 2 |
| 5 | 00:20 | 2 | 1 | 2 | 2 |
| 6 | 00:25 | 2 | 1 | 2 | 2 |
| 7 | 00:30 | 3 | 1 | 3 | 2 |
| 8 | 00:35 | 2 | 1 | 2 | 2 |
| 9 | 00:40 | 2 | 1 | 2 | 2 |

ROCKING TYPE EXERCISING APPARATUS

BACKGROUND OF THE INVENTION

1. Field of the Invention

The present invention relates to a rocking type exercising apparatus that provides a user with an exercising effect similar to the horseback riding by rocking a seat which the user straddles.

2. Description of the Related Art

Such rocking type exercising apparatuses as providing an exercising effect similar to the horseback riding to a user by rocking a seat which the user straddles have been widely used as an exercising apparatus among users of various generations from children to elderly persons at homes, as well as in medical facilities for the purpose of medical rehabilitation. Conventional rocking type exercising apparatuses are disclosed in Japanese Patent No. 3394890, Japanese Unexamined Patent Publication No. 2001-286578, and Japanese Unexamined Patent Publication No. 11-155836.

Japanese Patent No. 3394890 discloses a prophylactic exercising apparatus for lumbago, which is constructed such that rhythmical rocking motions are realized with use of a parallel mechanism having a leeway of movement in six different directions.

Japanese Unexamined Patent Publication No. 2001-286578 discloses a balance exercising apparatus comprising a single motor and a linking mechanism for realizing reciprocating rotational motions in forward and backward directions and reciprocating rotational motions in sideways directions.

Japanese Unexamined Patent Publication No. 11-155836 discloses a movement analyzing method and a movement auxiliary apparatus, wherein movement is analyzed by an electromyogram and a motion capturing technology to realize rocking motions suitable for an intended exercising.

The above prior art documents disclose a mechanism for generating rocking motions or a technology of detecting an exercising condition of a user in rocking motions. However, none of the prior art documents discloses a technique of causing an exercising effect to a selectively targeted specific site of the user's body. Generally, an exercising amount can be increased by raising the rocking speed or increasing the movement stroke. However, such exercising manners causes only the effect that increases the entire amount of muscle activity of the user's body, and fails to selectively increase an exercising effect to a selected specific site of the user's body.

SUMMARY OF THE INVENTION

It is an object of the present invention to provide an exercising apparatus which is free from the problems residing in the prior art.

It is another object of the present invention to provide a rocking type exercising apparatus which can cause an exercising effect to a selectively targeted portion of a user's body.

According to an aspect of the invention, an exercising apparatus is provided with a seat to be straddled by a user, a tilt provider for providing the seat with a predetermined inclination relative to a reference position; and a rocker for rocking the seat in the inclination to apply a stress of exercise to the user.

With this arrangement, an exercise stress is given to the user at different sites of the user's body, thereby allowing the user to selectively obtain an exercising effect on an intended specific site of his or her body.

These and other objects, features and advantages of the present invention will become more apparent upon reading of the following detailed description along with the accompanying drawings.

BRIEF DESCRIPTION OF THE DRAWINGS

FIG. 21 is a chart explaining how the inclined position of a seat attached with the tilt adjusting unit shown in FIG. 19 is changed in association with a movement of an elevating mechanism.

FIG. 22 is a chart explaining how the inclined position of the seat attached with a variation of the tilt adjusting unit shown in FIG. 19 is changed in association with a movement of an elevating mechanism.

FIG. 41 is a time chart of a control table to be stored in a memory when the exercising apparatus in the second embodiment is run in an example of the automatic modes.

DETAILED DESCRIPTION OF THE PREFERRED EMBODIMENTS OF THE INVENTION

Figure 1:
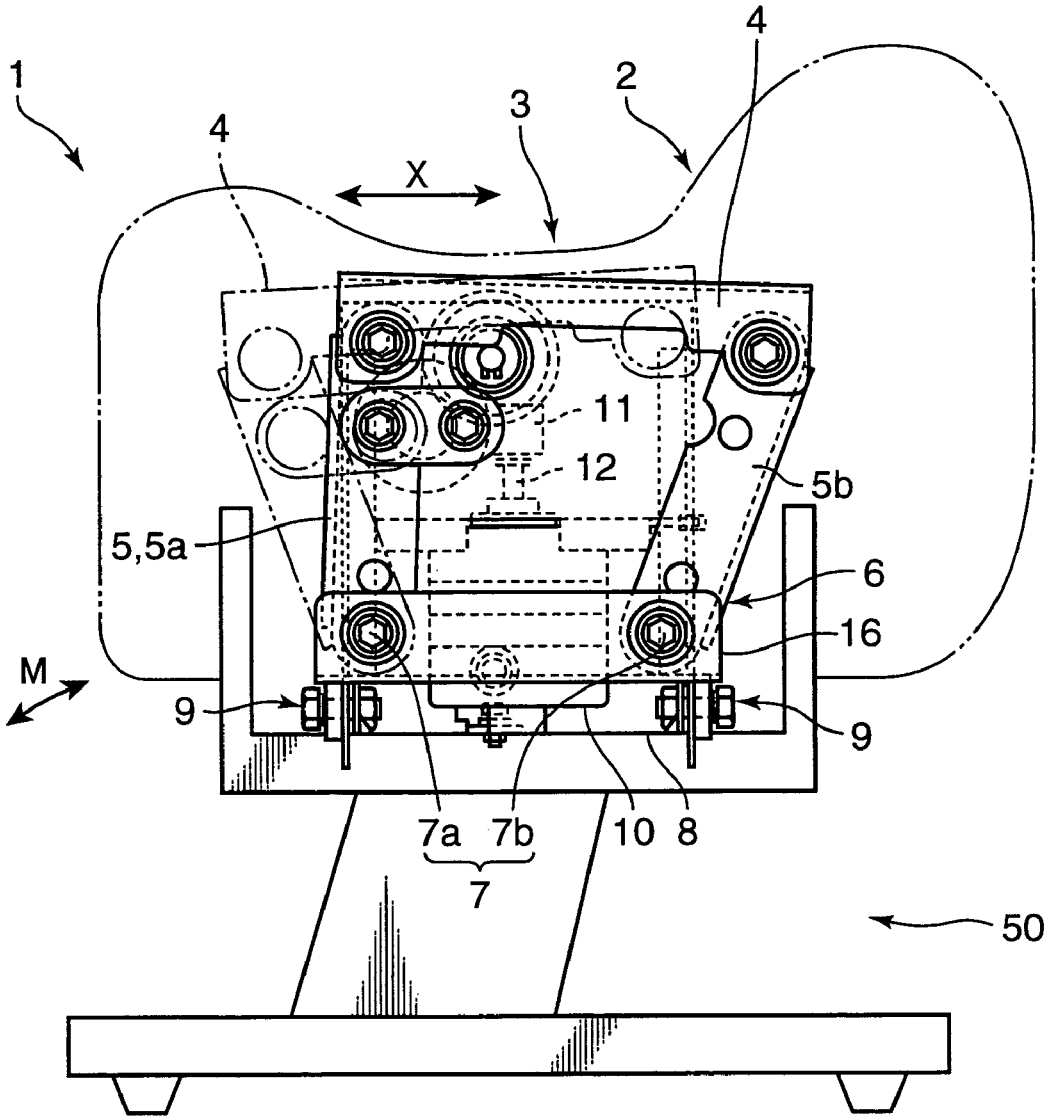
FIG. 1 is a side view showing an entire construction of a rocking type exercising apparatus as a first embodiment of the invention.

Referring to FIG. 1 showing a side view of a rocking type exercising apparatus embodying the invention, an exercising apparatus 1 comprises a seat 2 imitating the shape of a horse back or a saddle which the user straddles, a rocking mechanism 3 which is provided in the seat 2, and a base support member 50 which supports the seat 2 and the rocking mechanism 3.

Figure 2:
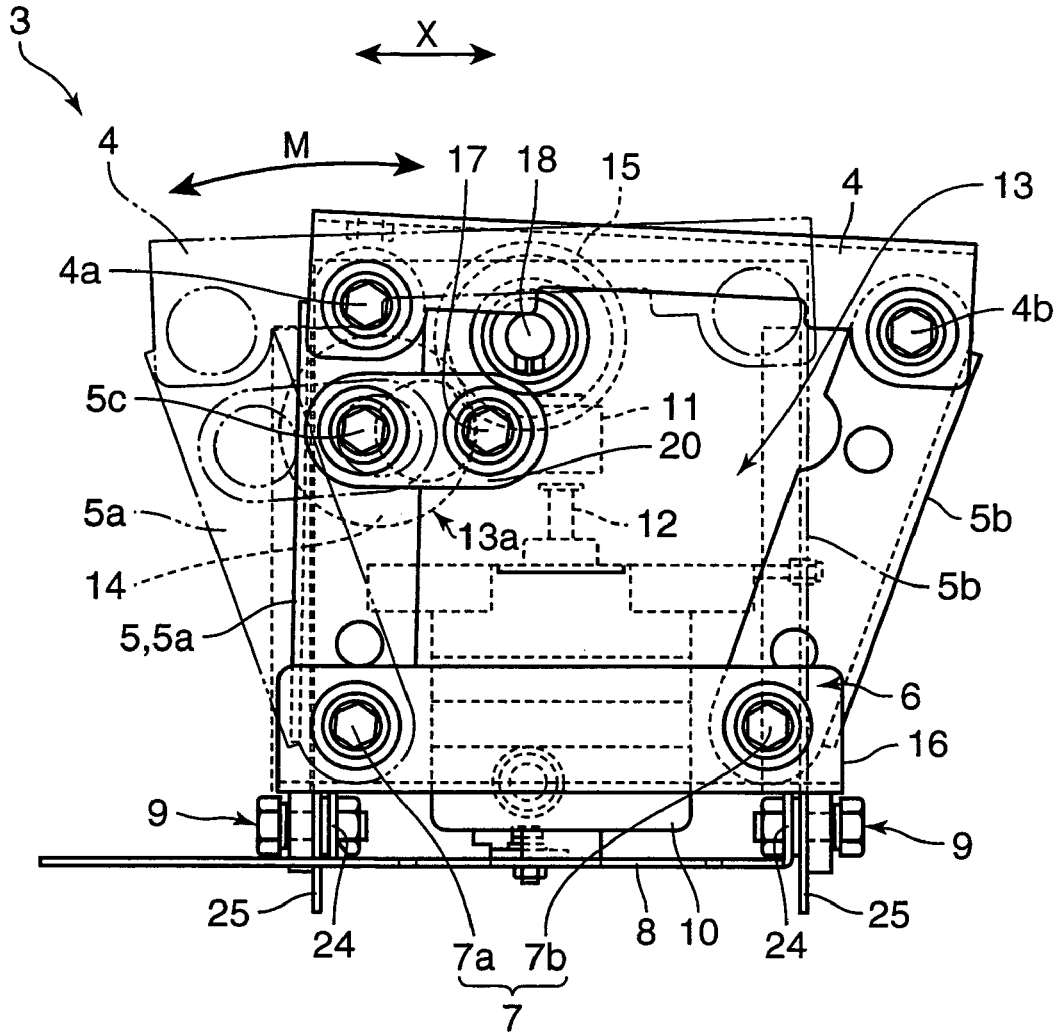
FIG. 2 is a side view enlargedly showing a rocking mechanism of the exercising apparatus.
Figure 3:
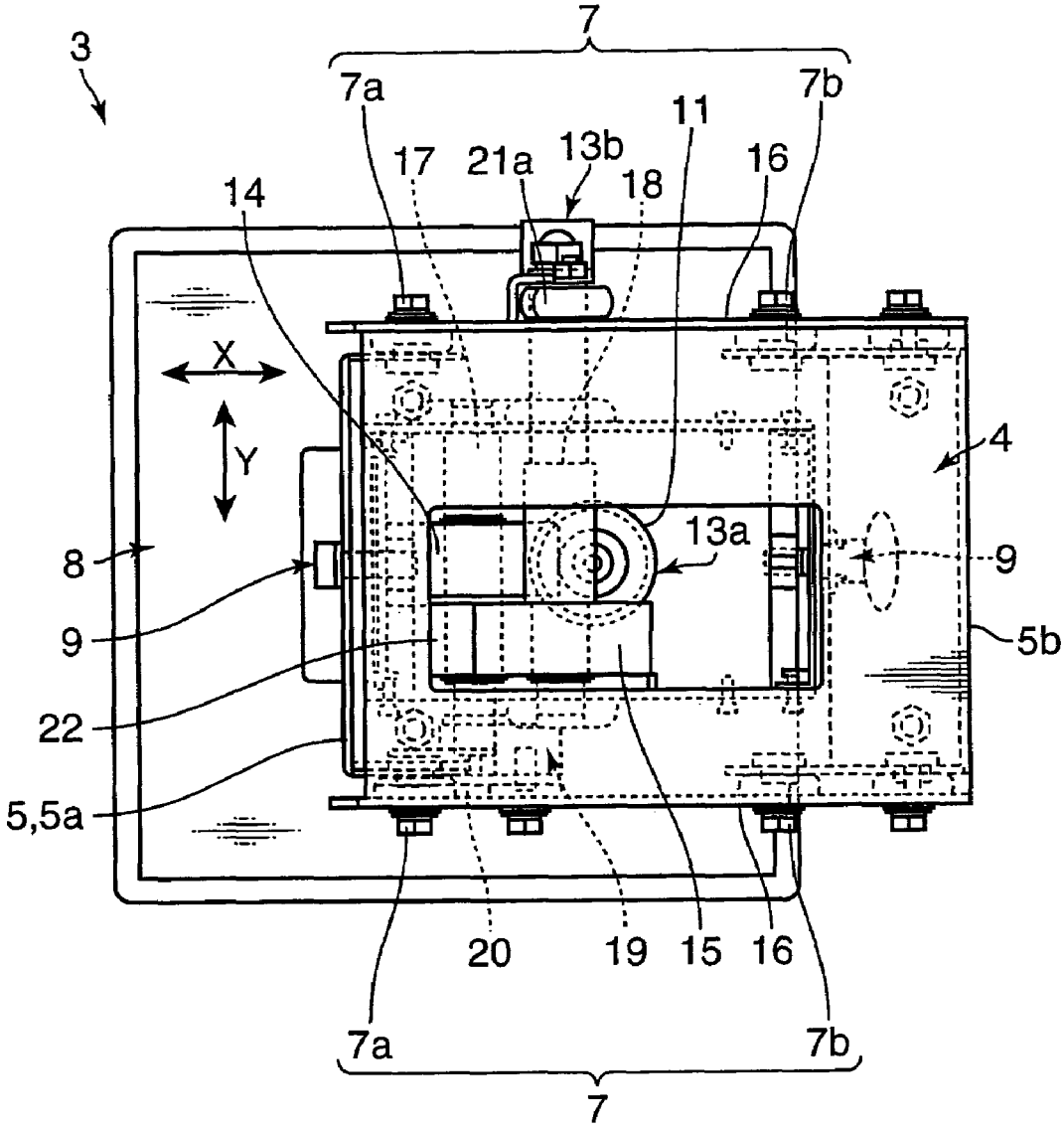
FIG. 3 is a top plan view of the rocking mechanism.
Figure 4:
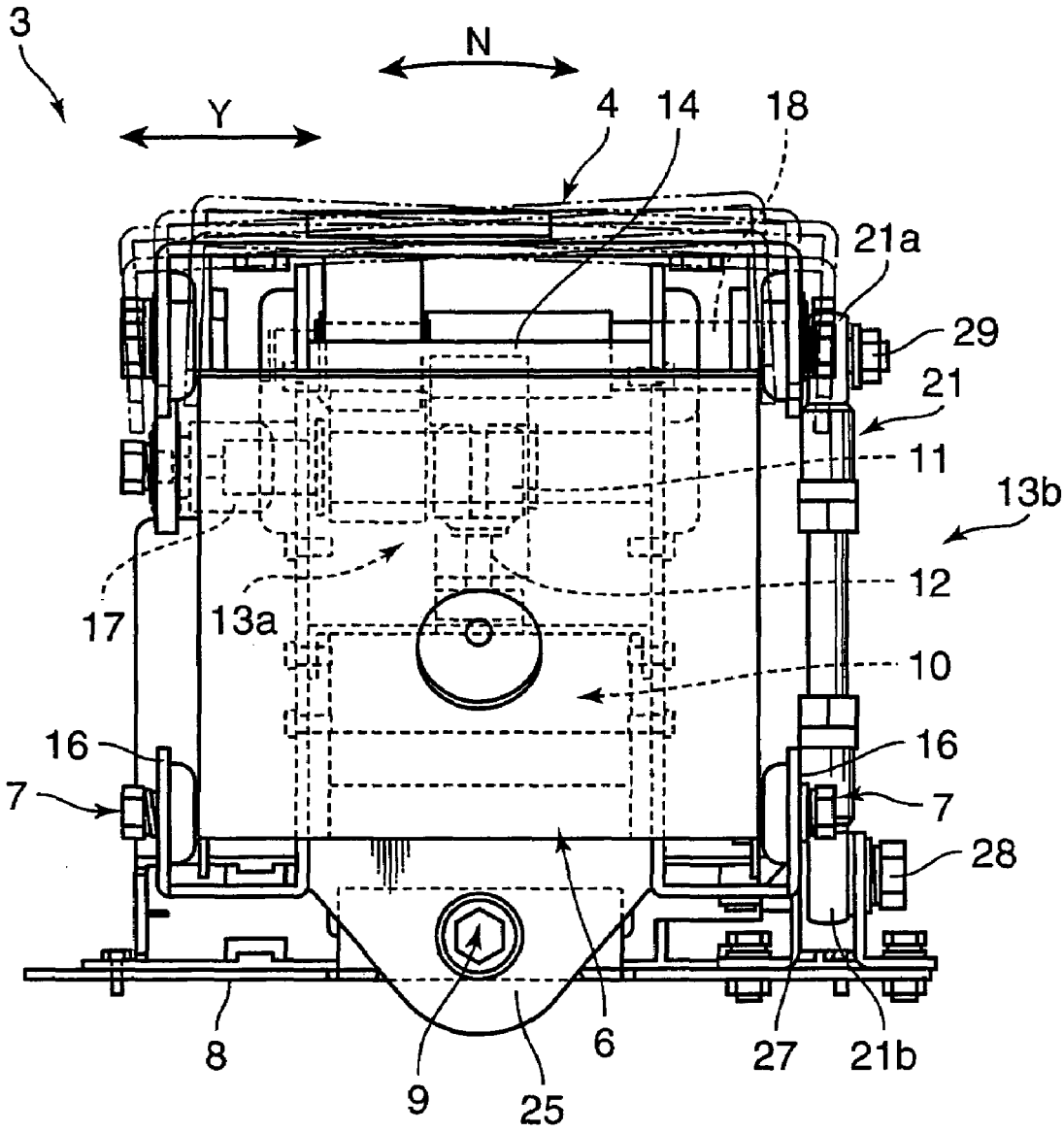
FIG. 4 is a rear view of the rocking mechanism.

FIGS. 2 to 4 enlargedly show the rocking mechanism 3. FIG. 2 is a side view of the rocking mechanism 3, FIG. 3 is a top plan view of the rocking mechanism 3, and FIG. 4 is a rear view of the rocking mechanism 3. A seat connection member 4 on which the seat 2 is mounted is pivotally supported on a pivotal support member 6 via pairs of link members 5, 5 respectively provided on the left side and the right side of the exercising apparatus 1, so that the seat connection member 4 rocks forward and backward. The pivotal support member 6 is pivotally supported on a base member 8, so that the pivotal support member 6 rocks leftward and rightward. A driving unit 13 is housed in a space defined by the seat connection member 4 and the pivotal support member 6. The link members 5 include front link members 5*a* and rear link members 5*b*. An upper end of the front link member 5*a* is pivotally connected to an upper pin 4*a* attached to a front end of the seat connection member 4, and a lower end of the front link member 5*a* is pivotally connected to a lower pin 7*a* attached to a front end of a side wall 16 of the pivotal support member 6. An upper end of the rear link member 5*b* is pivotally connected to an upper pin 4*b* attached to a rear end of the seat connection member 4, and a lower end of the rear link member 5*b* is pivotally connected to a lower pin 7*b* attached to a rear end of the side wall 16 of the pivotal support member 6. The lower pins 7*a*, 7*b* on which the front link members 5*a* and the rear link members 5*b* are pivotally mounted constitute lateral axes 7, 7 each of which extends in the direction of the arrows Y in FIG. 3. The link members 5, 5 are pivoted about the front and rear lateral axes 7, 7. With this arrangement, the seat connection member 4 is enabled to make reciprocating rotational motions about the respective lateral axes 7, 7 in forward and backward directions of the arrows M in FIG. 2.

As shown in FIGS. 2 and 4, upright pin support walls 24, 24 are formed at opposite ends of the base member 8 in the longitudinal direction shown by the arrows X, respectively. Linking flanges 25, 25 extend downwards at opposite ends of the pivotal support member 6 in the longitudinal directions X and at positions opposing the pin support walls 24, 24, respectively, and the linking flanges 25, 25 are pivotally interconnected to the corresponding pin support walls 24, 24 by way of pins, which thus constitute a longitudinal axis 9. The longitudinal axis 9 passes the center of the front and rear walls of the base member 8 to pivotally support the pivotal support member 6. With this arrangement, the seat connection member 4 is allowed to make reciprocating rotational motions in leftward and rightward directions of the arrows N in FIG. 4 about the longitudinal axis 9, 9.

The driving unit 13 includes a motor 10 of a stand alone type, and a first driver 13*a* and the second driver 13*b* for converting a torque of an output shaft 12 of the motor 10 into rectilinear reciprocating motions in forward and backward directions, namely, in the X-directions of the seat connection member 4, reciprocating rotational motions about the lateral axes 7, 7, and reciprocating rotational motions about the longitudinal axis 9 to drive the seat 2 in an intended position by synthesizing these three different motions. The motor 10 in this embodiment is installed upright on the base member 8, with the output shaft 12 extending vertically upward.

The first driver 13*a* is used to make rectilinear reciprocating motions in the X-direction, and reciprocating rotational motions about the lateral axes 7, 7. The second driver 13*b* is used to make reciprocating rotational motions about the longitudinal axis 9. As shown in FIGS. 2 and 3, the first driver 13*a* includes a first shaft 17 which is interconnected to the output shaft 12 via a motor gear 11 and a first gear 14, an eccentric crank 19 which is eccentrically connected to an end of the first shaft 17, and an arm link member 20 having an end thereof connected to the eccentric crank 19 and the other end thereof pivotally connected to a pin 5*c* attached to the front link member 5*a*. The opposite ends of the first shaft 17 are respectively pivotally connected to the seat connection member 4. The eccentric crank 19 makes eccentric rotation relative to the first shaft 17. With this arrangement, the front link member 5*a* reciprocates in the X-direction via the arm link member 20, whereby the seat connection member 4 interconnected to the link members 5, 5, namely, the seat 2 rocks in the direction of the arrows M shown in FIGS. 1 and 2.

As shown in FIGS. 3 and 4, the second driver 13*b* includes a second shaft 18 interconnected to an association gear 22 of the first shaft 17 via a second gear 15, and an eccentric rod 21 having an end thereof eccentrically connected to an end of the second shaft 18 and the other end thereof pivotally connected to the base member 8. The opposite ends of the second shaft 18 are respectively pivotally connected to the seat connection member 4. The eccentric rod 21 is disposed on one of the left side and the right side of the seat connection member 4. In FIGS. 3 and 4, the eccentric rod 21 is disposed on the right side of the seat connection member 4. An upper end 21*a* of the eccentric rod 21 is eccentrically connected to the end of the second shaft 18 by a pin 29 shown in FIG. 4. A lower end 21*b* of the eccentric rod 21 is pivotally interconnected to an L-shaped bracket 27 secured to the base member 8 by a shaft pin 28. With this arrangement, the upper end 21*a* of the eccentric rod 21 makes eccentric rotation as the second shaft 18 is rotated, whereby the seat connection member 4, namely, the seat 2 is enabled to make reciprocating rotational motions about the longitudinal axis 9 in the direction of the arrows N shown in FIG. 4.

In the above construction, when the output shaft 12 extending upward from the motor 10 is rotated, the first shaft 17 in mesh with the motor gear 11 and with the first gear 14 is rotated. Simultaneously, the second shaft 18 in mesh with the association gear 22 of the first shaft 17 and with the second gear 15 is rotated. In association with the rotation of the first shaft 17, the eccentric crank 19 connected to the one end of the first shaft 17 makes eccentric rotation, with the result that the front link member 5*a* swings in the X-directions about the front lateral axis 7 via the arm link member 20. At this time, the rear link member 5*b* swings about the rear lateral axis 7 in cooperation with the pivotal rotation of the front link member 5*a*. Thereby, the seat connection member 4, namely, the seat 2 rocks while making reciprocating movements in the X-directions. On the other hand, the upper end 21*a* of the eccentric rod 21 makes eccentric rotation as the second shaft 18 is rotated, whereby the seat connection member 4, namely, the seat 2 makes reciprocating rotational motions about the longitudinal axis 9.

Figure 5A:
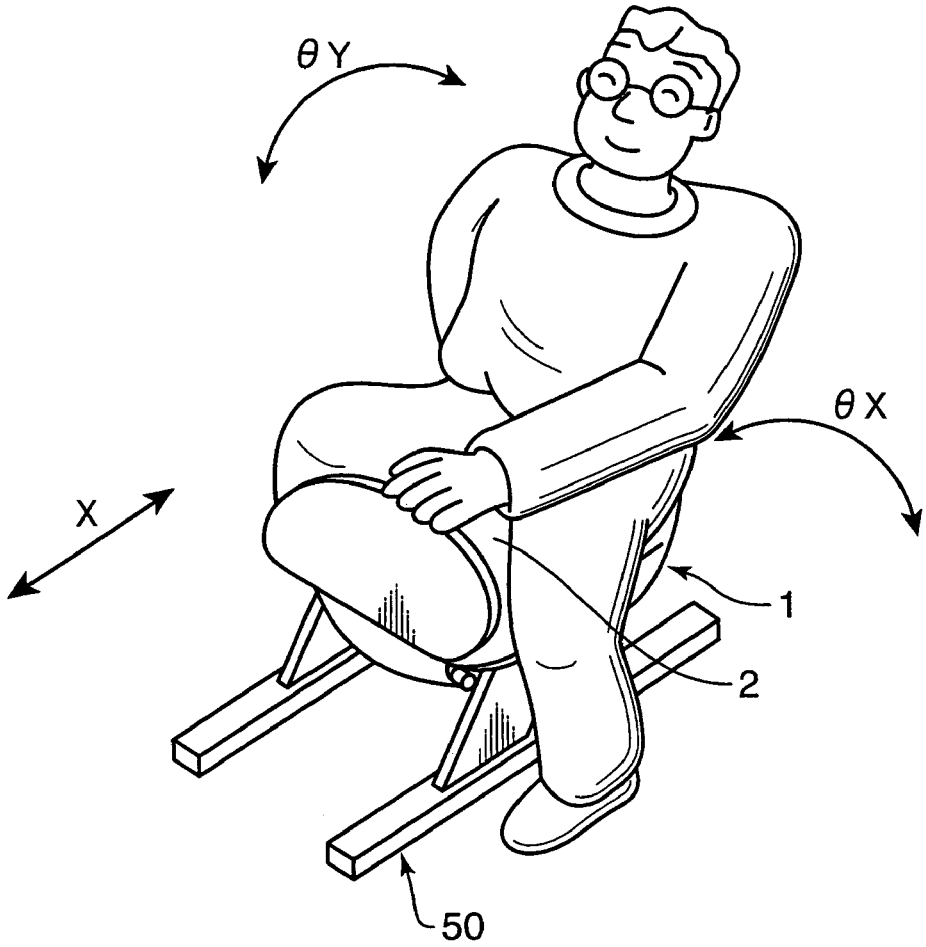
FIGS. 5A and 5B are illustrations explaining motions of the seat.
Figure 5B:
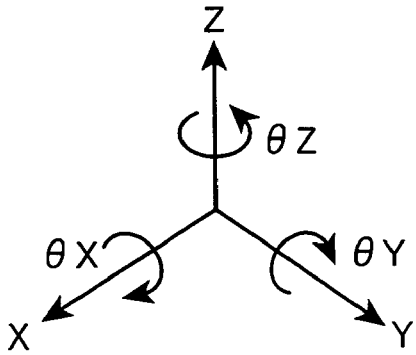

In this way, the seat 2 makes rocking motions in forward and backward directions, namely, in X-directions, leftward and rightward directions, namely, in Y-directions, upward and downward directions, namely, in Z-directions, as well as swing motions in θX-directions, θY-directions, and θZ-directions (see FIGS. 5A and 5B), while the user straddles the seat 2, thereby allowing the user to exercise balance training or promote physical fitness. Further, the apparatus 1 provides the three different motions with use of the single motor 10. This arrangement contributes to reduction of the number of motors to be used, provides easy control, and provides an inexpensive and compact exercising apparatus. Further, since the output shaft 12 of the motor 10 extends upward in one direction, the motor 10 is mountable in upright position. As compared with an arrangement that a motor is provided with two output shafts extending in two different directions and is mounted in transverse position, this arrangement enables to reduce the installation space for the entirety of the rocking mechanism 3 including the motor 10, which contributes to miniaturization of the rocking mechanism 3. Thereby, the apparatus 1 can accurately reproduce an intended motion simulating horseback riding, with the miniaturized rocking mechanism 3 being housed in the seat 2.

Figure 6A:
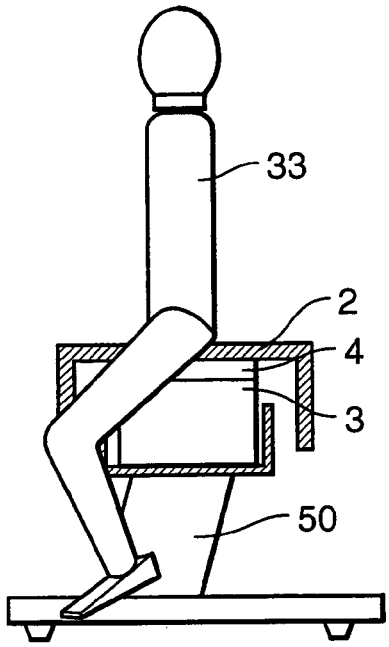
FIGS. 6A through 6C are side views each showing a tilting member provided in the exercising apparatus.
Figure 6B:
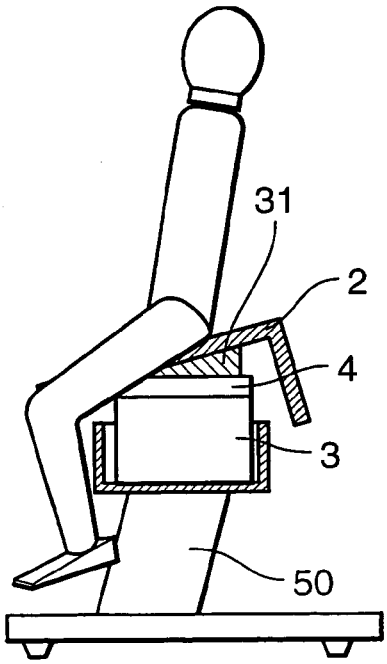
Figure 6C:
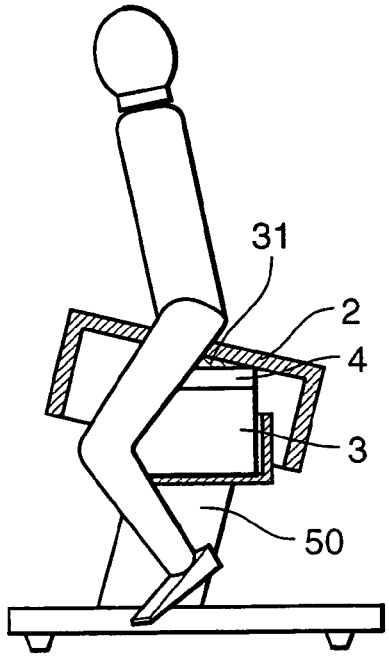

The rocking type exercising apparatus 1 as the first embodiment has the following feature. Specifically, as shown in FIGS. 6B and 6C, a wedge-shaped tilting member 31 is provided in contact with the bottom surface of the seat 2 and the upper surface of the seat connection member 4 of the rocking mechanism 3 for setting the seat 2 to a certain inclined position relative to a reference position of the seat 2 where the seated surface of the seat 2 is held in a horizontal or a neutral position. Although a seated position differs among individual users 33, as shown in FIG. 6A, while the seated surface of the seat 2 is held horizontal, in most of the cases, the user 33 is seated in a reference position in a relaxed manner with the amounts of his or her muscle activity of both the muscle of abdomen and the muscle of back being substantially identical to each other.

Figure 7A:
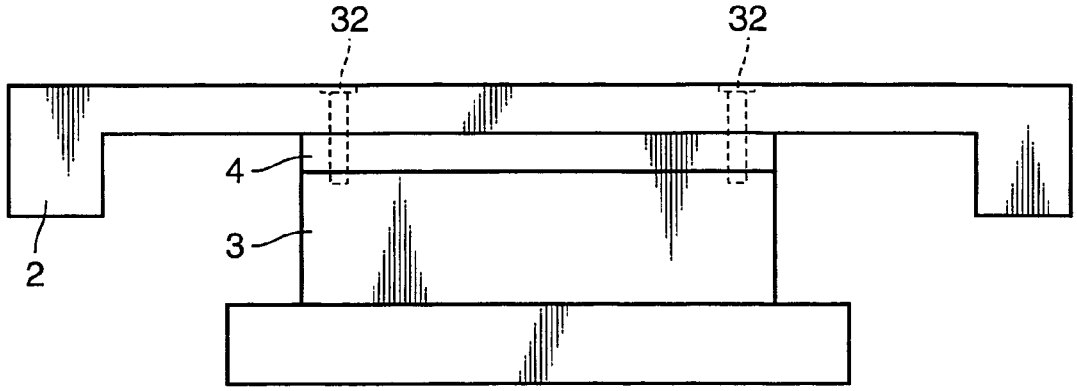
FIGS. 7A and 7B are side views explaining a function of the tilting member shown in FIGS. 6A through 6C.
Figure 7B:
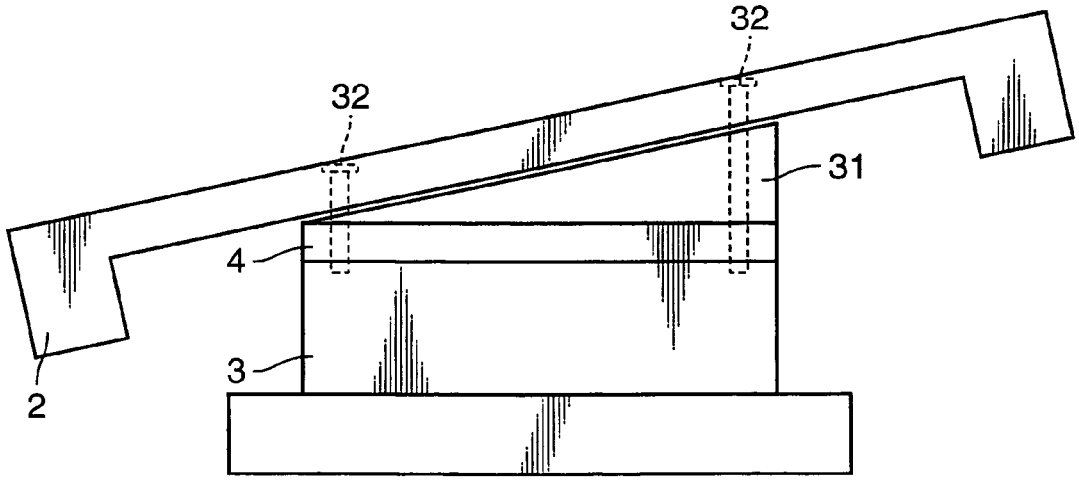

The tilting member 31 has an area substantially equal to the area of the upper surface of the seat connection member 4, and is adapted to tilt the contacted portion of the seat connection member 4 by about 10 degrees. The tilting member 31 is mounted in the seat 2 by temporarily loosening bolts 32, 32 which have been fastened to attach the seat 2 to the seat connection member 4, as shown in FIG. 7A, attaching the tilting member 31 on the seat 2 as shown in FIG. 7B, and by fastening the bolts 32, 32 again. In this way, the seat 2 can be rocked in intended directions in a state that the seat 2 is set to a predetermined inclined position with the simplified construction.

Similarly, mounting a tilting member for tiling the seat 2 by a certain degree in the sideways directions enables to tilt the seated surface of the seat 2 by an intended degree in the sideways directions, thereby rocking the seat 2 in intended directions in a state that the seat 2 is set to a predetermined inclined position. In the case where the sizes of the seat connection member 4 in the longitudinal directions and the sideways directions are substantially identical to each other, and bolt holes are symmetrically formed with each other, it is possible to tilt the seat 2 in the longitudinal directions or the sideways directions by mounting a tilting member at a position 90 degrees displaced clockwise or counterclockwise. Further alternatively, tilting members may be provided in such a manner as to tilt the seat 2 both in the longitudinal directions and in the sideways directions.

Figure 8:
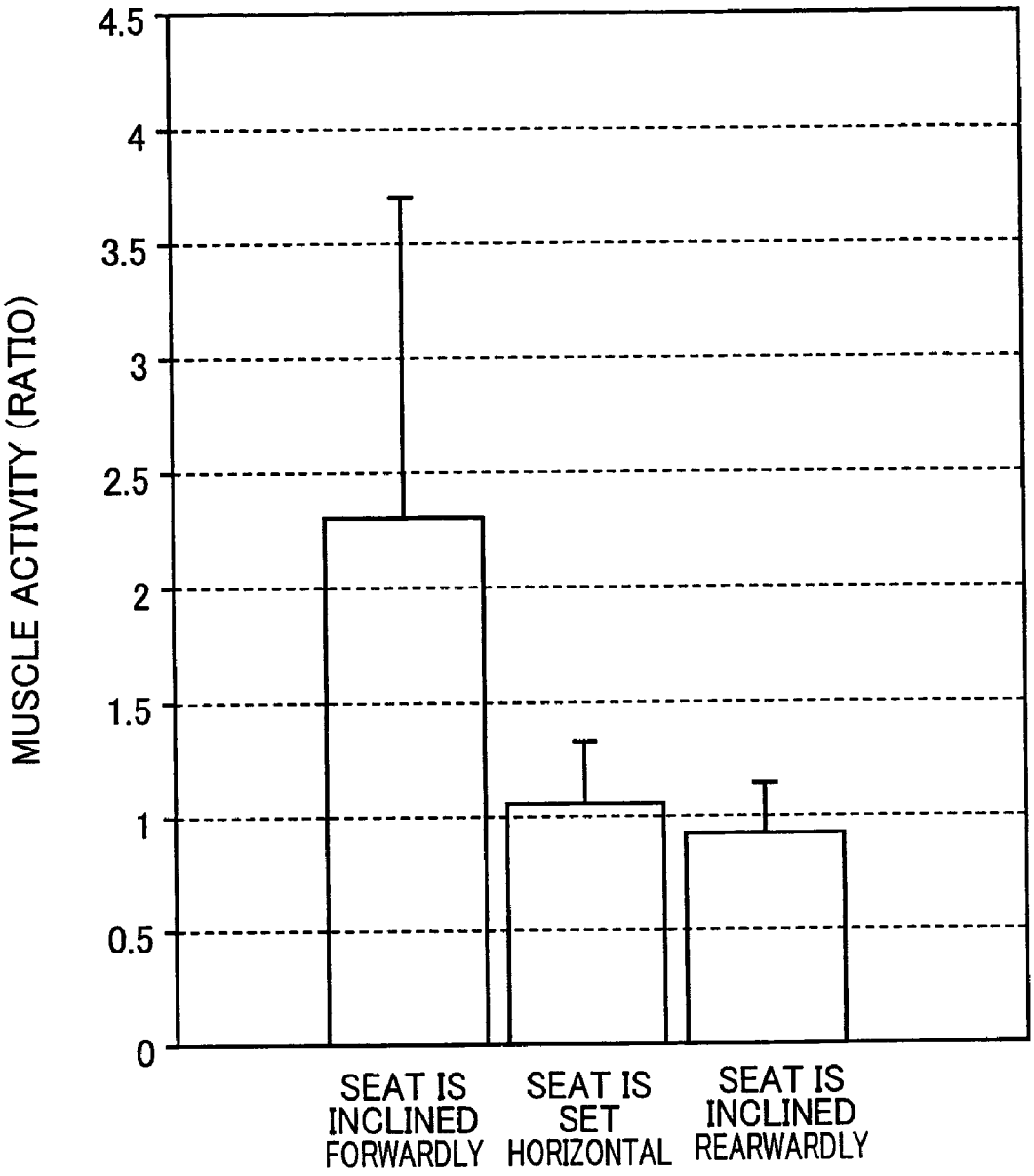
FIG. 8 is a bar graph showing experiment results conducted by the inventors showing amounts of muscle activity of rectus muscle of abdomen, which is part of the muscle of abdomen.
Figure 9:
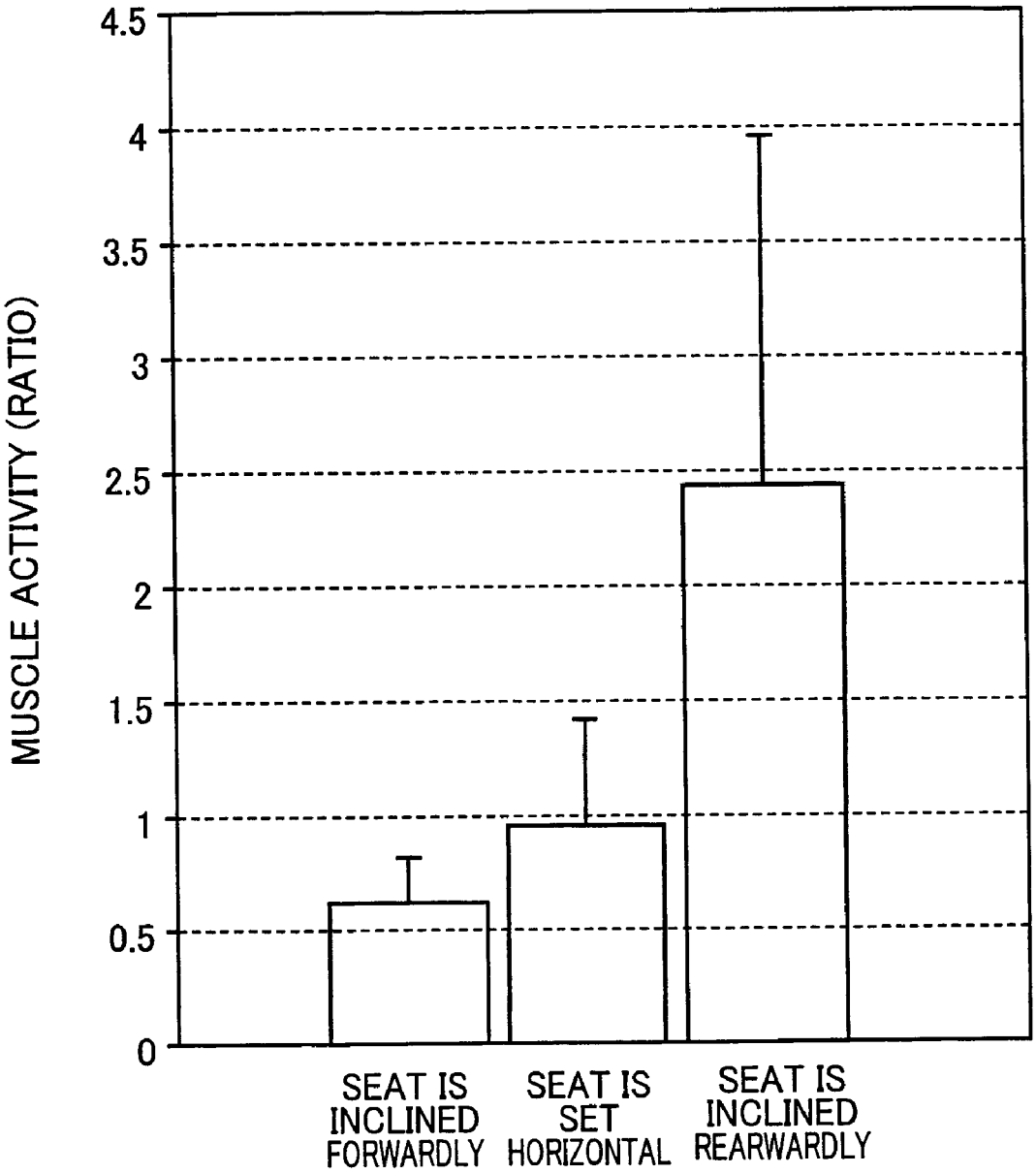
FIG. 9 is a bar graph showing experiment results conducted by the inventors showing amounts of muscle activity of paraspinal muscle, which is part of the muscle of back.

FIGS. 8 and 9 are bar graphs showing experiment results conducted by the inventors. FIGS. 8 and 9 show amounts of muscle activity of rectus muscle of abdomen, which is part of the muscle of abdomen of subjects, and amounts of muscle activity of paraspinal muscle, which is part of the muscle of back of the subjects, respectively, wherein the left-side bar shows the amount of muscle activity of the subjects in a state that the subjects are seated in the reference position as shown in FIG. 6A, with the seated surface of the seat 2 being held horizontal, the middle bar shows the amount of muscle activity of the subjects in a state that the subjects are seated in a rearwardly inclined position as shown in FIG. 6B, with the tilting member 31 being attached in such a direction as to set the seat 2 in a forwardly inclined position, and the right side bar shows the amount of muscle activity of the subjects in a state that the subjects are seated in a forwardly inclined position as shown in FIG. 6C, with the tilting member 31 being attached in such a direction as to set the seat 2 in a rearwardly inclined position. The respective amounts of muscle activity of the subjects can be measured by a surface electromyogram. FIGS. 8 and 9 show results of nine subjects with the inclination of 10 degrees, wherein the bars represent averages of the muscle activity amounts, and lines represent standard deviations thereof.

As is obvious from FIGS. 8 and 9, when the seat 2 is rocked at the forwardly inclined position, the amount of muscle activity of the rectus muscle of abdomen of the user 33 seated on the seat 2 can be increased, as compared with the other positions of the seat 2. Further, when the seat 2 is rocked at the rearwardly inclined position, the amount of muscle activity of the paraspinal muscle of the user 33 seated on the seat 2 can be increased, as compared with the other positions of the seat 2. The increase of the muscle activity amount can be controlled by changing the inclination of the seat 2. For instance, the amount of abdominal muscle activity is likely to be decreased with age, as compared with the amount of back muscle activity. Accordingly, it is recommended to strengthen the muscle of abdomen with age. In this way, the exercising apparatus 1 enables the user to obtain an intended exercising effect on a specific site of his or her body depending on the physical condition of the user.

As mentioned above, with use of the exercising apparatus 1 in the first embodiment, the user 33 can desirably change the site of his or her body where he or she wishes to obtain an exercise stress by setting the seat 2 in a predetermined inclined position relative to the reference position where the seated surface of the seat 2 is set horizontal when the user 33 straddles the seat 2 with his or her knee joint or hip joint being held at a certain angular position relative to the seat 2, and by rocking the seat 2 in a state that the seat 2 is set in the inclined position. Specifically, the user 33 can selectively strengthen the muscle of abdomen by setting the seat 2 in a forwardly inclined position, and can selectively strengthen the muscle of back by setting the seat 2 in a rearwardly inclined position. Furthermore, with use of the exercising apparatus 1, the user 33 can selectively strengthen different lateral muscles of his or her body such as oblique abdominal muscle, gluteus medius, and adductor muscle by setting the seat 2 in a sideways inclined position, thereby allowing the user 33 to obtain a sophisticated balance training requiring challenging skills, as compared with an arrangement that a seat is not inclined, namely, a seat is kept in the reference position.

In this way, simply attaching the wedge-shaped tilting member 31 in contact with the bottom surface of the seat 2 and with the upper surface of the seat connection member 4 in a conventional rocking type exercising apparatus enables to provide the user with an intended exercising effect on a specific site of his or her body.

Figure 10A:
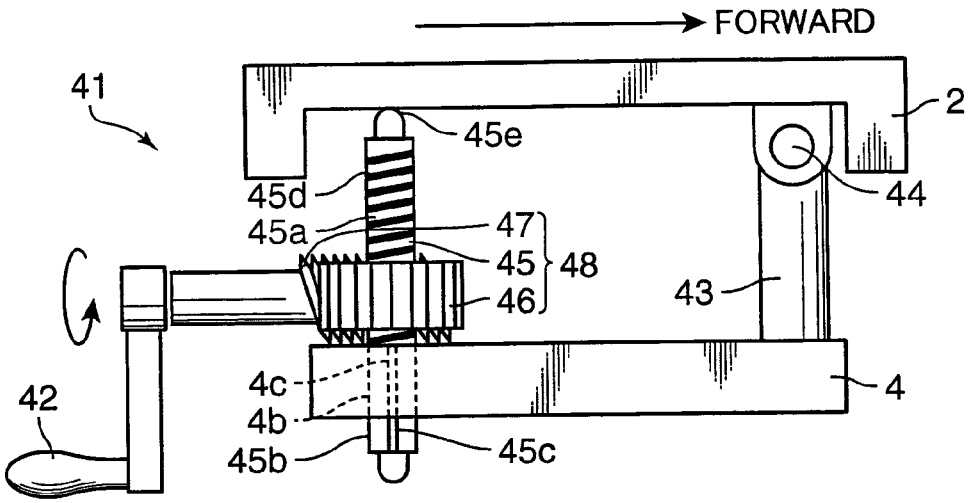
FIGS. 10A and 10B are side views each showing a tilt adjusting unit in a modification.
Figure 10B:
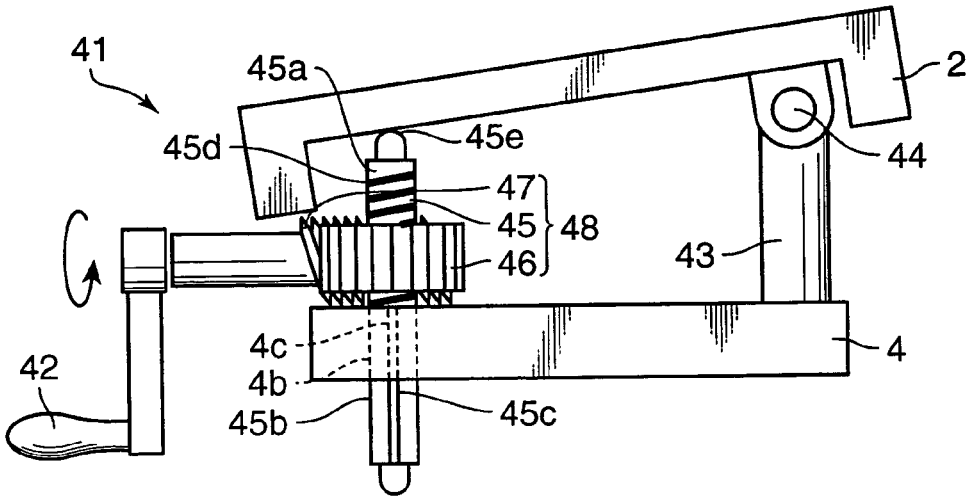
Figure 11:
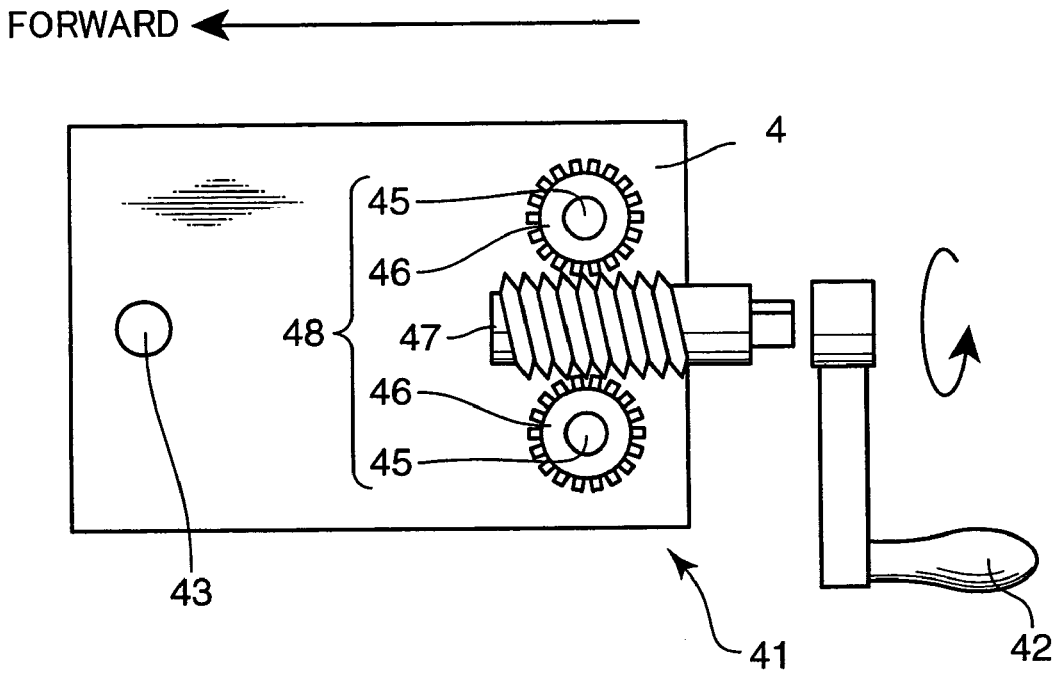
FIG. 11 is a plan view showing the tilt adjusting unit shown in FIGS. 10A and 10B, the seat being removed.

FIGS. 10A and 10B are side views of a tilt adjusting unit 41 which is applicable for the first embodiment of the invention, and FIG. 11 is a plan view of the tilt adjusting unit 41 with a seat 2 being detached from the tilt adjusting unit 41. The tilt adjusting unit 41 is used in the rocking type exercising apparatus 1 as shown in FIGS. 1 through 5B, and is attached in contact with the bottom surface of the seat 2 of the exercising apparatus 1 and the upper surface of the seat connection member 4 of the rocking mechanism 3, as in the case of the tilting member 31 shown in FIGS. 6A through 7B. With use of a handle 42, the tilt adjusting unit 41 enables to adjust the inclination of the seat 2.

Specifically, a support member 43 is provided upright on a front end of the seat connection member 4, which is a base block to be mounted on the upper surface of the rocking mechanism 3. A front end of the bottom surface of the seat 2 is pivotally supported by the support member 43 about a horizontal axis by way of a hinge member 44.

An elevating mechanism 48 comprised of elevating members 45, 45, worm wheels 46, 46, and a worm rod 47 (see FIG. 11) is provided at a rear end on the bottom surface of the seat 2. The elevating member 45 each is in the form of a solid or a hollow cylindrical shape, and is substantially divided into an upper end portion 45*a* and a lower end portion 45*b*. A rib 45*c* extending in an axial direction of the elevating member 45 is formed on the outer surface of the lower end portion 45*b*. A hole 4*b* including an engaging groove 4*c* extending in the axial direction of the elevating member 45 is formed in the inner surface of the seat connection member 4, so that the lower end portion 45*b* is fitted in the hole 4*b* of the seat connection member 4. The rib 45*c* engages the engaging groove 4*c* by fitting the lower end portion 45*b* of the elevating member 45 in the hole 4*b* of the seat connection member 4. Thereby, the elevating member 45 is movable up and down in and out of the hole 4*b* with its rotation about the axis thereof being restrained. On the other hand, a spiral rib 45*d* is formed on the outer surface of the upper end portion 45*a* of the elevating member 45. The spiral rib 45*d* formed on the upper end portion 45*a* of the elevating member 45 engages a spiral groove (not shown) which is formed in the inner surface of the worm wheel 46. Further, an upper end portion 45*e* of the elevating member 45 supports the bottom surface of the seat 2 at the rear end thereof. The worm rod 47 is rotatably supported on the seat connection member 4 about a longitudinal axis of rotation, and meshes with the worm wheels 46, 46.

In this arrangement, when a user attaches the handle 42 to the worm rod 47, and rotates the handle 42, the worm wheels 46, 46 are rotated with a great reduction ratio, and the elevating members 45, 45 emerge out of the holes 4*b*, 4*b* in the seat connection member 4, whereby the user is enabled to manually adjust the tilt amount of the seat 2 in the longitudinal directions of the seat 2. For instance, as shown in FIG. 10B, when the user rotates the handle 42 in such a direction as to lower the elevating members 45, 45, the seat 2 is tilted rearwardly.

In the examples of FIGS. 10A, 10B, and 11, the worm rod 47 is provided on the centerline of the seat connection member 4 in the sideways directions of the seat 2, and two pairs each comprised of the elevating member 45 and the worm 46 are arranged symmetrical with each other in the sideways directions of the seat 2. Alternatively, it is possible to arrange a worm rod 47 at a displaced position with respect to the centerline in the sideways directions of the seat 2, and to arrange a pair of an elevating member 45 and a worm wheel 46 on the centerline. In this embodiment, the ribs 45*c*, 45*d* are formed on the elevating member 45, and the engaging groove 4*c* and the spiral groove are formed in the seat connection member 4 and the worm wheel 46, respectively. Contrary to this, ribs may be formed on the seat connection member 4 and the worm wheel 46, and counterpart grooves may be formed in the elevating member 45.

Figure 12:
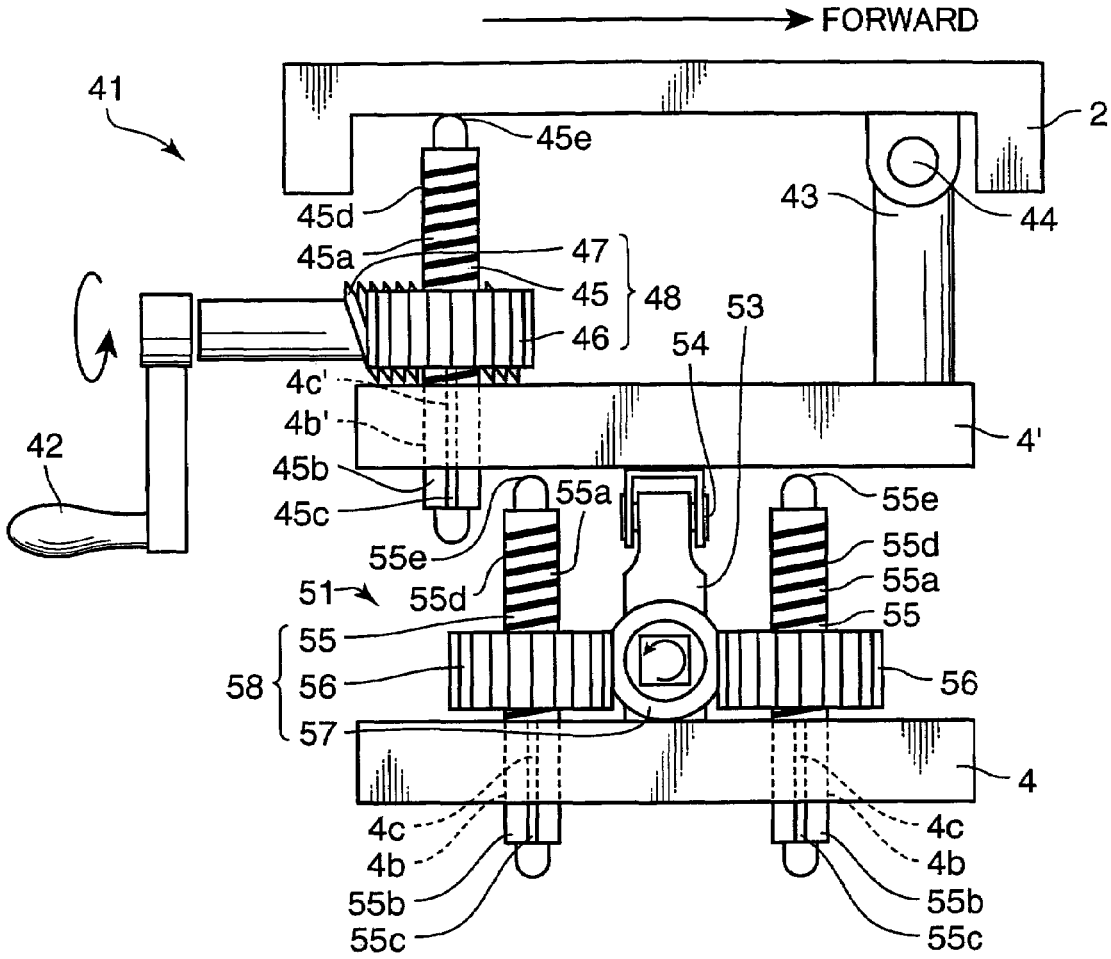
FIG. 12 is a side view of a tilt adjusting unit in another modification.
Figure 13:
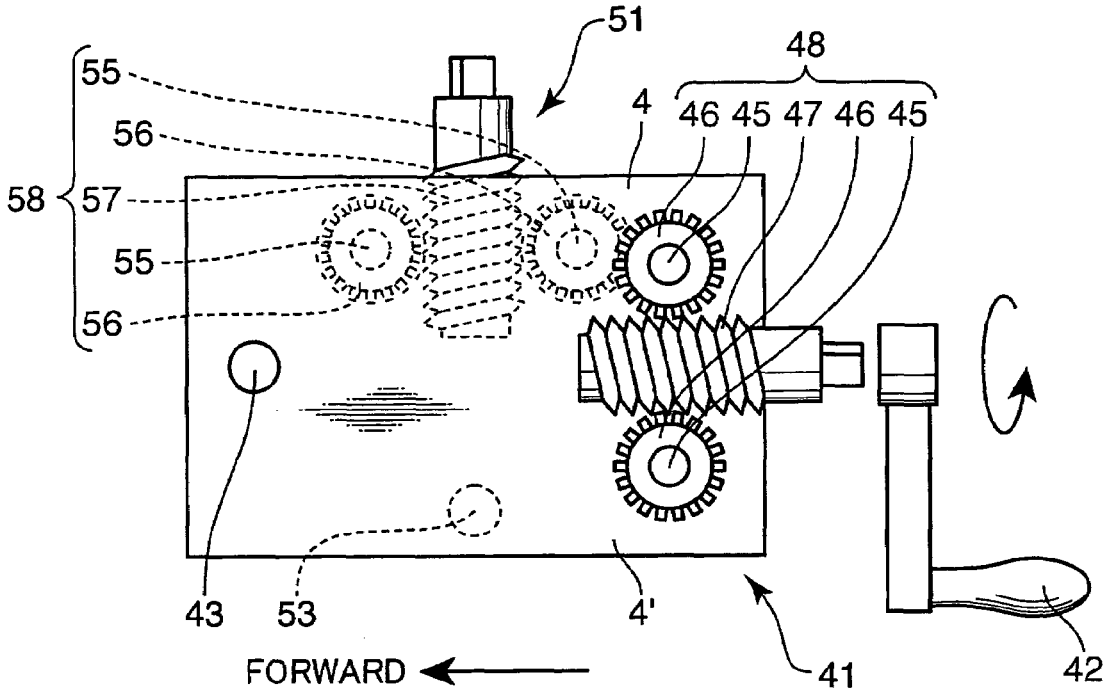
FIG. 13 is a top plan view showing the tilt adjusting unit shown in FIG. 12, the seat being removed.

FIG. 12 is a side view of tilt adjusting units 41, 51 which is applicable for the first embodiment of the invention. FIG. 13 is a plan view showing a state that a seat 2 is detached from the tilt adjusting units 41, 51. The construction of the tilt adjusting unit 41 in this modification is the same as that of the tilt adjusting unit 41 in the previous modification as shown in FIGS. 10A, 10B, and 11. This modification is different from the previous modification in that the tilt adjusting unit 51 which has the construction identical to that of the tilt adjusting unit 41 is provided above the tilt adjusting unit 41. Specifically, the tilt adjusting unit 41 for adjusting the inclination of the seat 2 in the longitudinal directions thereof is arranged above the tilt adjusting unit 51, and the tilt adjusting unit 51 for adjusting the inclination of the seat 2 in the sideways directions thereof is provided below the tilt adjusting unit 41. The tilt adjusting unit 51 is mounted on a seat connection member 4, and the tilt adjusting unit 41 is mounted on a seat connection member 4', respectively to support the seat 2.

Elements in FIGS. 12 and 13 which are identical to those in FIGS. 10A, 10B, and 11 are denoted at the same reference numerals, and description thereof is omitted herein. The constructions of the tilt adjusting units 41, 51 are identical to each other, except that the tilt adjusting unit 51 is mounted on the seat connection member 4 at a position 90 degrees displaced clockwise or counterclockwise with respect to the mounted position of the tilt adjusting unit 41 on the seat connection member 4'. A support member 53 is provided upright at a left end of the seat connection member 4 on the plane of FIG. 13, and a left end of the bottom surface of the seat connection member 4' is pivotally supported by the support member 53 about a horizontal axis by way of a hinge member 54. The seat connection member 4 serves as a base block to be mounted on the upper surface of a rocking mechanism 3.

An elevating mechanism 58 comprised of elevating members 55, 55, worm wheels 56, 56, and a worm rod 57 is provided on a right end of the bottom surface of the seat connection member 4' on the plane of FIG. 13. The elevating member 55 each is in the form of a solid cylindrical shape or a hollow cylindrical shape, and is substantially divided into an upper end portion 55*a* and a lower end portion 55*b*. A rib 55*c* extending in an axial direction of the elevating member 55 is formed on the outer surface of the lower end portion 55*b*. A hole 4*b* including an engaging groove 4*c* extending in the axial direction of the elevating member 55 is formed in the inner surface of the seat connection member 4, so that the lower end portion 55*b* is fitted in the hole 4*b* of the seat connection member 4. The rib 55*c* engages the engaging groove 4*c* by fitting the lower end portion 55*b* of the elevating member 55 in the hole 4*b* of the seat connection member 4. Thereby, the elevating member 55 is movable up and down in and out of the hole 4*b* with its rotation about the axis thereof being restrained. On the other hand, a spiral rib 55*d* is formed on the outer surface of the upper end portion 55*a* of the elevating member 55. The spiral rib 55*d* formed on the upper end portion 55*a* of the elevating member 55 engages a spiral groove (not shown) which is formed in the inner surface of the worm wheel 56. Further, an upper end portion 55*e* of the elevating member 55 supports the bottom surface of the seat connection member 4' at a right end of the bottom surface thereof on the plane of FIG. 13. The worm rod 57 is rotatably supported on the seat connection member 4 about a transversely extending axis of rotation, and meshes with the worm wheels 56, 56.

The tilt adjusting unit 41 is provided on the seat connection member 4'. Fitting a lower end portion 45*b* of an elevating member 45 in a hole 4*b'* formed in the seat connection member 4' enables to engage a rib 45*c* formed on the lower end portion 45*b* of the elevating member 45 in an engaging groove 4*c'* of the hole 4*b'*, whereby the elevating member 45 is movable up and down in and out of the hole 4*b'*, with its rotation about an axis thereof being restrained.

In the above arrangement, when a user attaches a handle 42 to a worm rod 47 (57), and rotates the handle 42, the worm wheels 46, 46 (56, 56) are rotated with a great reduction ratio, and the elevating members 45, 45 (55, 55) emerge out of the hole 4*b'*, 4*b'* (4*b*, 4*b*), whereby the user is enabled to manually adjust the tilt amounts of the seat 2 in the longitudinal directions and in the sideways directions thereof. In this way, preparing the tilt adjusting units 41, 51 for tiling the seat 2 in the longitudinal directions and in the sideways directions respectively, and arranging the tilt adjusting units 41, 51 in positions orthogonal to each other enables to tilt the seat 2 in two different directions, namely, in the longitudinal directions and in the sideways directions of the seat 2.

Figure 14:
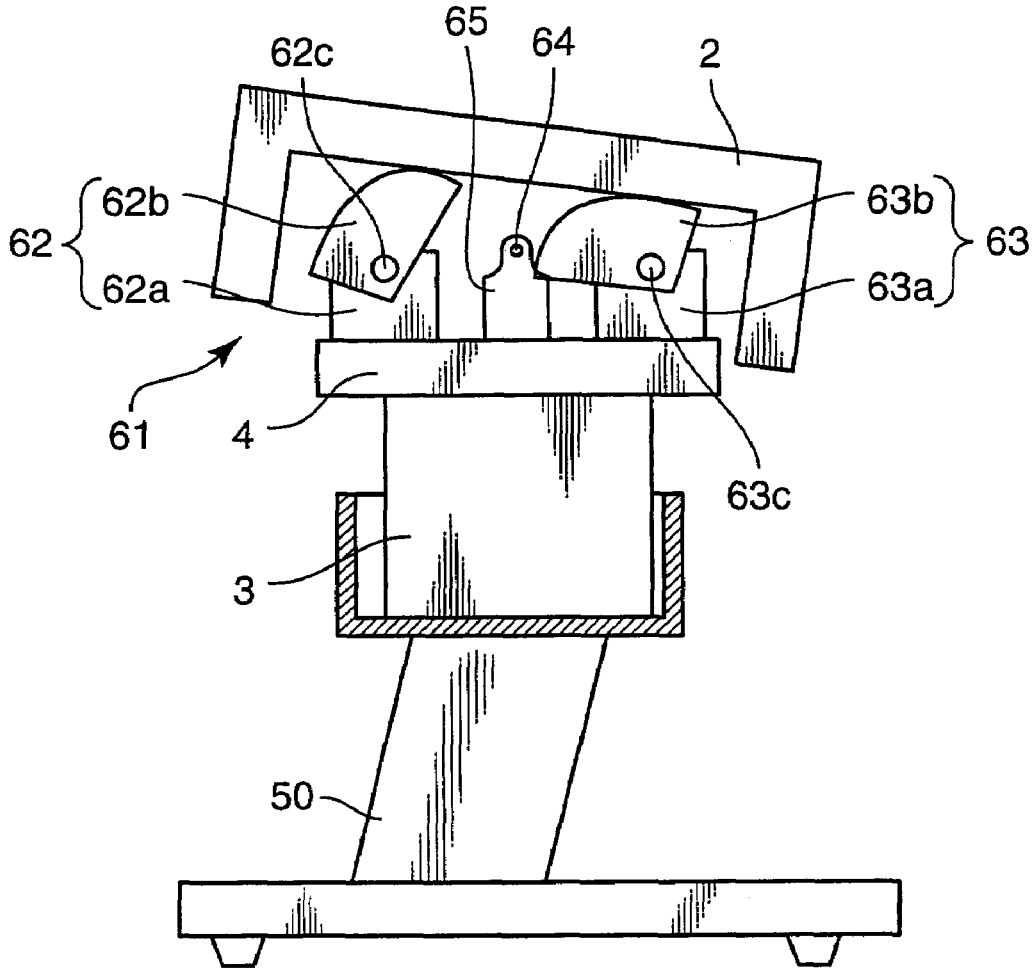
FIG. 14 is a side view of a tilt adjusting unit in still another modification.

FIG. 14 is a side view of a tilt adjusting unit 61 which is applicable for the first embodiment of the invention. Similarly to the foregoing modifications, the tilt adjusting unit 61 is used in the rocking type exercising apparatus 1 as shown in FIGS. 1 through 5B. Elements in this modification which are equivalent to those in FIG. 1 are denoted at the same reference numerals, and description thereof is omitted herein. This modification is different from the foregoing embodiment in that the tilt adjusting unit 61 is capable of adjusting the inclination of a seat 2 in the longitudinal directions thereof by an electric control unit. In view of this, a support member 65 for pivotally supporting the seat 2 at the bottom surface of the seat 2, and a universal joint 64 are arranged on a seat connection member 4 at a position substantially corresponding to an intermediate portion of the seat 2 in the longitudinal directions thereof. Elevating mechanisms 62, 63 are provided at positions symmetrical with each other with respect to the support member 65 and the universal joint 64 in the longitudinal directions of the seat 2. The elevating mechanism 62 is provided on the rear side, and the elevating mechanism 63 is provided on the front side with respect to the support member 65 and the universal joint 64.

Figure 15:
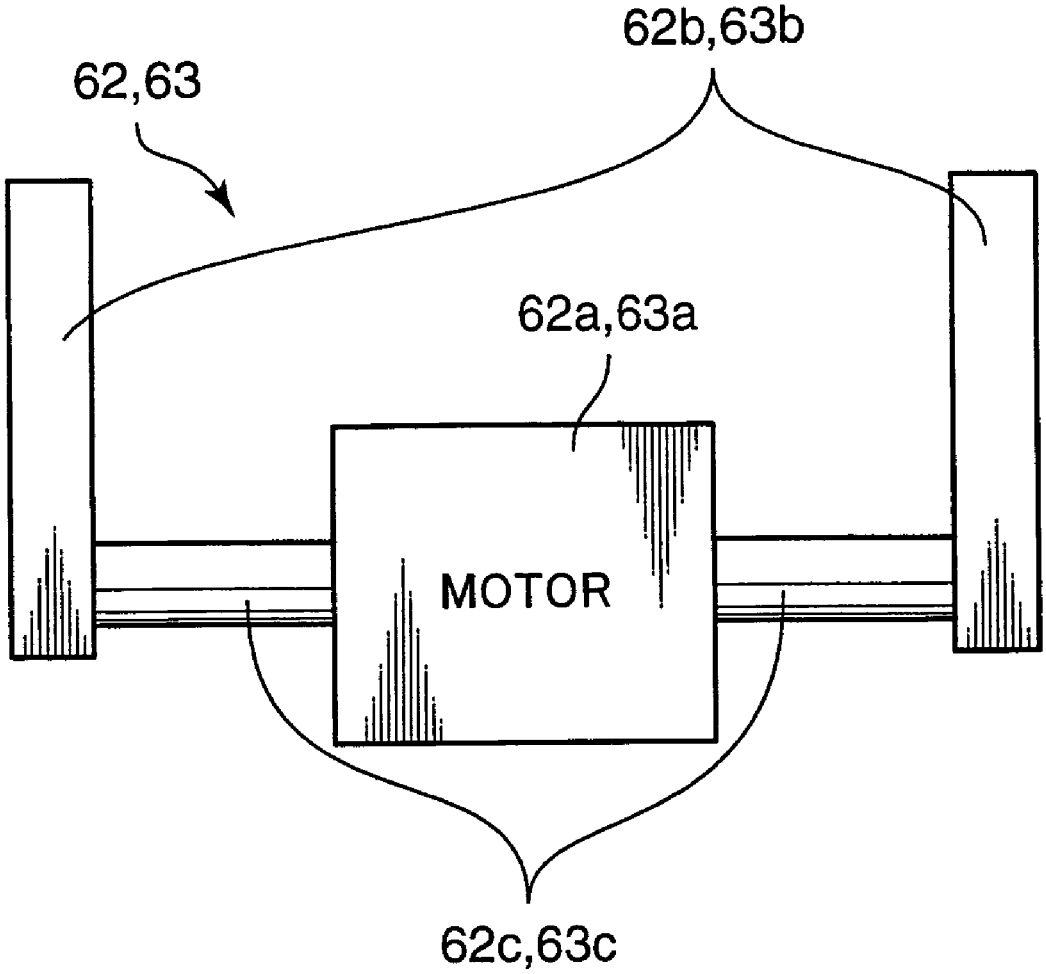
FIG. 15 is an enlarged illustration of an elevating mechanism to be used in the tilt adjusting unit shown in FIG. 14.

As shown in FIGS. 14 and 15, the elevating mechanism 62 (63) has a motor 62*a* (63*a*) with an output shaft 62*c* (63*c*) extending in the sideways directions of the seat 2, and an eccentric rotary disk 62*b* (63*b*) which is secured to the output shaft 62*c* (63*c*), wherein the eccentric rotary disk 62*b* (63*b*) have different radii depending on its circumferential positions. In the example of FIG. 15, the motor 62*a* (63*a*) is disposed at a middle position in the sideways directions of the seat 2, and the eccentric rotary disks 62*b*, 63*b* in pair support the bottom surface of the seat 2 at symmetrical positions with each other in the sideways directions of the seat 2 by way of the transversely and outwardly extending output shafts 62*c*, 63*c*. Alternatively, a motor may be disposed at a displaced position with respect to the middle position in the sideways directions, and a single eccentric disk may support the bottom surface of the seat 2 at the middle position in the sideways directions by way of an output shaft protruding outwardly toward a left end or a right end thereof. Further alternatively, a speed reduction mechanism may be incorporated in the motors 62*a*, 63*a* as shown in FIGS. 14 and 15 according to needs.

Figure 16A:
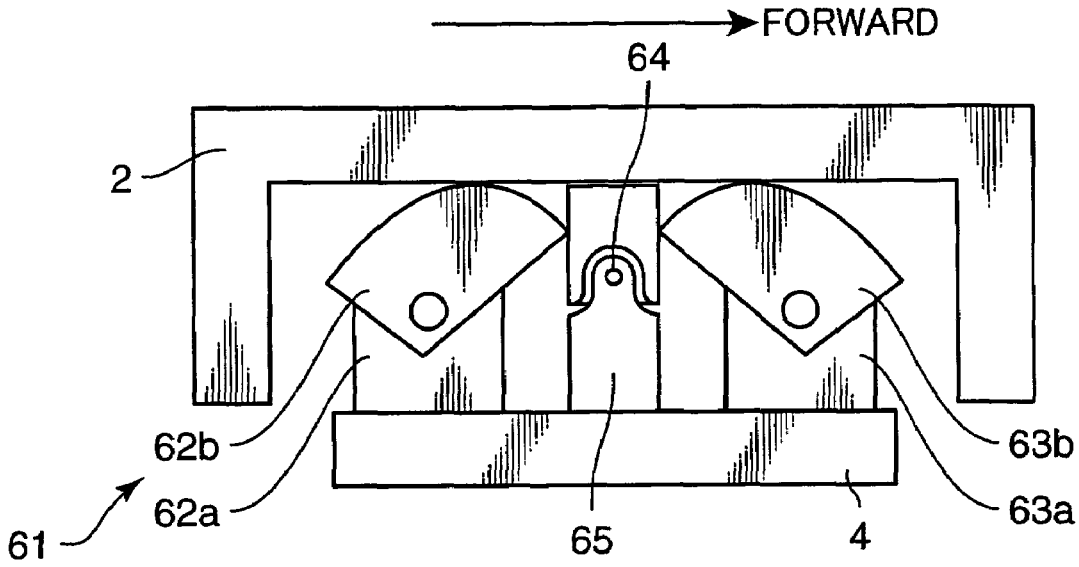
FIGS. 16A and 16B are side views explaining a function of the tilt adjusting unit shown in FIG. 14.
Figure 16B:
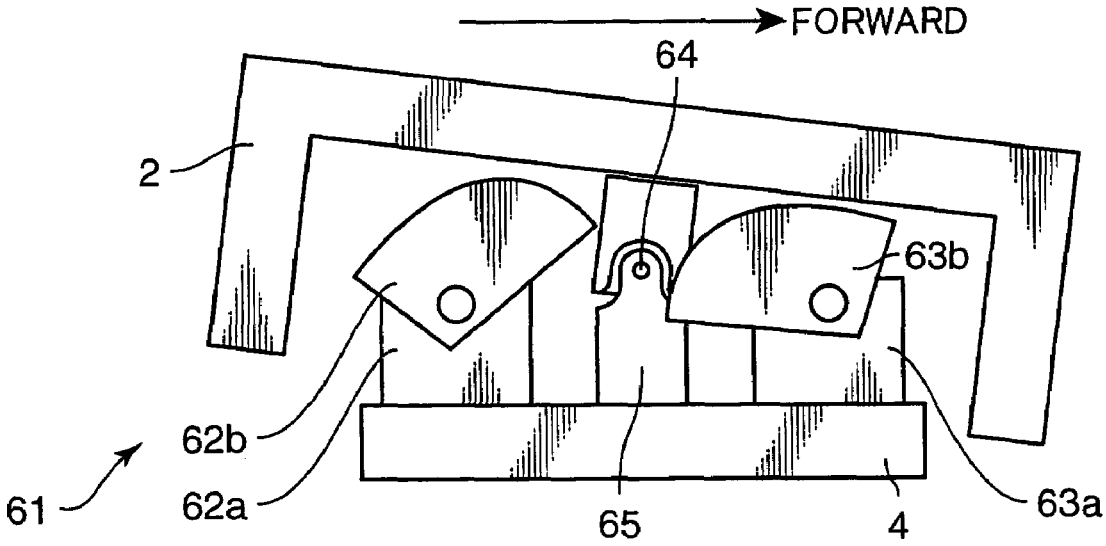

As will be described later, the motors 62*a*, 63*a* are controlled in association with each other. For instance, when the motor 62*a* is driven to rotate the rearwardly arranged eccentric rotary disk 62*b* in such a manner that a large diametrical portion of the eccentric rotary disk 62*b* is in contact with the bottom surface of the seat 2, then, the motor 63*a* is driven in association with the motor 62*a* to rotate the forwardly arranged eccentric rotary disk 63*b* in such a manner that a small diametrical portion of the forwardly arranged eccentric rotary disk 63*b* is in contact with the bottom surface of the seat 2. Thereby, the seat 2 is shifted from a position as shown in FIG. 16A where the eccentric rotary disks 62*b*, 63*b* support the bottom surface of the seat 2 at the circumferentially same positions to a forwardly inclined position as shown in FIG. 16B. In this way, the inclination of the seat 2 in the longitudinal directions can be arbitrarily controlled by driving the motors 62*a*, 63*a* in association with each other.

Figure 17:
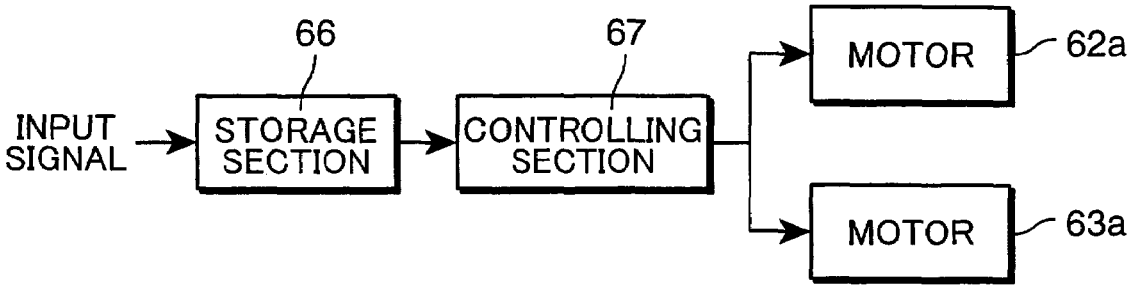
FIG. 17 is a block diagram showing a control circuit of a motor to be used with the tilt adjusting unit shown in FIG. 14.

FIG. 17 is a block diagram showing a control circuit of the motors 62*a*, 63*a*. When a user selects forward inclination or rearward inclination, designates an intended inclination through an unillustrated entering/operating section, an input signal is sent to a storage section 66 serving as a storage section, which, in turn, reads out data such as a pattern of a corresponding driving current for outputting to a controlling section 67. The controlling section 67 drivingly controls the motors 62*a*, 63*a* based on the readout data. In the case that the motors 62*a*, 63*a* are stepping motors, it is possible to controllably set the eccentric rotary disks 62*b*, 63*b* at intended angular positions based on an input pulse number. In such a case, an encoder may be provided on another motor to detect whether the eccentric rotary disks 62*b*, 63*b* have reached the intended angular positions for feedback control in the controlling section 67.

Figure 18:
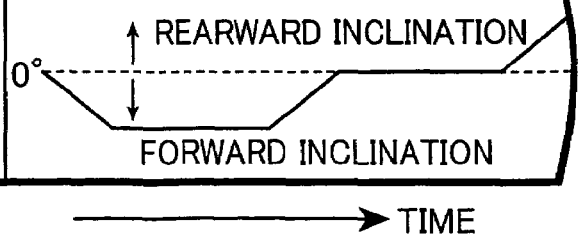
FIG. 18 is a chart explaining how the inclined position of a seat attached with the tilt adjusting unit shown in FIG. 14 is changed with time.

The storage section 66 stores therein a control pattern based on time. In response to receiving an input signal through manipulation by the user, the time-based control pattern stored in the storage section 66 is read out and is sent to the controlling section 67 successively. The controlling section 67 changes the inclination of the seat 2 in the longitudinal directions with time in response to the readout control pattern. An example of a change of the inclination with time is illustrated in FIG. 18. The chart shown in FIG. 18 shows relations between control signals to be inputted to the motors 62*a*, 63*a*, and changes of the inclination of the seat 2 with respect to the horizontal position of the seat 2 with time.

As shown in FIG. 18, the position of the seat 2 can be serially changed from a horizontal position to a forwardly inclined position, to the horizontal position, to a rearwardly inclined position, to the horizontal position, to the forwardly inclined position, and so on by changing the control signal with time during exercising with use of the exercising apparatus 1. This arrangement provides versatile exercising menus, and keeps the user from getting bored with the exercising. If the position of the seat 2 is cyclically changed, as shown in FIG. 18, rhythmical exercising responsive to the change of the position of the seat 2 is provided, thereby letting the user feel the exercising fun, and encouraging the user to continue the exercising. On the other hand, if the position of the seat 2 is changed at random, unexpected sensation is given to the user, which also encourages the user to continue the exercising.

Alternatively, the storage section 66 may store therein a plurality of patterns of changing the inclination with time, so that the user arbitrarily selects a pattern among the plurality of patterns with use of the unillustrated entering/operating section, which serves as a selecting section. In this arrangement, the kind of exercise and the intensity of exercise can be selected individually among the users each time the exercising apparatus 1 is used to thereby provide the users with a proper exercising effect and encourage the users to continue the exercising. For instance, if the user suffers backache, it is possible to gradually increase the inclination or a maximum changed amount of the inclination.

Alternatively, it is possible to provide a calculating section for outputting a control signal to the controlling section 67 in response to an input signal sent from an external device, in place of reading out data from the storage section 66. In such an altered arrangement, the controlling section 67 can change the inclination of the seat 2 in response to the input signal sent from the external device during the exercising. With this arrangement, the inclination of the seat 2 can be changed in association with a music or an image generated based on the input signal sent from the external device, for instance, in association with a parameter which changes with time, such as a sound volume level of a music or a peak frequency, whereby improved sensation is given to the user. Further alternatively, feedback control is enabled by causing the controlling section 67 to acquire detection results of various sensors with use of the input signal sent from the external device.

Figure 19:
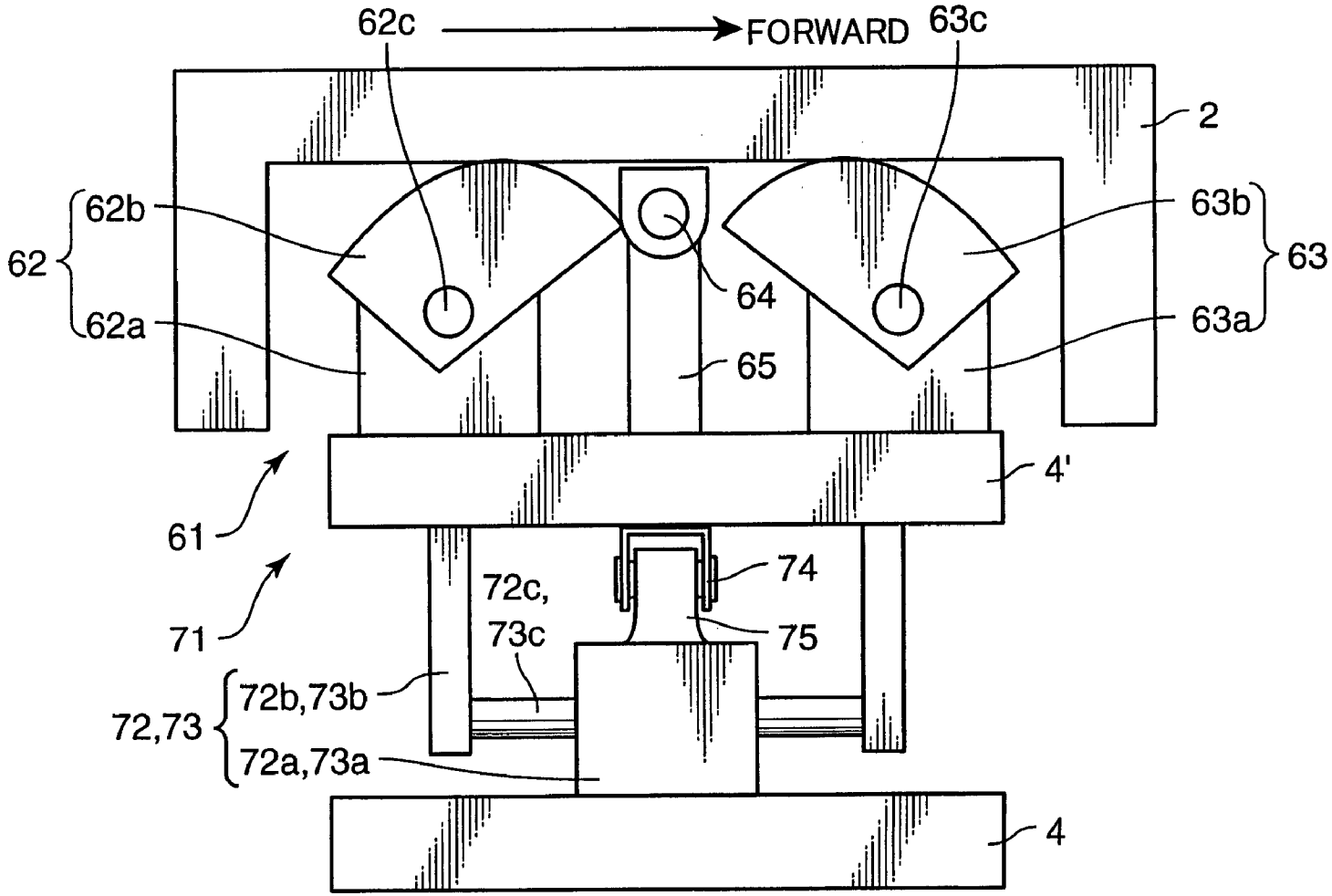
FIG. 19 is a side view of a tilt adjusting unit in a still another modification.

FIG. 19 is a side view of tilt adjusting units 61, 71 which is applicable for the first embodiment of the invention. This modification is similar to the foregoing modifications but is different from these modifications in that the tilt adjusting unit 61 substantially equivalent to the tilt adjusting unit 61 shown in FIGS. 14 through 16B is used for adjusting the inclination of a seat 2 in the longitudinal directions thereof, and that the tilt adjusting unit 71 having the same construction as the tilt adjusting unit 61 is arranged below the tilt adjusting unit 61 for adjusting the inclination of the seat 2 in the sideways directions thereof. In this arrangement, the tilt adjusting unit 71 is mounted on a seat connection member 4, and the tilt adjusting unit 61 is mounted on a seat connection member 4'. In this way, the seat connection member 4 and the seat connection member 4 support the seat 2.

Elements in FIG. 19 equivalent to those in FIGS. 14 through 16B are denoted at the same reference numerals, and description thereof is omitted herein. The tilt adjusting unit 71 is substantially the same as the tilt adjusting unit 61 in construction except that the tilt adjusting unit 71 is mounted at a position 90 degrees displaced clockwise or counterclockwise with respect to the mounted position of the tilt adjusting unit 61. Specifically, a support member 75 for pivotally supporting the seat connection member 4' at the bottom surface thereof, and a universal joint 74 are arranged on the seat connection member 4 at a position substantially corresponding to an intermediate portion of the seat 2 in the longitudinal directions thereof. The seat connection member 4 serves as a base block to be mounted on the upper surface of a rocking mechanism 3. Elevating mechanisms 72, 73 are provided at positions symmetrical with each other with respect to the support member 75 and the universal joint 74 in the sideways directions of the seat 2. The elevating mechanism 72 is provided on the left side, and the elevating mechanism 73 is provided on the right side with respect to the support member 75 and the universal joint 74. The elevating mechanism 72 (73) has a motor 72*a* (73*a*) with an output shaft 72*c* (73*c*) extending in the longitudinal directions, and an eccentric rotary disk 72*b* (73*b*) which is secured to the output shaft 72*c* (73*c*), wherein the eccentric rotary disk 72*b* (73*b*) have different radii depending on its circumferential positions.

Figure 20:
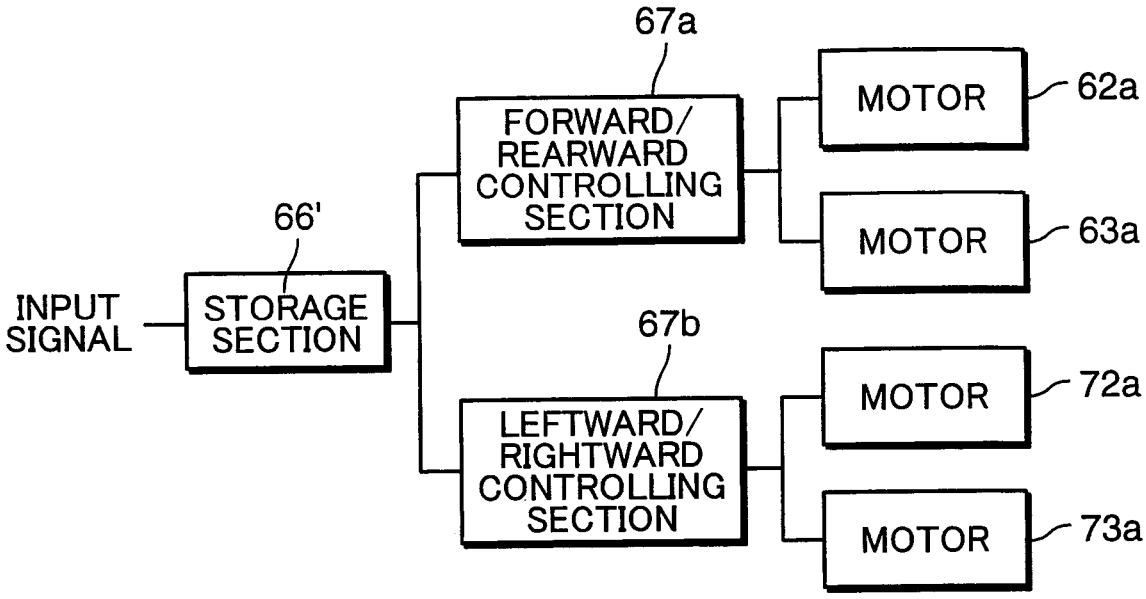
FIG. 20 is a block diagram showing a control circuit of a motor to be used with the tilt adjusting unit shown in FIG. 19.

FIG. 20 illustrates a control circuit for controlling the tilt adjusting units 61, 71. Specifically, the control circuit has a storage section 66' for storing control data for controlling the respective motors 62*a*, 63*a*; 72*a*, 73*a*, a forward/rearward controlling section 67*a* for driving the motors 62*a*, 63*a* to rock the seat 2 in forward and backward directions, and a leftward/rightward controlling section 67*b* for driving the motors 72*a*, 73*a* to rock the seat 2 in leftward and rightward directions.

A control pattern with use of the tilt adjusting units 61, 71 is as shown in the chart of FIG. 21, for instance. Referring to FIG. 21, "0" represents a neutral position of the seat 2, wherein the height levels of the elevating mechanisms 62, 63 in pair and the height levels of the elevating mechanisms 72, 73 in pair are set substantially identical to each other, respectively. In this arrangement, the inclined position of the seat 2 can be arbitrarily set both in the longitudinal directions and in the sideways directions. Furthermore, it is possible to change the inclined position of the seat 2, as if change of the inclined position of the seat 2 makes a circular movement by displacing the height levels of the elevating mechanisms 62, 63 (72, 73) from each other in terms of time phase, namely, by moving the elevating mechanisms 62, 63 (72, 73) up and down in a displaced manner. Alternatively, cyclically changing the inclined position of the seat 2 from a forwardly inclined position to a rearwardly inclined position and to the forwardly inclined position, or from the forwardly inclined position to the rightwardly inclined position, to the rearwardly inclined position, to the leftwardly inclined position, and to the forward inclined position enables to provide the user with rhythmical sensation, and accordingly, provide the user with a rhythmical exercising responsive to a change of the position of the seat 2, thereby letting the user feel the exercising fun, and encouraging the user in continuing the exercising.

In the case where the inclined position of the seat 2 in the longitudinal directions and the inclined position of the seat 2 in the sideways directions with time are identical to each other, as shown in FIG. 21, it is possible to read out control data from a common storage section for controllably driving a motor, in place of reading out control data for controlling a motor in the case where the readout data is 0. Specifically, the forward/backward controlling section 67*a* or the leftward/rightward controlling section 67*b*, which needs controlling, may read out control data for controlling the elevating mechanism pair 62, 63 or the elevating mechanism pair 72, 73 with use of a common storage section for use in control of the inclined position of the seat 2 in the longitudinal directions and in the sideways directions.

Alternatively, providing three elevating mechanisms on the seat connection member 4 makes it possible to change the inclination of the seat 2 both in the longitudinal directions and in the sideways directions. For instance, in the case where an elevating mechanism A is provided at a forward position of the seat connection member 4, an elevating mechanism B is provided on a rearward left side of the seat connection member 4, and an elevating mechanism C is provided on a rearward right side of the seat connection member 4, a control pattern is as shown in the chart of FIG. 22. With such an altered arrangement, the seat 2 can be set to an arbitrary inclined position in the longitudinal directions and in the sideways direction, as well as in the embodiment.

Figure 23:
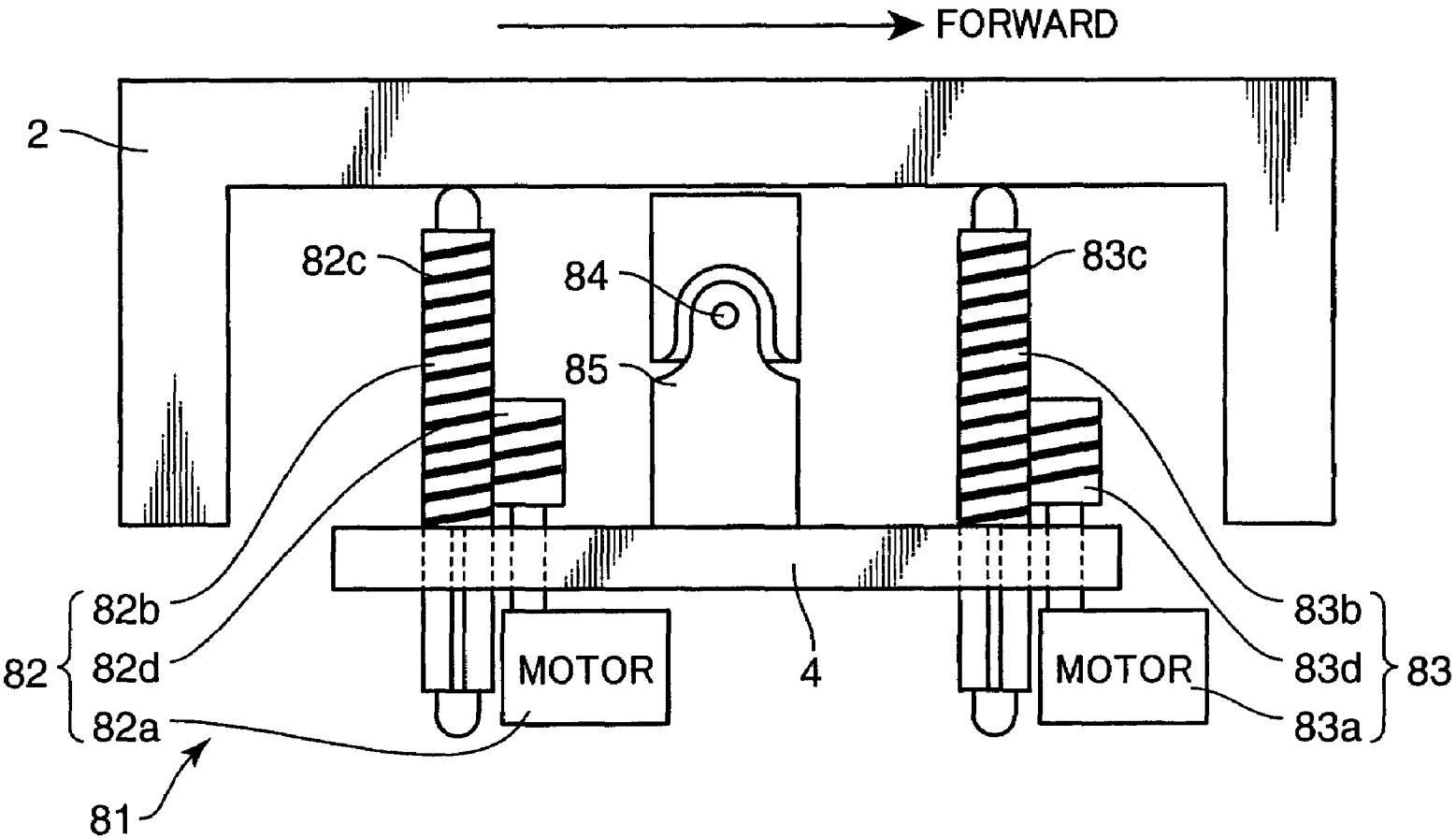
FIG. 23 is a side view of a tilt adjusting unit in a further modification.

FIG. 23 is a side view of a tilt adjusting unit 81 which is applicable for the first embodiment of the invention. This modification is similar to the modification shown in FIGS. 10A and 10B, and to the modification shown in FIG. 14. Specifically, a support member 85 for pivotally supporting a seat 2 at the bottom surface thereof, and a universal joint 84 are arranged on a seat connection member 4 at a position substantially corresponding to an intermediate portion of the seat 2 in the longitudinal directions thereof. Elevating mechanisms 82, 83 are arranged at positions symmetrical with each other with respect to the support member 85 and the universal joint 84 in the longitudinal directions.

The elevating mechanism 82 (83) includes an elevating member 82*b* (83*b*) equivalent to the elevating member 45, a screw 82*d* (83*d*) which is pivotally supported on the seat connection member 4 about a vertical axis, and which is engaged with a rib 82*c* (83*c*) formed on an upper end portion of the elevating member 82*b* (83*b*), and a motor 82*a* (83*a*) for drivingly rotating the screw 82*d* (83*d*). In other words, the elevating mechanism 82 (83) is electrically driven with use of the motor 82*a* (83*a*) in place of the handle 42 used in the modification shown in FIGS. 10A and 10B.

Figure 24A:
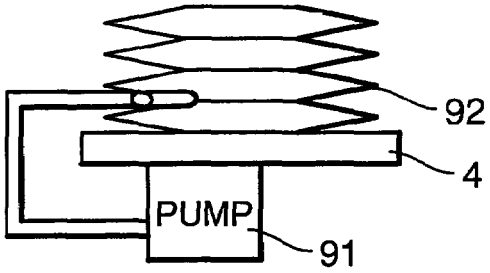
FIGS. 24A and 24B are side views showing a variation of the tilt adjusting unit shown in FIG. 23.
Figure 24B:
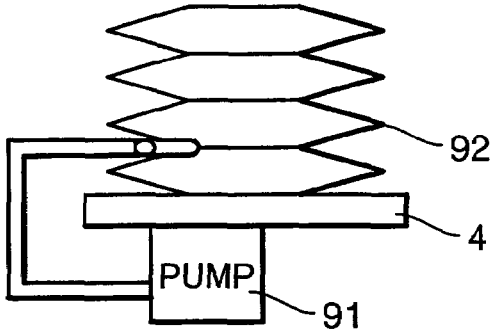

Alternatively, the elevating mechanism may comprise a pump 91 and an air jack 92 as shown in FIGS. 24A and 24B. In such an altered arrangement, the inclination of the seat 2 can be selectively changed by switching over the state of the elevating mechanism between a contracted state as shown in FIG. 24A and an expanded state as shown in FIG. 24B.

Further alternatively, in a case that a rocking mechanism 3 has a rocking mechanism of a high latitude, it is possible to cause the rocking mechanism 3 to tilt the seat 2 in place of using a dedicated tilt adjusting unit comprised of a gear and a cam as an additional part, as in the foregoing embodiment.

Figure 25:
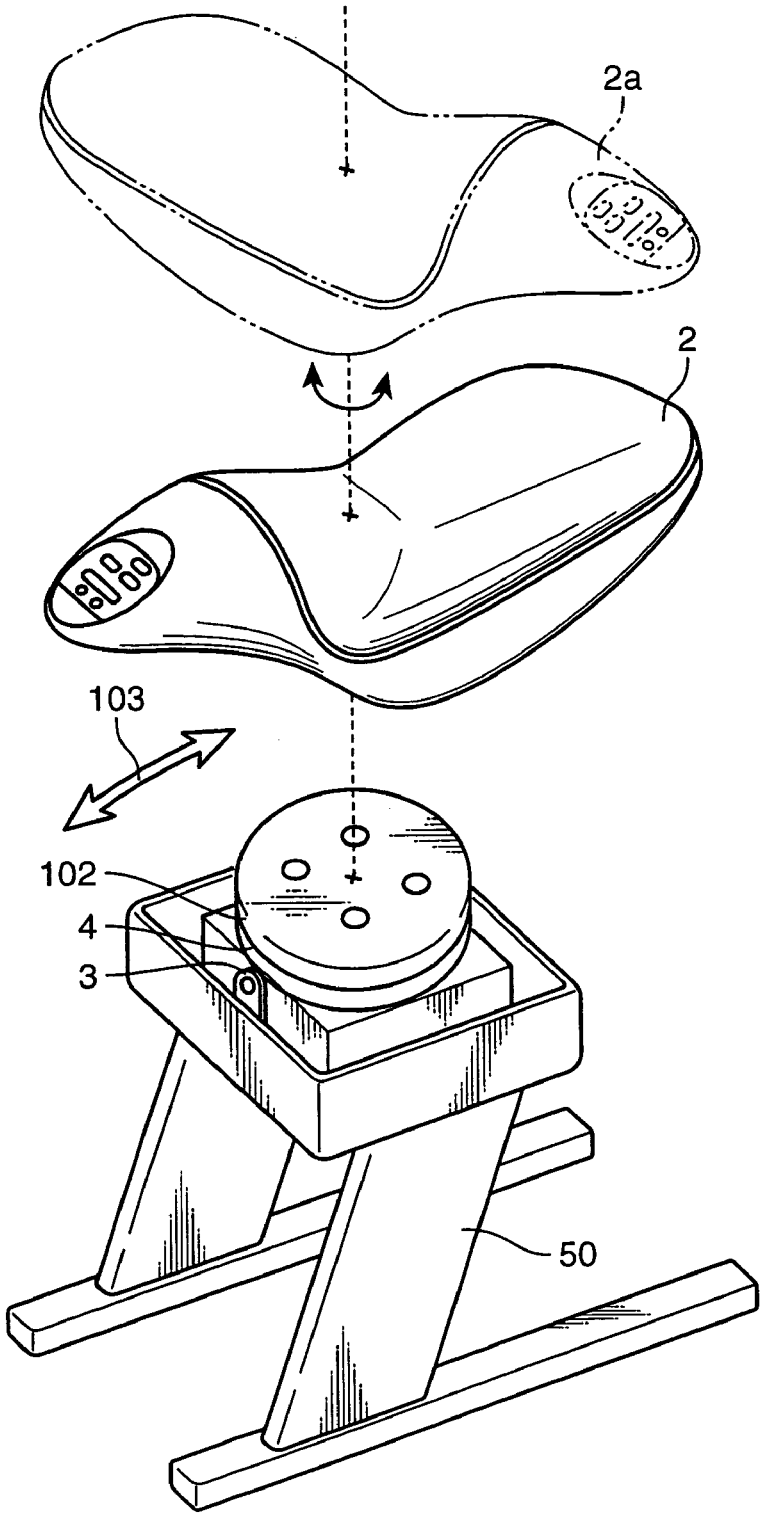
FIG. 25 is an explosive perspective view showing an entire construction of a rocking type exercising apparatus in a still further modification.

FIG. 25 is an explosive perspective view showing an entire construction of a rocking type exercising apparatus 101 as another modification. This modification is different from the foregoing embodiment and modifications in that the exercising apparatus 101 equivalent to the exercising apparatus 1 is additionally provided with a rotating mechanism 102 for pivotally rotating a seat 2 about a vertical axis in an initial state of driving of the exercising apparatus 101. Elements in the exercising apparatus 101 which are equivalent to those in the exercising apparatus 1 are denoted at the same reference numerals, and description thereof is omitted herein. The rotating mechanism 102 serving as a rotation supplier is constituted of a rotary disk member mounted on a seat connection member 4 of a driving mechanism 3. The seat 2 is rotatable by mounting the seat 2 onto the rotary disk member of the rotating mechanism 102. If the latitude of a rocking mechanism of the rocking mechanism 3 is relatively high, it is possible to cause the driving mechanism 3 to generate a rotating force, so that the seat 2 rotates in an initial state of driving of the exercising apparatus 101.

Rotating the seat 2 in an initial state of driving of the exercising apparatus 101 in an arrangement of rocking the seat 2 in predetermined directions shown by the arrows 103 in FIG. 25 to give a stress of exercise to a user enables to change a pattern of applying the stress to the user's body while the seat 2 is rocked in the predetermined directions. For instance, rotating the seat 2 while the seat 2 is rocked in forward and backward directions enables to selectively and locally strengthen the lateral muscles of the user's body.

Rotating the seat 2 with time while the seat 2 is rocked enables to provide specific exercising effect depending on the rotated position of the seat 2. For instance, quickly changing the position of the seat 2 by pivotal rotation of the seat 2 while the seat 2 is rocked enables to realize a twist exercise of the user's body trunk, and slowly changing the position of the seat 2 by pivotal rotation of the seat 2 while the seat 2 is rocked enables to change the direction of magnitude of rocking motions with time, whereby the user can shift the muscle group for which the user wishes to obtain an exercising effect.

Figure 26:
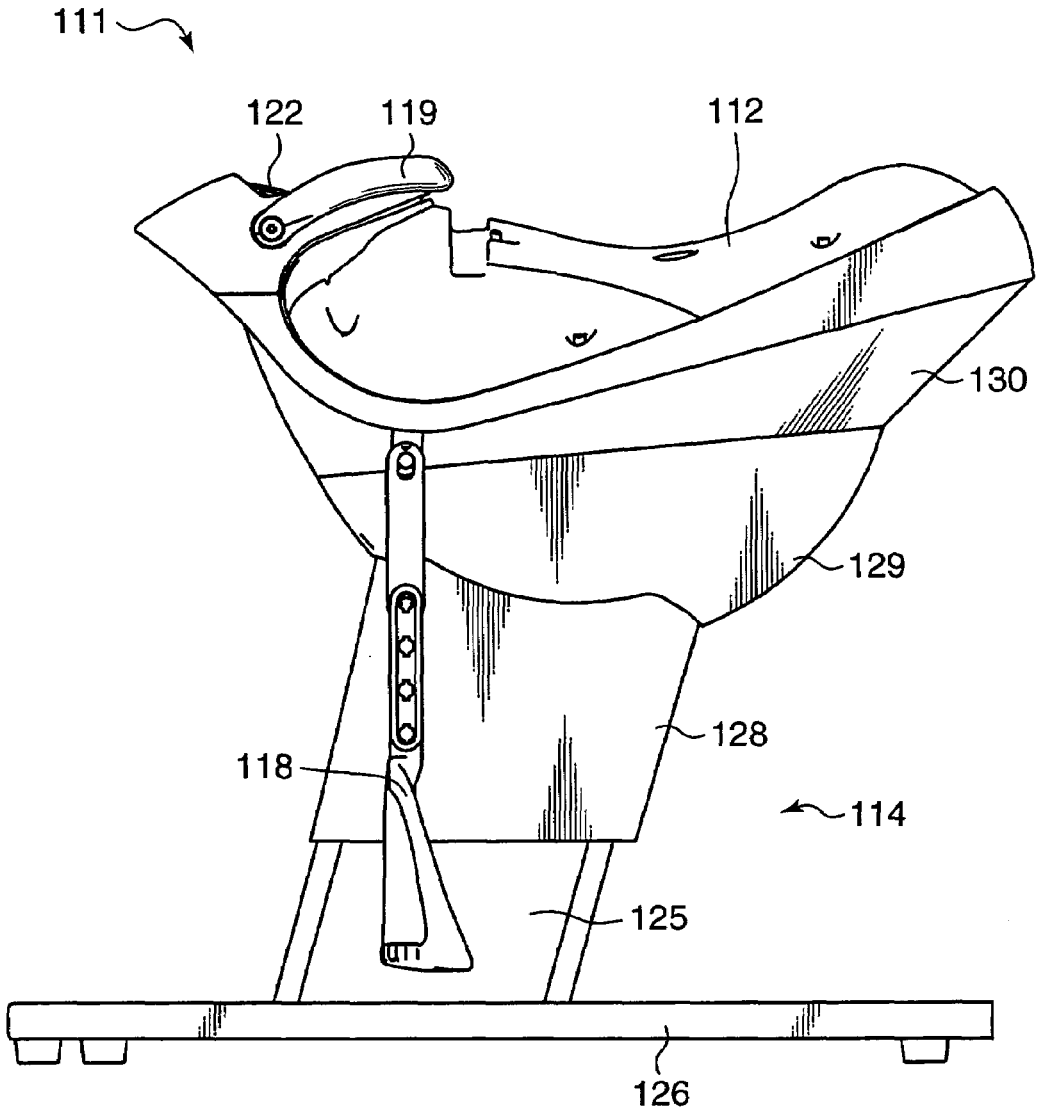
FIG. 26 is a side view showing an entire construction of a rocking type exercising apparatus in a second embodiment of the invention.
Figure 27:
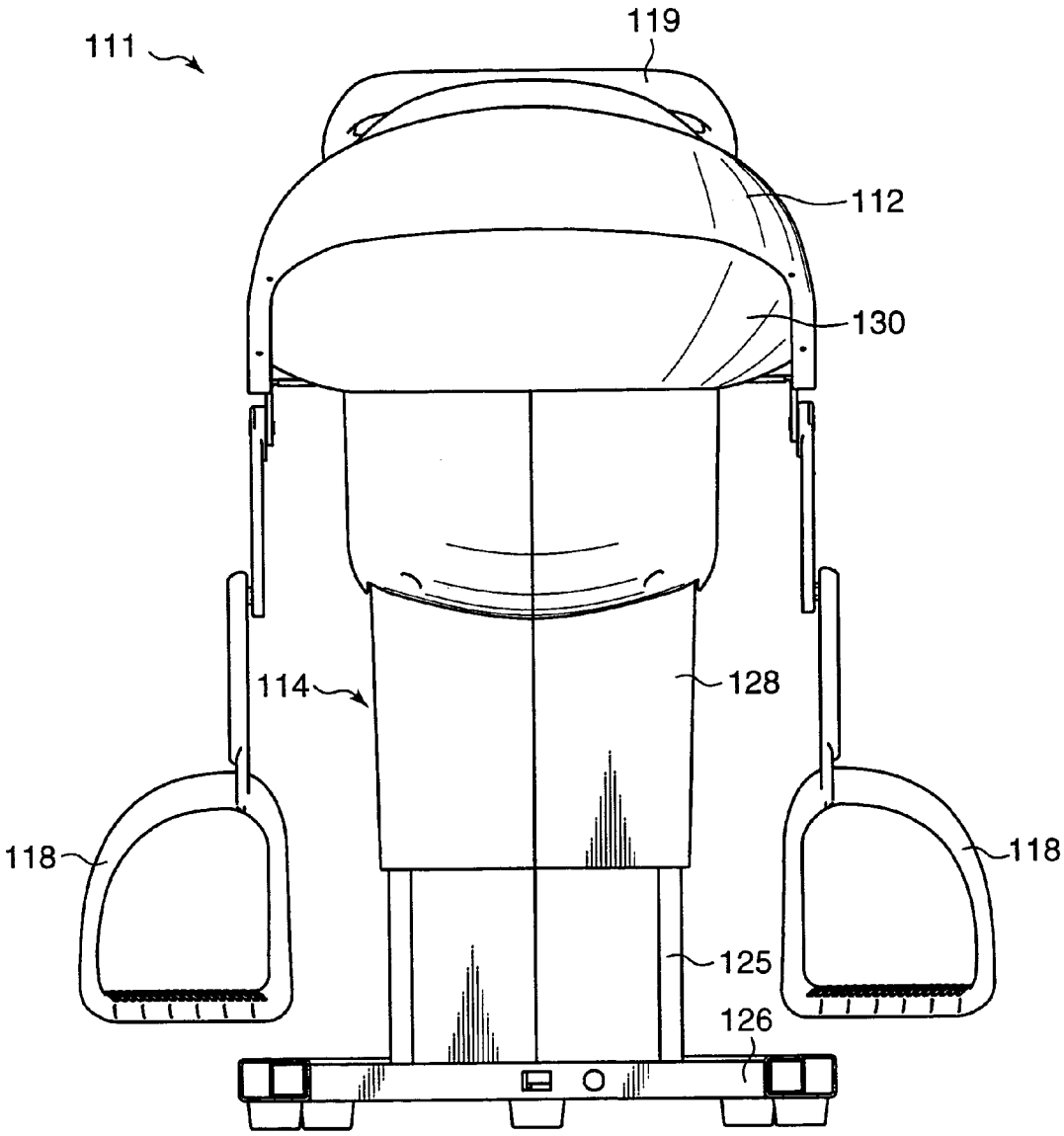
FIG. 27 is a rear view of the rocking type exercising apparatus shown in FIG. 26.
Figure 28:
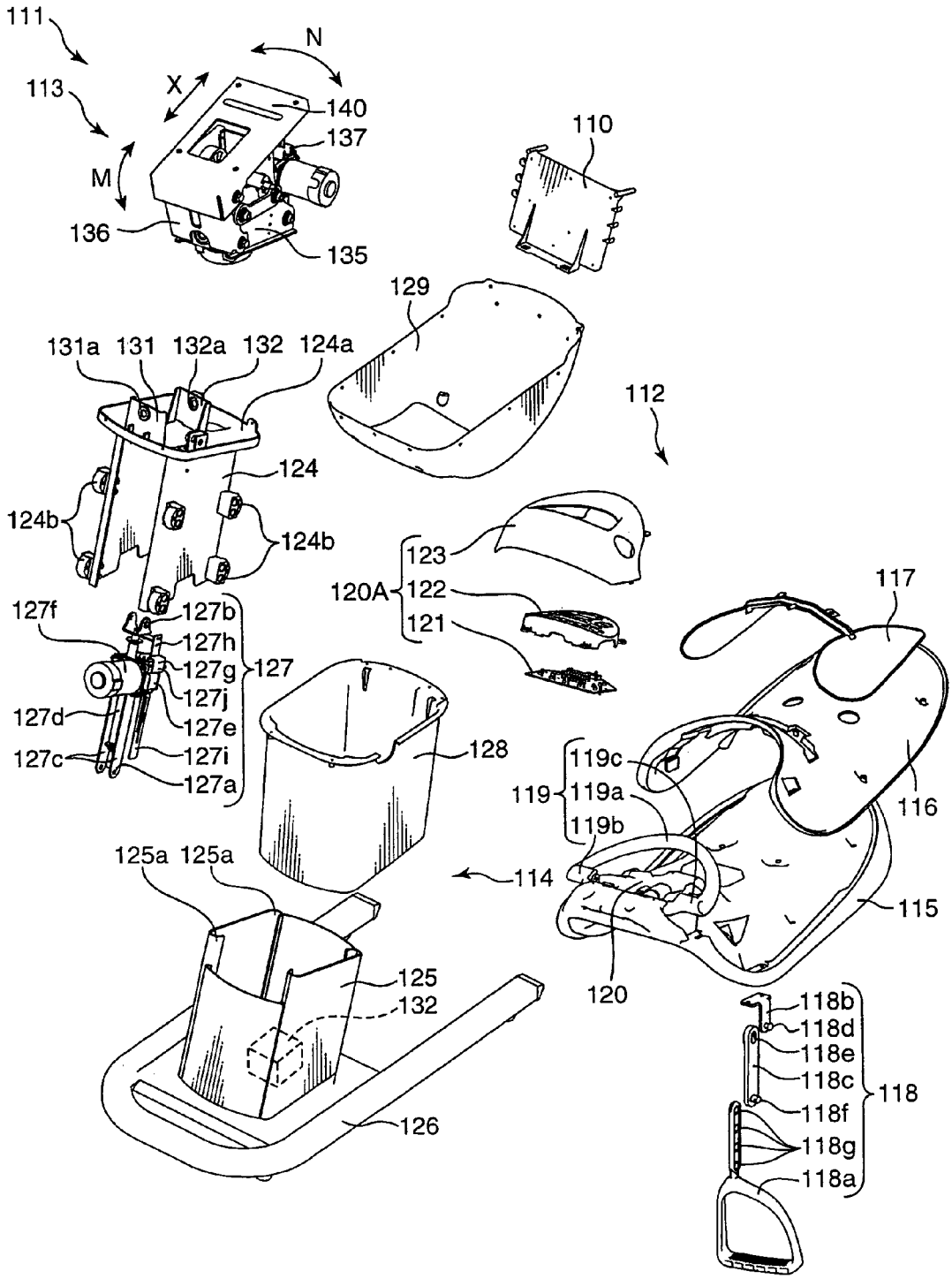
FIG. 28 is an explosive perspective view of the rocking type exercising apparatus shown in FIG. 26.

FIG. 26 is a side view showing an entire construction of a rocking type exercising apparatus 111 as a second embodiment of the invention. FIG. 27 is a rear view of the exercising apparatus 111, and FIG. 28 is an explosive perspective view of the exercising apparatus 111. Similarly to the foregoing embodiment, the exercising apparatus 111 comprises a seat assembly 112 imitating the shape of a horseback or a saddle which the user straddles, a rocking mechanism 113 which is provided inside the seat assembly 112 for driving the seat assembly 112, and a base support member 114 which supports the rocking mechanism 113 and the seat assembly 112 on a floor surface.

As shown in FIG. 28, the seat assembly 112 includes a seat base member 115 mounted on the rocking mechanism 113, a cushion member 116, and an airbag 117, which are placed one over the other in this order. By contracting or expanding the airbag 117, the user can flex his or her hip joints. A pair of stirrups (merely a left-side stirrup is shown in FIG. 28 for sake of simplified illustration) hang from a left side and a right side on a forward portion of the seat assembly 112.

The stirrup 118 has a foot rest 118*a* on which the user rests his or her foot, an attachment piece 118*b* which is secured to the seat base member 115 by fastening a screw, and a connecting piece 118*c* for connecting the foot rest 118*a* to the attachment piece 118*b*. Engaging a pin 118*d* attached to a lower end of the attachment piece 118*b* in a hole 118*e* formed in an upper end portion of the connecting piece 118*c* enables to swing the connecting piece 118*c* about an axis of the pin 118*d*. Engaging a pin 118*f* attached to a lower end of the connecting piece 118*c* in one of a plurality of holes 118*g* formed in an upper end portion of the foot rest 118*a* enables to adjust the length of the stirrup 118, namely, the height of the foot rest 118*a*.

A rein 119 is attached to the front portion of the seat assembly 112. The rein 119 has an arc-shaped handle portion 119*a*, and end portions 119*b*, 119*c* each of which is continued to the arc-shaped handle portion 119*a* radially inwardly. The end portions 119*b*, 119*c* are appropriately supported at widthwise ends on the front portion of the seat assembly 112. In this arrangement, the rein 119 is set to a ready-to-use position or an upright position when the user raises the rein 119 upward, and is set to an accommodated position when the user puts the rein 119 down. The rein 119 is kept from being inclined forwardly beyond the upright position by abutment of contact pieces attached to the end portions 119*b*, 119*c* against contact pieces attached to the seat assembly 112. With this arrangement, the user can easily support his or her body without or less likelihood of forward inclination, even if the seat 2 is set to a forwardly inclined position relative to a reference position, which will be described later.

A support block 120 is mounted on the forward portion of the seat assembly 112. An operating section 120A is constructed by mounting an operating-side circuit board 121 on the support block 120, encasing the operating-side circuit board 121 with a casing member 122, and by covering the casing member 122 with a front panel 123.

The seat assembly 112 having the above construction is mounted on an upper portion of the rocking mechanism 113. The rocking mechanism 113 is mounted on an elevating base member 124. The elevating base member 124 is sidably movable up and down in a hollow space of a leg portion 125 of the base support member 114. The height level of the seat assembly 112 is changeable with respect to the floor surface by the sliding movement of the elevating base member 124. A lower end 127*a* of an elevating mechanism 127 is secured to a leg table 126 of the base support member 114, and an upper end 127*b* of the elevating mechanism 127 is attached to the bottom surface of a support table 124*a* of the elevating base member 124. A plurality of pairs of upper and lower guide rollers 124*b* provided on opposing outer surfaces of the elevating base member 124 run along guide rails 125*a* formed in corresponding positions of inner walls of the leg portion 125. The height level of the seat assembly 112 with respect to the floor surface is raised in response to extension of the elevating mechanism 127, and is lowered in response to contraction of the elevating mechanism 127.

The elevating mechanism 127 has a pair of attachment members 127*c*, 127*c* opposing to each other by a certain gap, an actuating member 127*d* which is housed in the gap between the attachment members 127*c*, 127*c*, a gear box 127*e* attached to upper portions of the attachment members 127*c*, 127*c*, a motor 127*f* for driving the gear box 127*e*, and a height detecting unit 127*g*. A lower end 127*a* of the attachment member 127*c* is attached to the leg table 126, and an upper end thereof is attached to the gear box 127*e*. The actuating member 127*d* includes a ball screw, with an upper end 127*b* thereof being attached to an attachment member 124*x* (see FIG. 30) of the support table 124*a* of the elevating base member 124, and a lower portion thereof having such a shape as to pass through the gear box 127*e*. The ball screw is meshed with an inner screw portion formed in an inner surface of an unillustrated gear provided inside the gear box 127*e*. The actuating member 127*d* extends and contracts in and out of the gap defined by the attachment members 127*c*, 127*c* by driving the gear with use of a worm gear secured to an output shaft of the motor 127*f*, whereby the seat assembly 112 is movable up and down.

The height detecting unit 127*g* detects the height of the seat assembly 112 by causing a position sensor 127*j* to read a displacement of a slit member 127*i* connected to the actuating member 127*d* by a connecting member 127*h*.

Referring to FIG. 28, an elevation cover 128 encases the support table 124*a* of the elevating base member 124 to keep the elevating base member 124 from exposing out of the leg portion 125 when the elevating mechanism 127 is set to an extended position. A mechanism cover 129 covers the support table 124*a* of the elevating base member 124 to keep the rocking mechanism 113 from exposing outside. After the elevation cover 128 and the mechanism cover 129 are attached to the elevating base member 124, a cover sheet 130 (see FIG. 27) made of a stretch fabric covers an upper portion of the mechanism cover 129 and a lower portion of the seat base member 115.

Further, an apparatus-side circuit board 110 is mounted on the support table 124*a* of the elevating base member 124, and a power transformer 132 for heavy load is housed in the leg portion 125 on the leg table 126.

Figure 29:
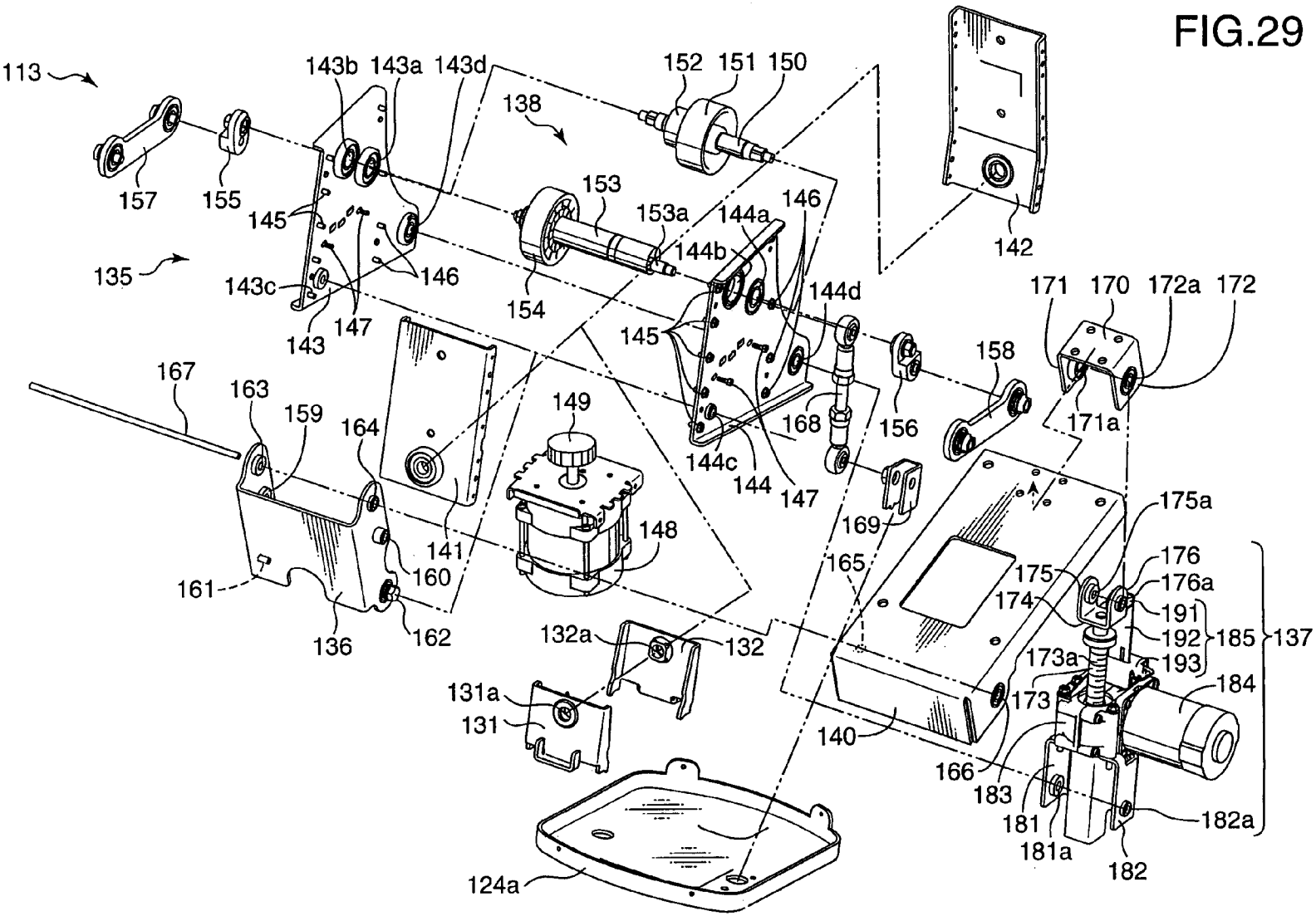
FIG. 29 is an explosive perspective view showing a detailed construction of a rocking mechanism in the exercising apparatus shown in FIG. 26.
Figure 30:
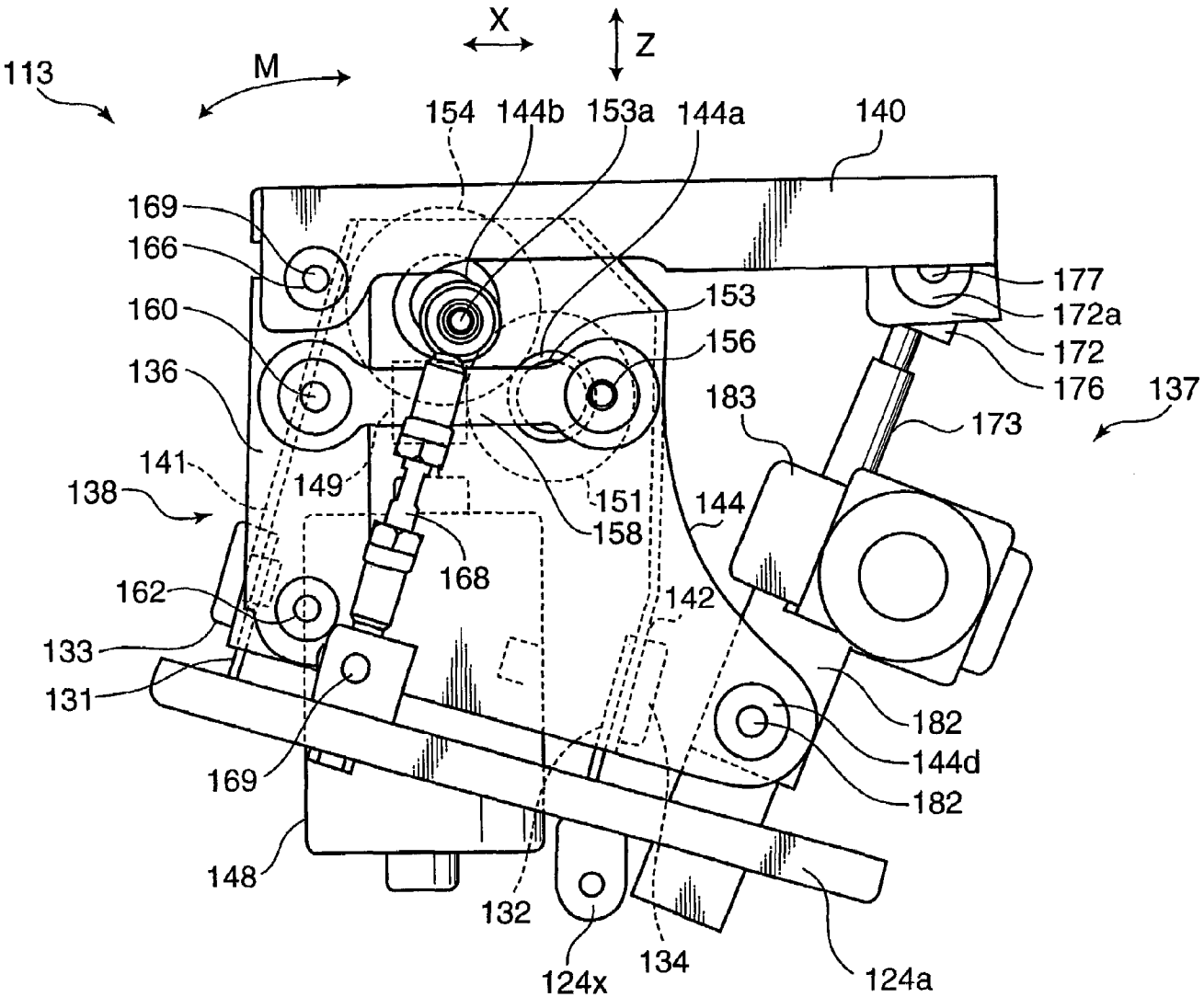
FIG. 30 is a side view showing an assembled state of the rocking mechanism shown in FIG. 29.
Figure 31:
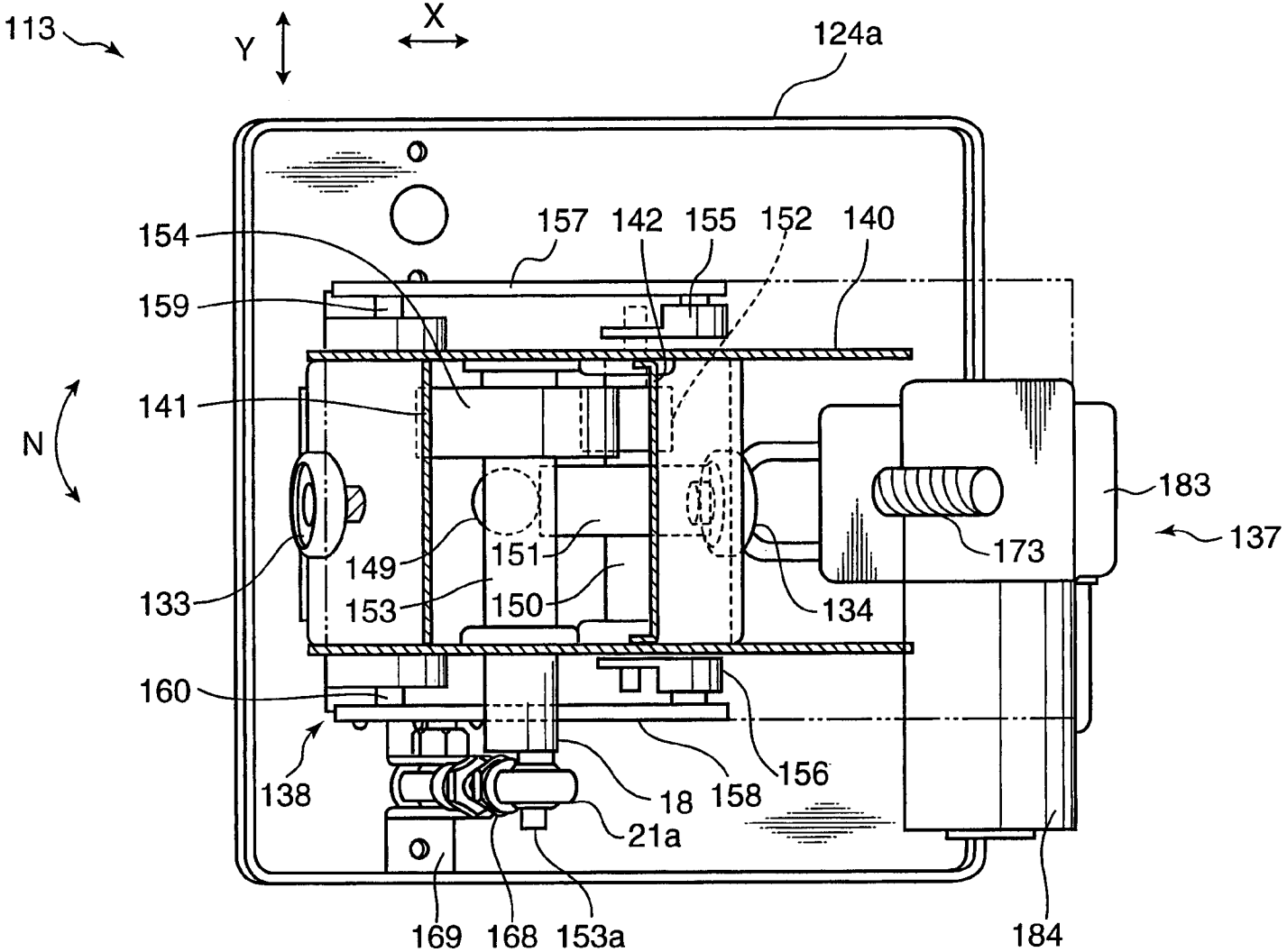
FIG. 31 is a partially sectional view of the rocking mechanism shown in FIG. 30, as viewed from above.
Figure 32:
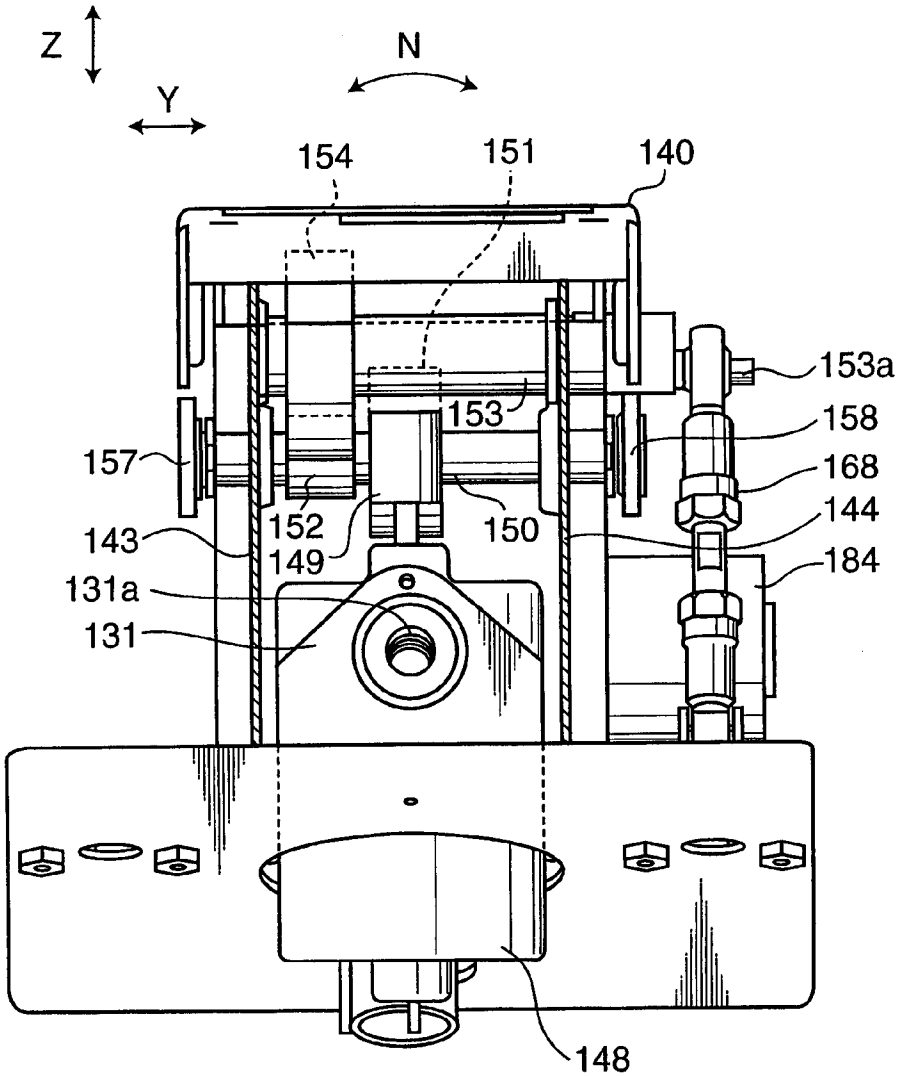
FIG. 32 is a partially sectional view of the rocking mechanism shown in FIG. 30, as viewed from front.

FIG. 29 is an explosive perspective view showing a detailed construction of the rocking mechanism 113. FIG. 30 is a side view showing an assembled state of the rocking mechanism 113. FIG. 31 is a partially sectional view of the assembled rocking mechanism 113 shown in FIG. 30 as viewed from above. FIG. 32 is a partially sectional view of the assembled rocking mechanism shown in FIG. 30 as viewed from front. In FIGS. 30 through 32, illustration of some components is omitted for sake of easy understanding. The rocking mechanism 113 offers a base of rocking motions, wherein the support table 124*a* of the elevating base member 124 is unmovable except for displacement driving by the elevating mechanism 127, although the support table 124*a* of the elevating base member 124 is set to a rearwardly inclined position.

Referring to FIGS. 29 through 32 as well as FIG. 28, a pair of upright pin support flange members 131, 132 opposing to each other in longitudinal directions of the seat assembly 112 are mounted on the support table 124*a*. A rocking mechanism 135 is enabled to rock in leftward and rightward directions as shown by the arrows N about axes of pins 133, 134 which are received in bearings 131*a*, 132*a* of the pin support flange members 131, 132. Further, a seat connection member 140 for supporting the seat assembly 112 is enabled to rock in forward and backward directions as shown by the arrows X by way of a front link member 136 which is supported by the rocking mechanism 135, and an elevating mechanism 137 serving as a rear link member. A driving unit 138 (see FIG. 30) is housed in a space defined by the support table 124*a*, the front link member 136, the seat connection member 140, and the elevating mechanism 137.

A front plate 141 is pivotally supported on the front-side pin support flange member 131, so that the front plate 141 swings in leftward and rightward directions about the axis of the pin 133 fitted in the bearing 131*a* of the front-side pin support flange member 131 likewise, a rear plate 142 is pivotally supported on the rear-side pin support flange member 132, so that the rear plate 142 swings in the leftward and rightward directions about the axis of the pin 134 fitted in the bearing 132*a* of the rear-side pin support flange member 132. The front plate 141 and the rear plate 142 are secured to side plates 143, 144 by fastening screws 145, 146. A casing unit of the rocking mechanism 135 serving as a movable frame has the construction as mentioned above.

A motor 148 is secured to the side plates 143, 144 by fastening screws 147. The motor 148 is mounted in the rocking mechanism 135 in an upright position, with its output shaft extending upward. A gear 149 secured to the output shaft of the motor 148 is meshed with a first gear 151 mounted on a first shaft 150, and a second gear 152 mounted on the first shaft 150 is meshed with a gear 154 mounted on a second shaft 153. The first shaft 150 and the second shaft 153 are pivotally supported on bearings 143*a*, 144*a* and bearings 143*b*, 144*b* of the side plates 143, 144, respectively.

The opposite end portions of the first shaft 150 each has a prismatic shape, and eccentric cranks 155, 156 are mounted at the opposite end portions of the first shaft 150 respectively at the same angular positions. The eccentric crank 155 (156) is attached to an end of an arm link member 157 (158), and a pin 159 (160) attached to a left side (right side) on an upper portion of the front link member 136 is connected to the other end of the arm link member 157 (158). A pin 161 (162) attached to a left side (right side) on a lower portion of the front link member 136 is pivotally connected to a bearing 143*c* (144*c*) attached to a front lower portion of the side plate 143 (144). Further, referring to FIG. 29, a bearing 163 (164) attached to the left side (right side) on the upper portion of the front link member 136 is interconnected to a bearing 165 (166) attached to a left side (right side) on a front end portion of the seat connection member 140 by way of a shaft 167. In this arrangement, when the motor 148 is rotated, the rotating force of the first shaft 150 is converted into rectilinear reciprocating motions by the eccentric cranks 155, 156, and the arm link members 157, 158, whereby the seat connection member 140 is enabled to rock in the forward and backward directions as shown by the arrows X.

On the other hand, a pin 153*a* is eccentrically attached to one end of the second shaft 153. The pin 153*a* is connected to an end of an eccentric rod 168. The other end of the eccentric rod 168 is pivotally connected to a connecting bracket 169 which is attached to the support table 124*a*. In FIGS. 29 through 32, the pin 153*a* and the eccentric rod 168 are provided on the left side with respect to the rocking mechanism 135. Alternatively, the pin 153*a* and the eccentric rod 168 may be provided on the right side with respect to the rocking mechanism 135. Further alternatively, pins 153*a* may be provided on the opposite sides of the rocking mechanism 135, namely, on the opposite ends of the second shaft 153 at angular positions displaced from each other by 180 degrees. In such an altered arrangement, when the motor 148 is rotated, the rotating force of the second shaft 153 is converted into rectilinear reciprocating motions by the pins 153*a* and corresponding eccentric rods 168, whereby the rocking mechanism 135 loaded with the seat connection member 140 rocks in the leftward and rightward directions as shown by the arrows N.

The rocking mechanism 113 in this embodiment is provided with the elevating mechanism 137 functioning as a rear link member. A U-shaped connecting member 170 is secured to a rear portion on the bottom surface of the seat connection member 140. Bearings 171*a*, 172*a* attached to opposing downward extensions 171, 172 of the connecting member 170, and bearings 175*a*, 176*a* attached to opposing upward extensions 175, 176 of a U-shaped connecting member 174 attached to an upper end of an actuating member 173 of the elevating mechanism 137 are interconnected to each other by a pin 177. Bearings 143*d*, 144*d* attached to lower rear end portions of the side plates 143, 144, and bearings 181*a*, 182*a* attached to lower end portions of a pair of left and right attachment members 181, 182 of the elevating mechanism 137 are interconnected to each other by an unillustrated pin. Thus, the elevating mechanism 137 serves as a rear link member for connecting the side plates 143, 144 with each other at a rear end of the seat connection member 140.

The elevating mechanism 137 is constituted of the left and right attachment members 181, 182 which oppose to each other by a certain gap, the actuating member 173 housed in the gap defined by the attachment members 181, 182, a gear box 183 mounted on upper portions of the attachment members 181, 182, a motor 184 for driving the gear box 183, and a height detecting unit 185.

Figure 33:
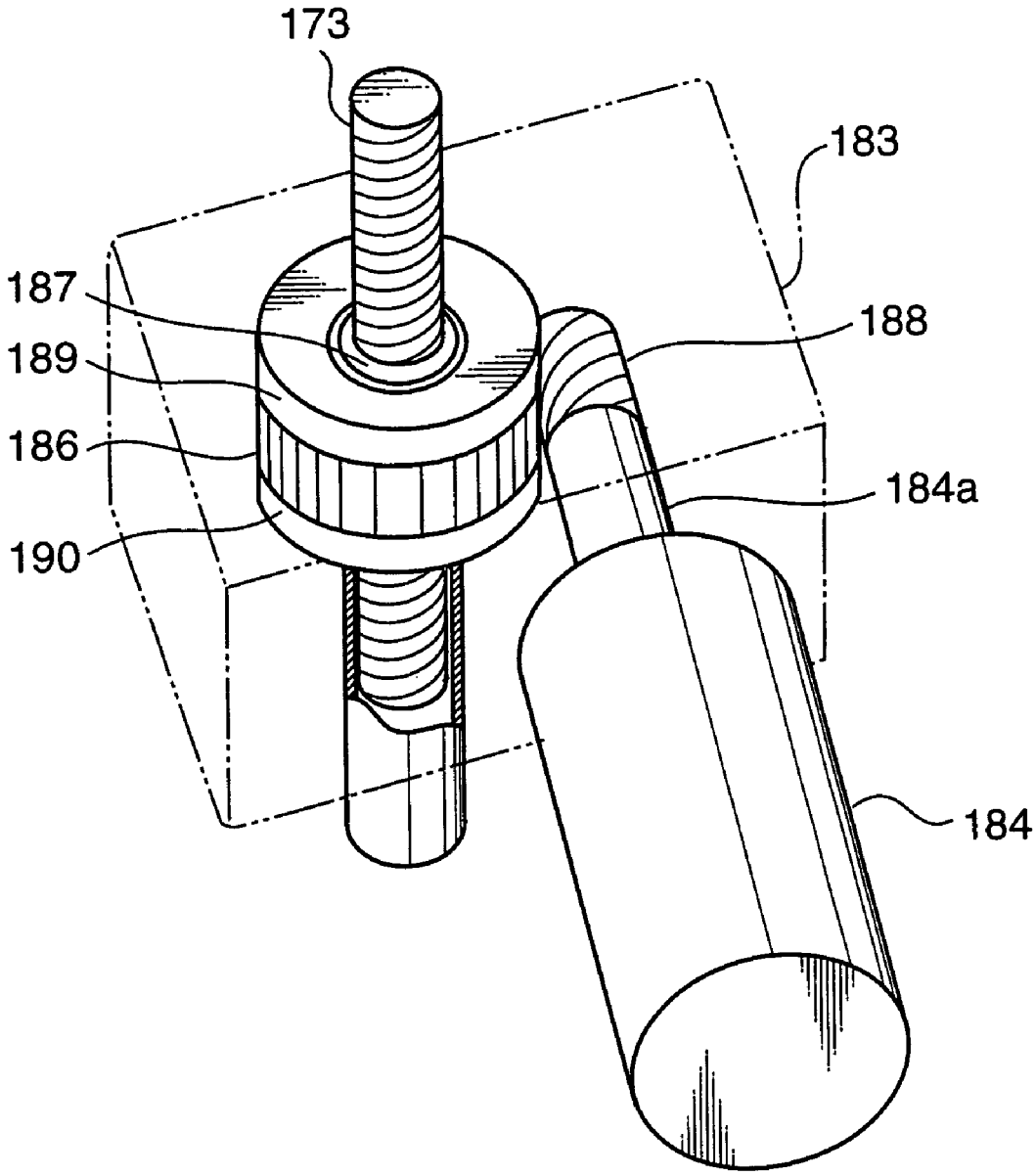
FIG. 33 is a see-through perspective view of a gear box of an elevating mechanism for inclining a seat assembly in longitudinal directions of the seat assembly.
Figure 34:
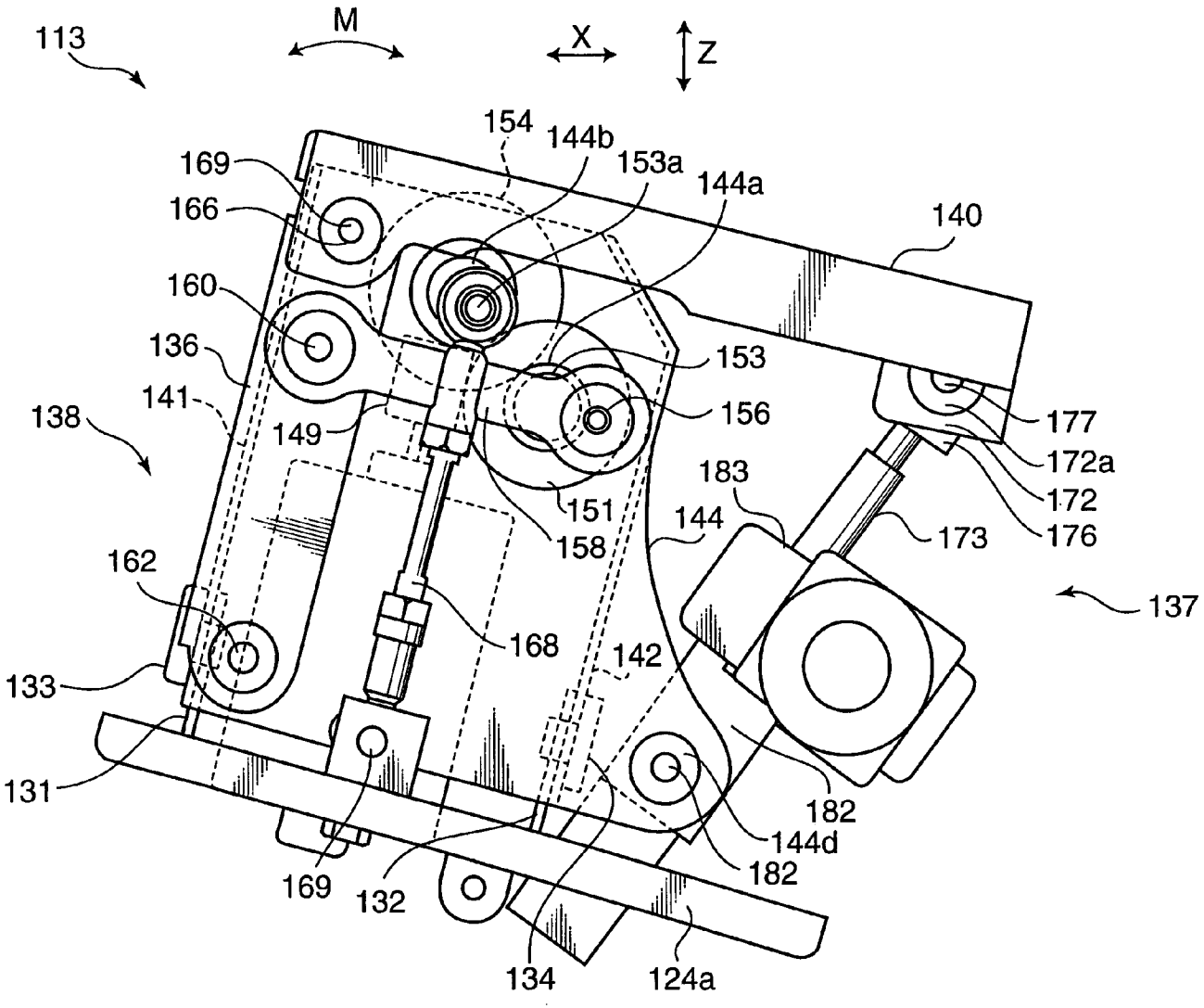
FIG. 34 is a side view of the rocking mechanism in a state that the seat assembly is set to a rearwardly inclined position relative to a horizontal position of the seat assembly as shown in FIG. 30.

The actuating member 173 includes a ball screw. An upper end 173*a* of the actuating member 173 is connected to the connecting member 174, and a lower portion thereof has such a shape as to pass through the gear box 183. As shown in FIG. 33, the ball screw is meshed with an inner screw portion formed in the inner surface of a nut 187 fitted in a worm wheel 186 provided in the gear box 183. The actuating member 173 extends and contracts in and out of the gap defined by the attachment members 181, 182 by driving the worm wheel 186 by a worm gear 188 secured to an output shaft 184*a* of the motor 184, whereby the seat assembly 112 is enabled to incline forwardly and rearwardly in the directions of the arrows M as shown in FIGS. 28, 30, and 34. The worm wheel 186 is rotatably supported about a vertical axis inside the gear box 183 by bearings 189, 190.

The height detecting unit 185 (see FIG. 29) detects the inclined position of the seat assembly 112 by causing a position sensor 193 to read displacement of a slit member 192 connected to the actuating member 173 by a connecting member 191. The inclined position of the seat assembly 112 to be detected by the height detecting unit 185 includes, for instance, a forward-most inclined position, a forwardly inclined position, a horizontal position, a rearwardly inclined position, and a rearmost inclined position. The construction of the elevating mechanism 127 for adjusting the height of the seat assembly 112 is basically the same as that of the elevating mechanism 137 except for withstand load, resolution performance of the position sensors 193, 127*j*, and the like.

Figure 35:
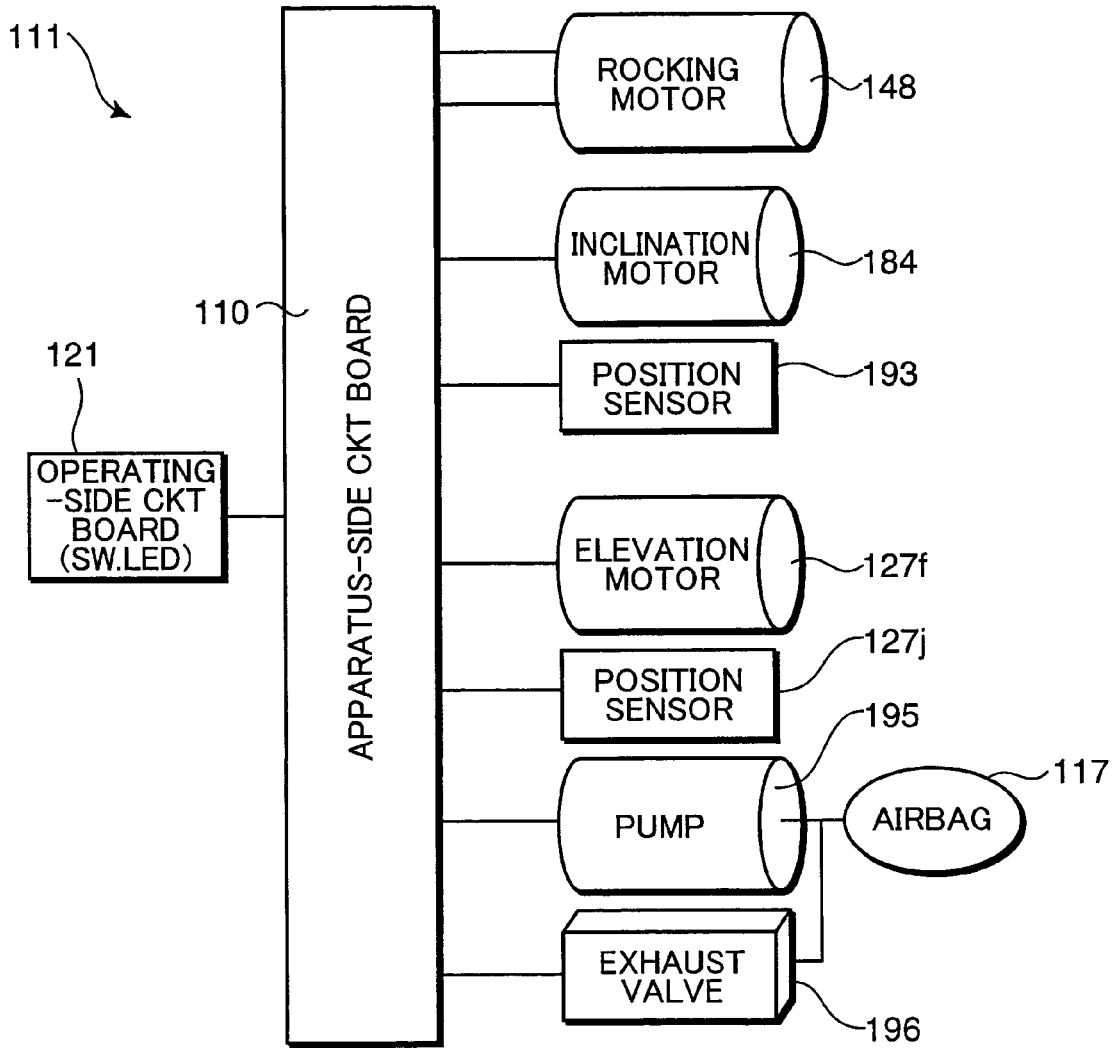
FIG. 35 is a block diagram showing an electrical configuration of the exercising apparatus in the second embodiment.

FIG. 35 is a block diagram showing an electrical configuration of the exercising apparatus 111. The apparatus-side circuit board 110 drives, in response to an operation signal from the operating section 120A, the rocking motor 148 comprised of a direct current (DC) brushless motor for driving the rocking mechanism 135, the inclination motor 184 comprised of a DC motor for driving the elevating mechanism 137, and an elevation motor 127*f* for driving the elevating mechanism 127, as well as a pump 195 and an exhaust valve 196 for expanding and contracting the airbag 117. The inclined amount of the seat assembly 112 by driving of the inclination motor 184 is detected by the position sensor 193, and the height of the seat assembly 112 by driving of the elevating motor 127*f* is detected by the position sensor 127*j*. Detection results of the position sensors 193, 127*j* are sent to the apparatus-side circuit board 110.

Figure 36:
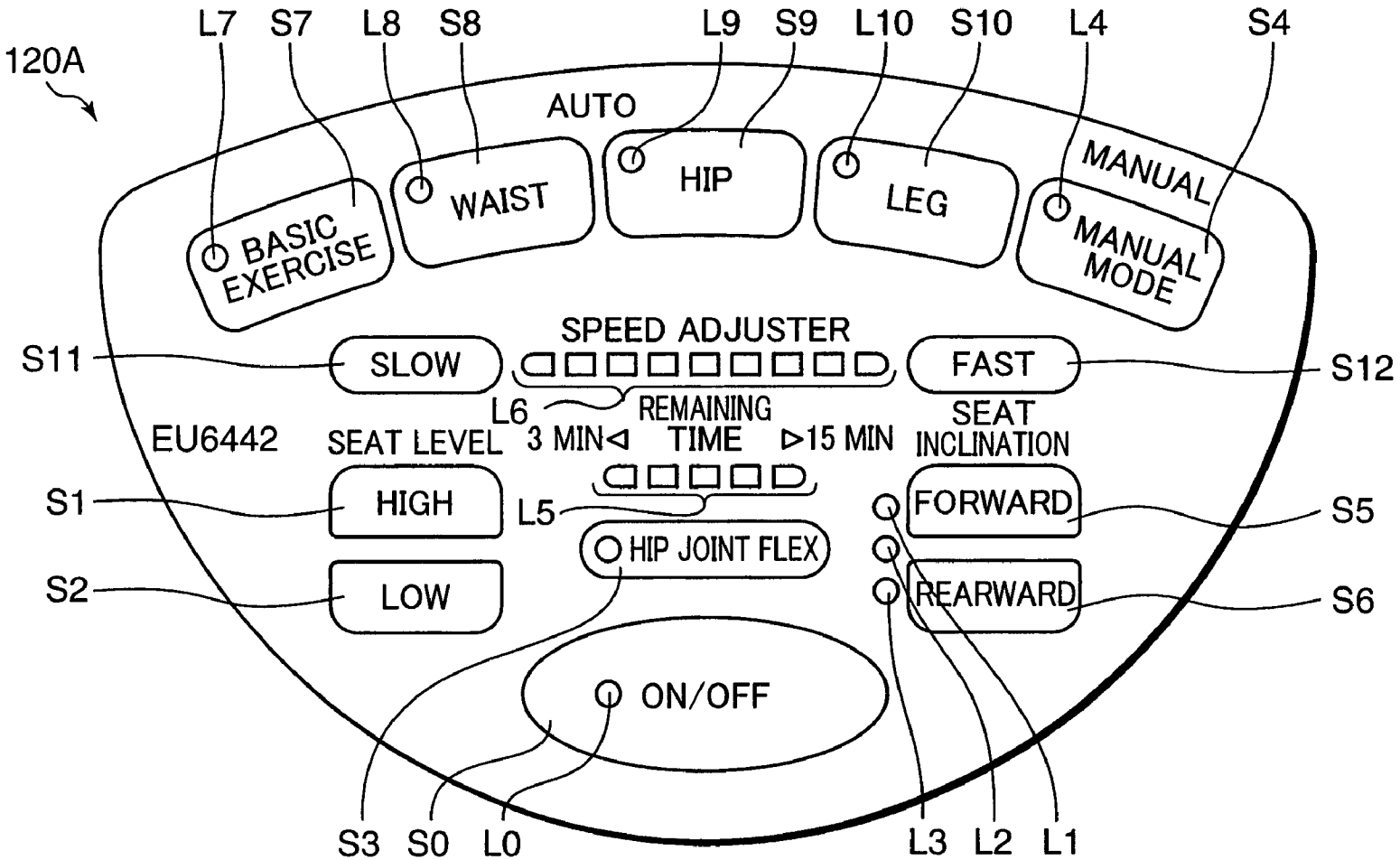
FIG. 36 is a front view of an operating section of the exercising apparatus in the second embodiment.

FIG. 36 is a front view of the operating section 120A. Referring to FIG. 36, when a power switch S0 is turned on, a lamp L0 is lit, so that the exercising apparatus 111 is ready to be used. Further, in response to manipulation of an upward switch S1 or a downward switch S2, the apparatus-side circuit board 110 drives the elevation motor 127*f* for moving the seat assembly 112 upward or downward. Further, in response to manipulation of a hip joint flex switch S3, the apparatus-side circuit board 110 drives the pump 195 and the exhaust valve 196 to expand or contract the airbag 117. Switches and lamps other than the above shown in FIG. 36, which are operable by the operating section 120A, will be described later.

Figure 37:
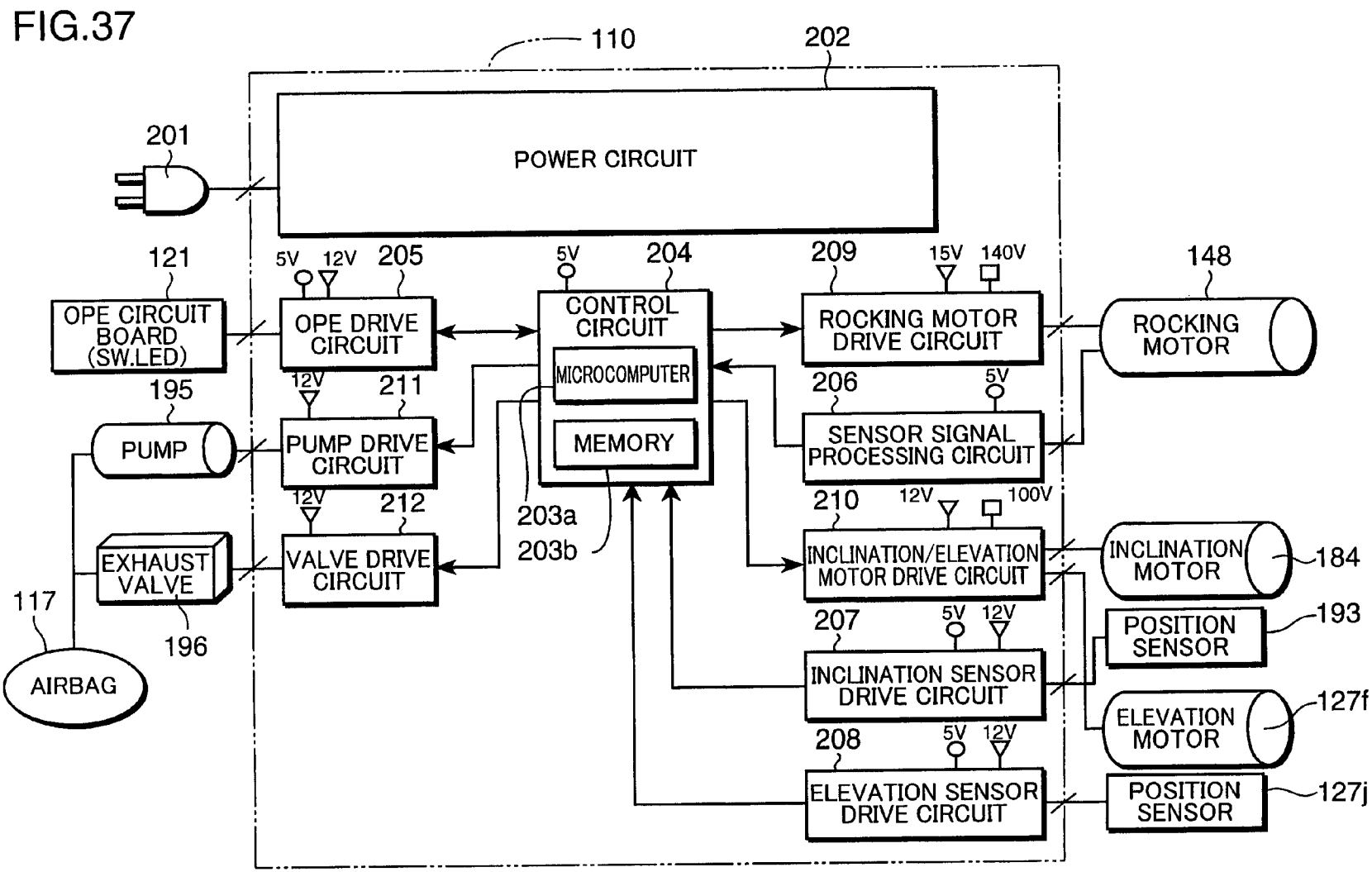
FIG. 37 is a block diagram showing an electrical configuration of an apparatus-side circuit board in the exercising apparatus in the second embodiment.

FIG. 37 is a block diagram showing an electrical configuration of the apparatus-side circuit board 110. A commercially alternating current (AC) supplied through a power plug is converted into direct currents of, e.g. 140V, 100V, 15V, 12V, and 5V to be supplied to respective corresponding circuits in the apparatus-side circuit board 110. The apparatus-side circuit board 110 includes a control circuit 204 for controlling operations of the exercising apparatus 111. The control circuit 204 has a microcomputer 203*a*, and a memory 203*b* which stores patterns relating to various rocking motions. The apparatus-side circuit board 110 controls the operating section 120A for display and output via an operating section drive circuit 205, and accepts operation commands entered through the operating section 120A. The control circuit 204 drives the rocking motor 148 via a rocking motor drive circuit 209, drives the inclination motor 184 and the elevation motor 127*f* via an inclination/elevation motor drive circuit 210, and drives the pump 195 and the exhaust valve 196 via a pump drive circuit 211 and a valve drive circuit 212, respectively, based on data on a rotating speed of the rocking motor 148 which is sent from a sensor signal processing circuit 206, and on detection results of the position sensors 193, 127*j*, which are sent from an inclination sensor drive circuit 207 and an elevation sensor drive circuit 208, respectively. The memory 203*b* constitutes a storage section, and the microcomputer 203*a*, the drive circuit 210, and the elevating mechanism 137 constitute a tilting member.

Figures 38A, 38B, 38C:
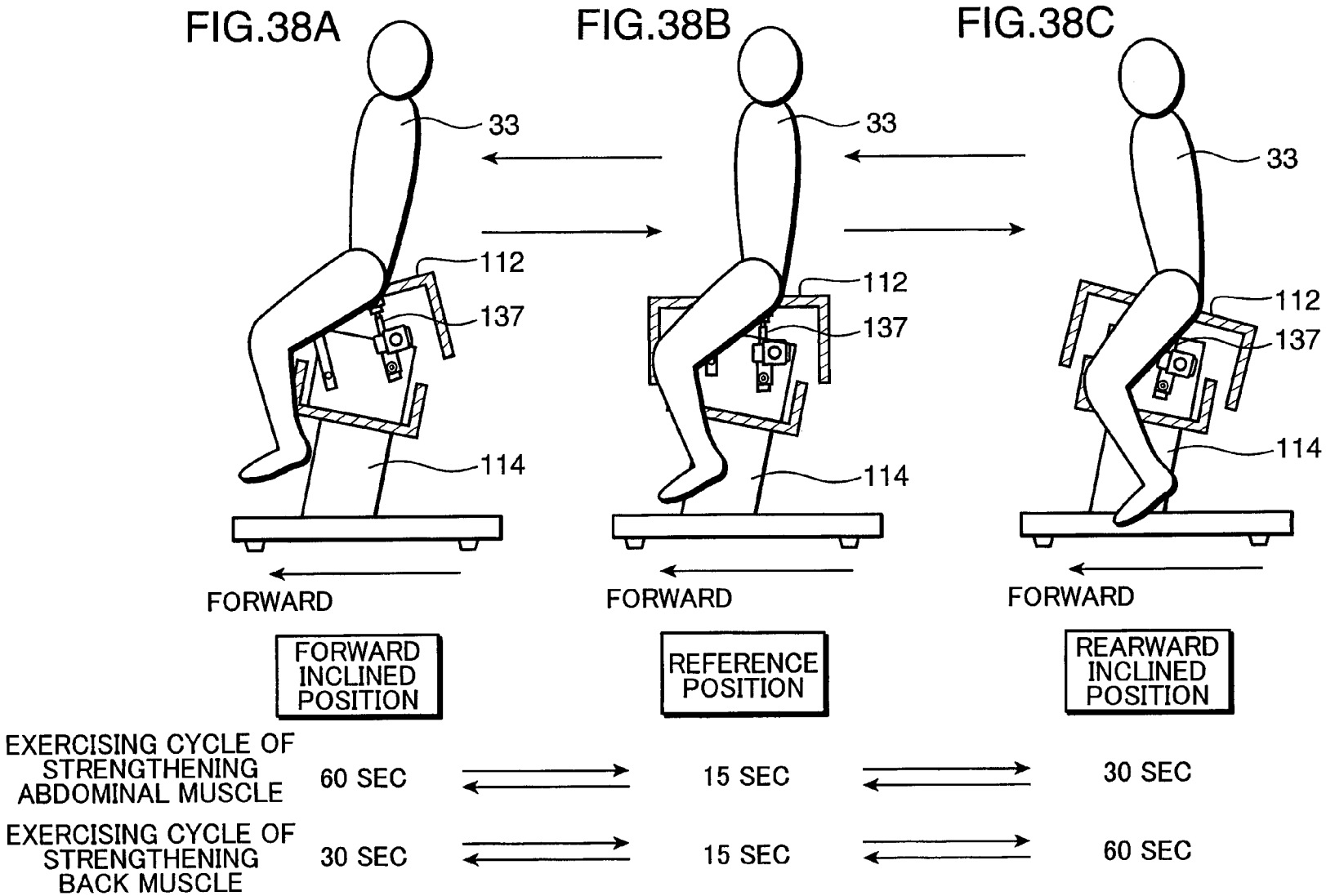
FIGS. 38A through 38C are illustrations showing how the inclined position of the seat assembly of the exercising apparatus in the second embodiment is cyclically changed when the exercising apparatus is operated in examples of automatic modes.

The rocking type exercising apparatus 111 having the above construction is operated in such a manner that the apparatus-side circuit board 110 drives the rocking mechanism 135 to rock the seat assembly 112, and drives the elevation mechanism 137 to change the inclination of the seat assembly 112. Specifically, the exercising apparatus 111 cyclically changes the position of the seat assembly 112 between a forwardly inclined position as shown in FIG. 38A, and a rearwardly inclined position as shown in FIG. 38C, with a reference position as shown in FIG. 38B being interposed therebetween, wherein in the reference position, the user 33 can straddle the seat assembly 112 with the seated surface thereof being set horizontal.

The operating section 120A as shown in FIG. 36 is operated as follows. In response to manipulation of a manual switch S4, a corresponding lamp L4 is lit, so that the inclination of the seat assembly 112 can be manually changed. In response to manipulation of a forward inclination switch S5 or a rearward inclination switch S6, the apparatus-side circuit board 110 drives the inclination motor 184 to change the inclination of the seat assembly 112 accordingly. When the position sensor 193 detects that the seat assembly 112 reaches the forward-most inclined position, the lamp L1 is lit. When the position sensor 193 detects that the seat assembly 112 reaches the horizontal position, the lamp L2 is lit. When the position sensor 193 detects that the seat assembly 112 reaches the rearward-most inclined position, the lamp L3 is lit. In this way, the operating section 120A notifies the user 33 of the respective positions of the seat assembly 112.

On the other hand, if one of automatic mode switches S7 through S10 in the operating section 120A is manipulated, the exercising apparatus 111 is brought to a corresponding designated automatic mode. When one of the automatic modes is started, one of lamps L7 through L10 corresponding to the automatic mode switches S7 through S10 is lit, and a remaining time of the exercising in the designated mode is indicated by emitting light through one of corresponding segments in a lamp section L5.

In the automatic modes, variation patterns relating to the rocking speed with time are stored, as well as variation patterns relating to the inclined positions of the seat assembly 112. For instance, in response to manipulation of the switch S8 for automatically strengthening the waist muscle, as shown in FIGS. 38A through 38C, the seat assembly 112 cyclically changes its position between two different angular positions, namely, the forwardly inclined position as shown in FIG. 38A and the rearwardly inclined position as shown in FIG. 38C, with the horizontal position as shown in FIG. 38B being interposed therebetween. Specifically, the exercising apparatus 111 rocks, with the seat assembly. 112 cyclically changing its position as follows. After holding the horizontal position for 15 seconds, the seat assembly 112 shifts to the forwardly inclined position and holds its position for 60 seconds. Then, the seat assembly 112 returns to the horizontal position, and holds its position for 15 seconds. Then, the seat assembly 112 shifts to the rearwardly inclined position, and holds its position for 30 seconds. With this arrangement, the user 33 can strengthen the muscles around the waist portion of his or her body by appropriately stimulating the muscle of abdomen, the oblique abdominal muscle, and the muscle of back due to sufficient increase in the amount of abdominal muscle activity by the forward inclination of the seat assembly 112, and sufficient increase in the amount of back muscle activity by the rearward inclination of the seat assembly 112, aided with effective addition of oblique movement of the seat assembly 112. There is a case that the exercising effect resulting from rearward inclination can be obtained when the seat assembly 112 is kept to the reference position, depending on an astride position of the user 33. In such a case, it is desirable to change a parameter in such a way that the ratio of forward inclination is adequately increased. In other words, it is desirable to change the parameter regarding an inclination pattern depending on the exercising effect resulting from rocking at the reference position.

Further, as shown in FIGS. 38A through 38C, in response to manipulation of the switch S9 for automatically strengthening the hip muscles of the user 33, the seat assembly 112 cyclically changes its position between the two different angular positions, namely, the forwardly inclined position as shown in FIG. 38A and the rearwardly inclined position as shown in FIG. 38C with the horizontal position as shown in FIG. 38B being interposed therebetween in a similar manner as the mode of automatically strengthening the waist muscle is designated by manipulating the switch S8. In the mode of automatically strengthening the hip muscles, the holding time of the forwardly inclined position is 30 seconds, and the holding time of the rearwardly inclined position is 60 seconds, which are opposite to those in the automatic waist muscle strengthening mode. In this arrangement, the hip muscles of the user 33 can be intensively strengthened by locally strengthening the muscle of back and the muscles of buttocks.

When the switch S7 for basic exercise is manipulated, the exercising apparatus 111 rocks, with the seat assembly 112 holding its horizontal position. When the switch S10 for automatically strengthening the leg muscles is manipulated, the seat assembly 112 cyclically changes its position between the horizontal position and the forwardly inclined position. Specifically, after holding the horizontal position for 20 seconds, the seat assembly 112 shifts to the forwardly inclined position and holds its position for 40 seconds. Then, the seat assembly 112 returns to the horizontal position, and holds its position for 20 seconds. While the seat assembly 112 is kept to the forwardly inclined position, the user 33 holds his or her feet tightly against the stirrups 118. As a result, the user 33 can intensively strengthen his or her quadriceps femoris muscles which have close relations to retention of walking ability and pain relief in gonalgia (knee pain). Thus, this arrangement provides an exercise suitable for aged persons by decreasing the change of inclination, which requires physical balance.

On the other hand, the rocking motor 148 comprised of a DC brushless motor can control the rotating speed thereof by changing a pulse frequency to be applied from the drive circuit 209. The rocking motor 148 can control the rotating speed thereof in nine stages, for instance, as shown in Table 1, when the user manipulates a speed regulating switch S11 or S12 on the operating section 120A. Table 1 shows rotating speeds of the rocking motor 148 at the respective speed levels from level 1 through level 9, and corresponding rocking speeds of the seat assembly 112. The speed level designated by manipulating the speed regulating switch S11 or S12 is displayed by emitting light through a corresponding one of nine segments of a lamp section L6. An output or the like from an encoder attached to the rocking motor 148 is processed by the sensor signal processing circuit 206, so that the processed signal is sent to the control circuit 204 as a speed signal for feedback control.

TABLE 1

| Speed level | Rotating number of motor (rpm) | Rocking speed (cycle) |
|---|---|---|
| Level 1 | 790 | 0.6 |
| Level 2 | 900 | 0.7 |
| Level 3 | 990 | 0.8 |
| Level 4 | 1,110 | 0.9 |
| Level 5 | 1,220 | 1.0 |
| Level 6 | 1,330 | 1.1 |
| Level 7 | 1,460 | 1.2 |
| Level 8 | 1,570 | 1.3 |
| Level 9 | 1,690 | 1.4 |

Figure 39:
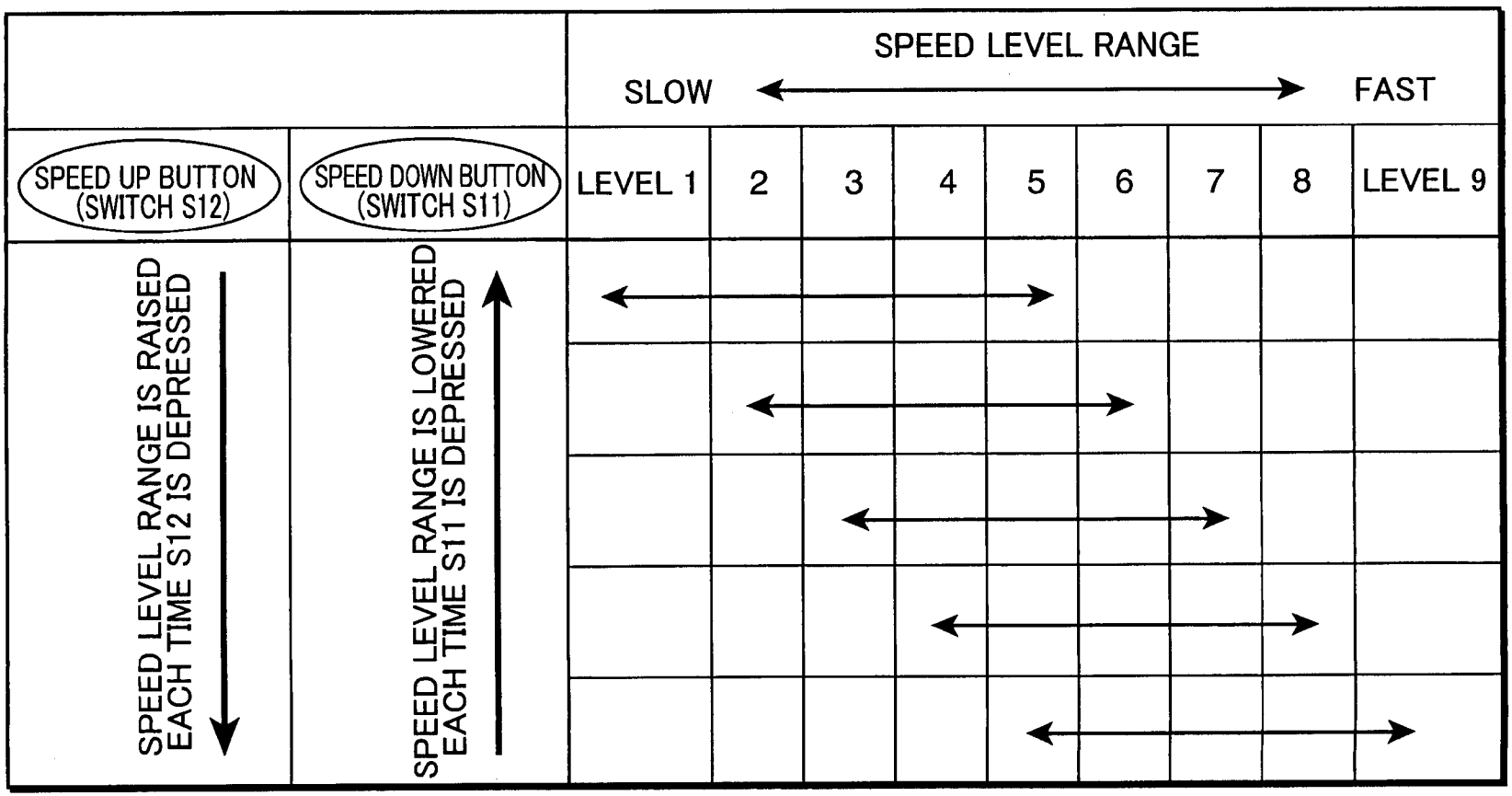
FIG. 39 is a chart showing speed level ranges of the seat assembly of the exercising apparatus in the second embodiment in the automatic modes.
Figure 40:
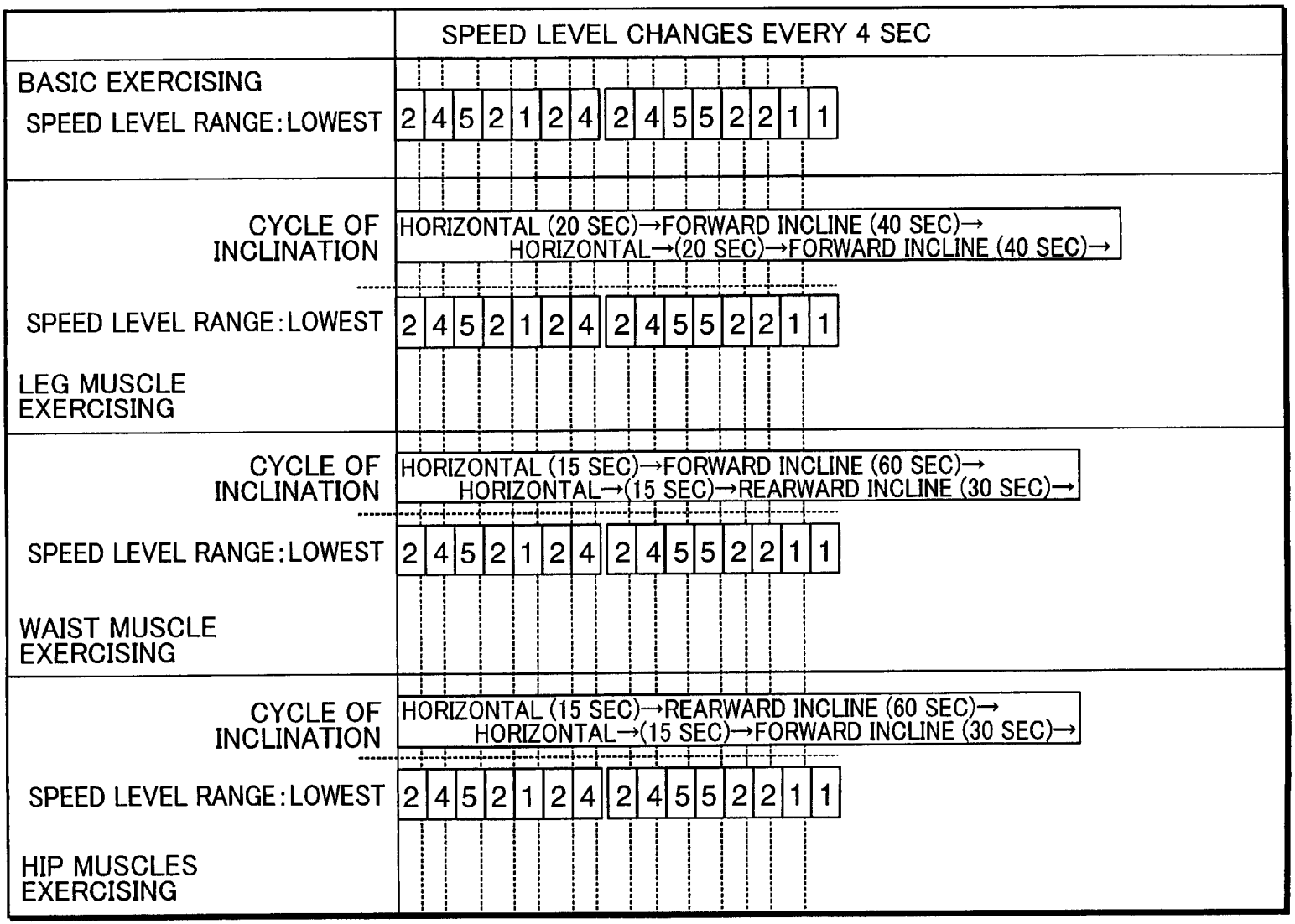
FIG. 40 is a chart showing relations between the speed level ranges of the seat assembly in some examples of the automatic modes, and patterns of cyclically changing the inclined position of the seat assembly in the exercising apparatus in the second embodiment.

Further, in the automatic modes, the speed level is changed within a certain speed level range periodically, e.g., every 4 seconds, and the speed level range can be selected by manipulating the speed adjusting switch S11 or S12. FIG. 39 is a chart for explaining how the speed level range is changed by manipulating the speed adjusting switch S11 or S12. In this example, the range from the speed level 1 to the speed level 5 is defined as the slowest speed level range, and the range from the speed level 5 to the speed level 9 is defined as the fastest speed level range. Each time the speed adjusting switch S12 is manipulated, the speed level range is raised one by one, and each time the speed adjusting switch S11 is manipulated, the speed level range is lowered one by one. FIG. 40 shows a relation between a speed level change, and a pattern of changing the position of the seat assembly 112 in the automatic modes. FIG. 40 shows an example of the speed level change in the slowest speed level range. As shown in FIG. 40, when the exercising apparatus 111 is operated in the automatic modes, the speed level is changed at randomly in a predetermined speed level range in association with a change of the position of the seat assembly 112.

FIG. 41 is a chart showing an example of a control table stored in the memory 203*b*. The control table shows how setting values for the speed levels and setting values for the inclined position are changed with time from the times when the automatic modes of strengthening the waist muscle and the hip muscles are started. The control table shows default values, and the memory 203*b* stores therein a lowest speed level range among five different speed level ranges. The speed level range is raised or lowered with time by manipulating the speed adjusting switch S12 or S11. In FIG. 41, the inclined position setting value "1" represents a forward-most inclined position, the inclined position setting value "0" represents a horizontal position, and the inclined position setting value "2" represents a rearward-most inclined position.

Figure 42:
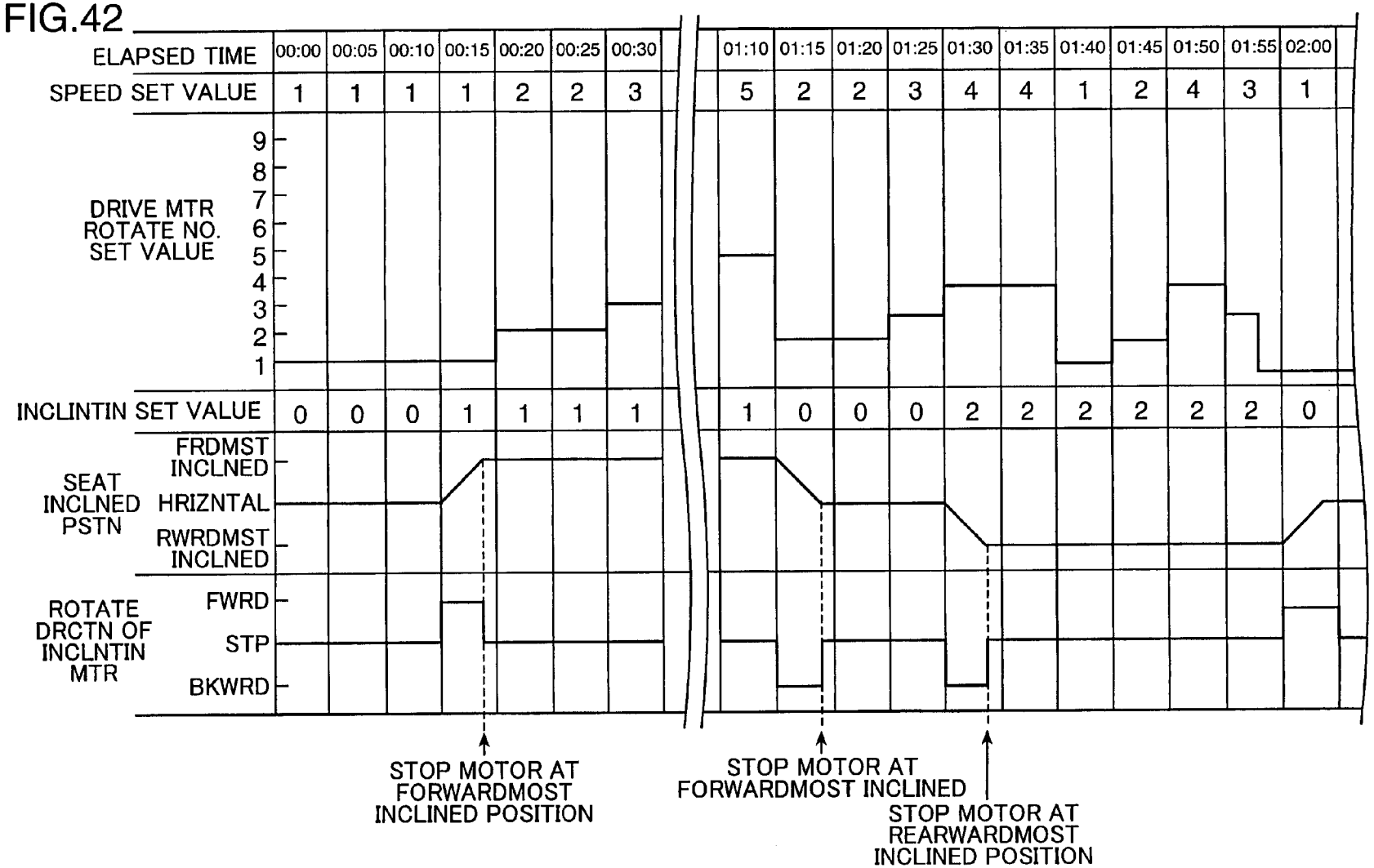
FIG. 42 is a time chart showing how an example of the automatic modes is controlled by the control table shown in FIG. 41.

FIG. 42 is a chart for explaining how the default values are controlled in the automatic mode of strengthening the waist muscle by the control table. As mentioned above, in the automatic mode of strengthening the waist muscle, the position of the seat assembly 112 is changed cyclically as follows. First, the seat assembly 112 is set to the horizontal position, keeps its position for 15 seconds, then is changed to the forwardly inclined position, keeps its position for 60 seconds, returns to the horizontal position, keeps its position for 15 seconds, is changed to the rearwardly inclined position, keeps its position for 30 seconds, and finally returns to the horizontal position. A running time of the exercising apparatus 111 in the automatic mode is for instance 15 minutes. The memory 203*b* may store therein a control table corresponding to the entirety of the running time of the exercising apparatus 111 in the automatic mode, and the speed level setting value may be changed every cycle of changing the position of the seat assembly 112. Further alternatively, the memory 203*b* may store therein a control table corresponding to one cycle, and the microcomputer 203*a* may read out the control table every cycle of changing the position of the seat assembly 112.

FIGS. 43A through 48 are bar graphs showing experiment results conducted by the inventors. The results were obtained by allowing subjects to perform exercising with the rocking type exercising apparatus 111 for 30 minutes a day, 4 times a week for about 3 months. In the experiments, the inclination of the seated surface of the seat assembly 112 of the exercising apparatus 111 is automatically and cyclically changed. In the experiments, the patterns shown in FIGS. 38A through 38C were used, and eight subjects each constitute a group F of subjects who intensively exercised the muscle of abdomen by increasing the ratio of forward inclination, a group B of subjects who intensively exercised the muscle of back by increasing the ratio of rearward inclination, and a control group C who had no exercise with the exercising apparatus 111. The averages of the muscle strengths of the subjects groups F, B, and C before and after the exercising are shown by the shaded bars and the white bars, respectively, and corresponding standard deviations thereof are shown by the lines.

Figure 43A:
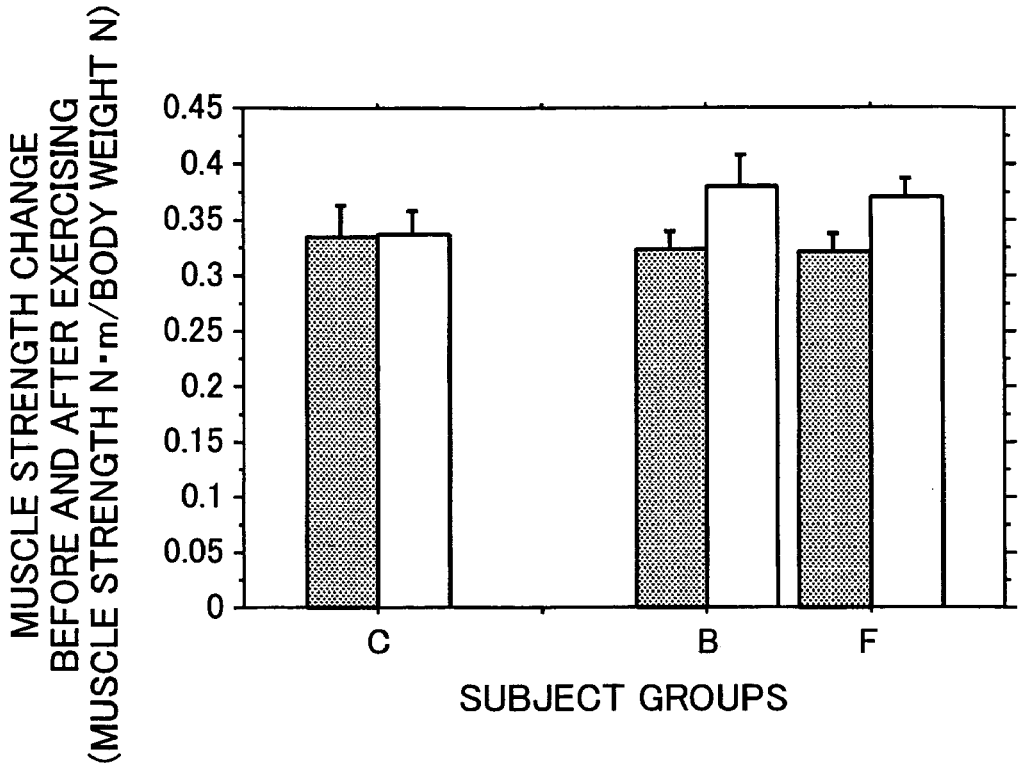
FIGS. 43A and 43B are bar graphs on experiment results conducted by the inventors showing the degree of strengthening the muscles of abdomen of subjects.
Figure 43B:
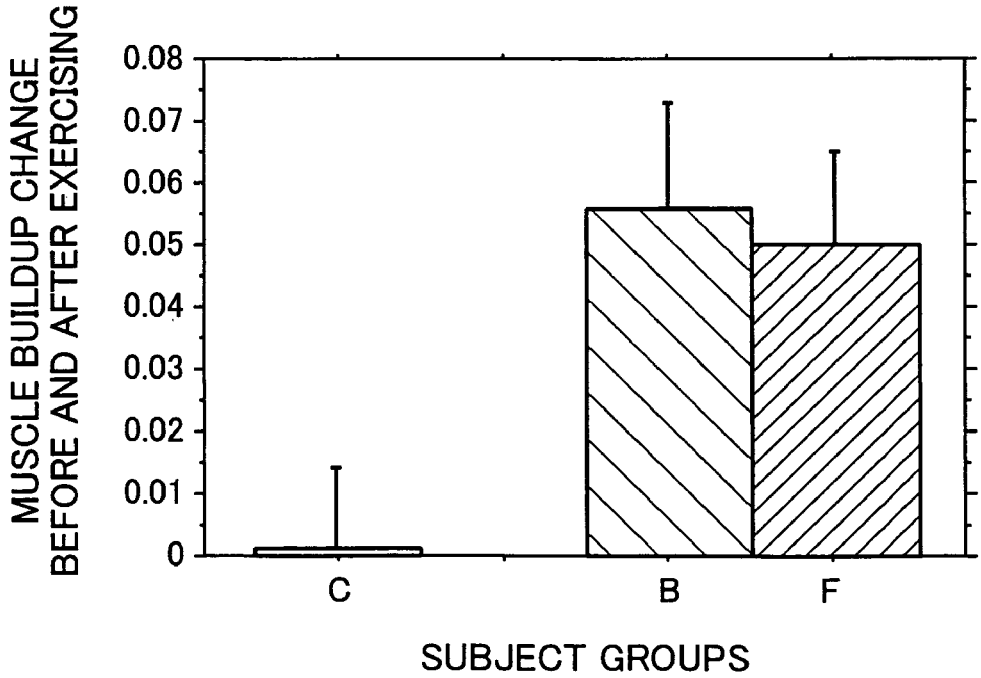

FIGS. 43A and 43B show how the muscle of abdomen is strengthened. FIG. 43A shows increase of the amount of muscle strength, and FIG. 43B shows increase of the amount of muscle buildup. It has already been confirmed that the users can strengthen the muscle of abdomen by doing exercises with the exercising apparatus 111 without forward or rearward inclination of the seat assembly 112. It is understood from the results of experiment that all the subjects in the subject group F and the subject group B show improvements on muscle strength and muscle buildup regarding the muscle of abdomen. The reason why the subject group B of primarily strengthening the back muscles show improvements on muscle strength and muscle buildup on the muscle of abdomen, as well as the subject group F of primarily strengthening the abdominal muscles is conceivably because the ratio of forward inclination leading to strengthening of the abdominal muscle is 25% per cycle of exercising, namely, 30 seconds per cycle of 120 seconds, as shown in FIGS. 38A through 38C. In other words, it can be said that the exercising with the exercising apparatus 111 according to the pattern as shown in FIGS. 38A through 38C provides a well-balanced exercising, while locally and intensively exercising a target site of the user's body.

Figure 44A:
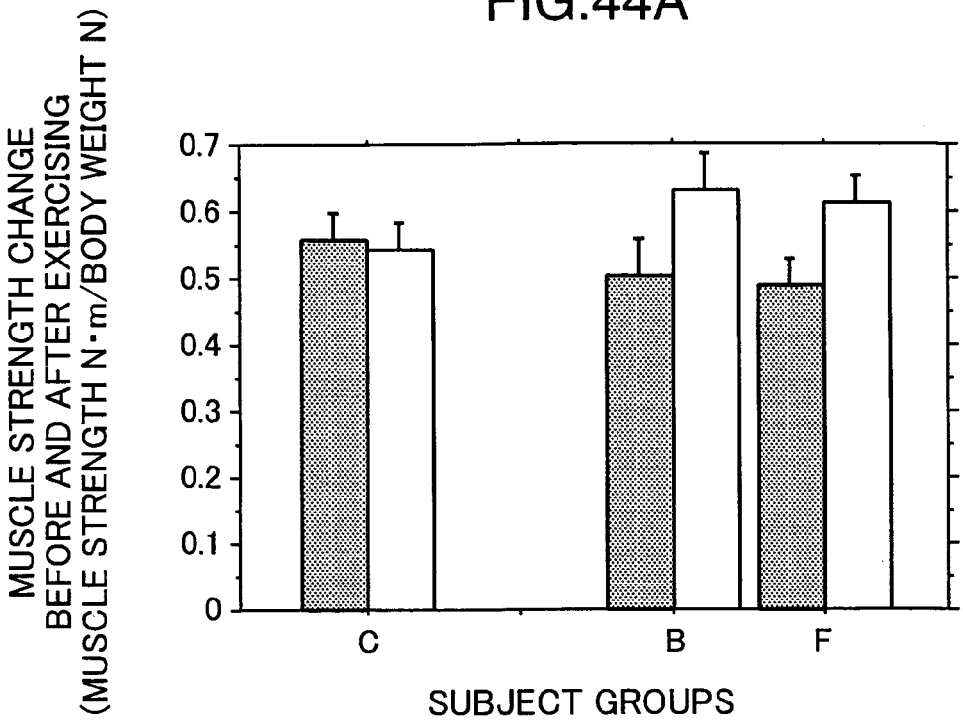
FIGS. 44A and 44B are bar graphs on the experiment results conducted by the inventors showing the degree of strengthening the muscles of back of the subjects.
Figure 44B:
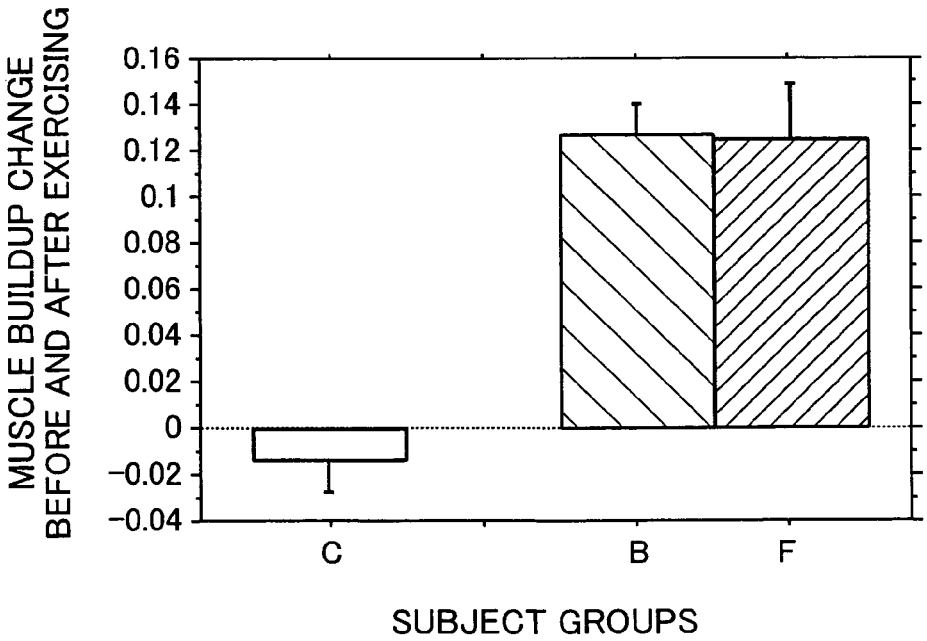

FIGS. 44A and 44B show how the muscle of back is strengthened. FIG. 44A shows increase of the amount of muscle strength, and FIG. 44B shows increase of the amount of muscle buildup. It has already been confirmed that the users can strengthen the back muscle by doing exercises with the exercising apparatus 111 without forward or rearward inclination of the seat assembly 112. It is also understood from the results of experiment that all the subjects in the subject group F and the subject group B show improvements on muscle strength and muscle buildup regarding the back muscle. The reason why the subject group F of primarily strengthening the abdominal muscles show improvements on muscle strength and muscle buildup regarding the back muscle, as well as the subject group B of primarily strengthening the back muscles is conceivably because the ratio of rearward inclination leading to strengthening of the back muscle is 25% per cycle of exercising, namely, 30 seconds per cycle of 120 seconds, as shown in FIGS. 38A through 38C. In other words, it can be said that the exercising with the exercising apparatus 111 according to the pattern as shown in FIGS. 38A through 38C provides a well-balanced exercising, while locally and intensively exercising a target site of the user's body.

Figure 45:
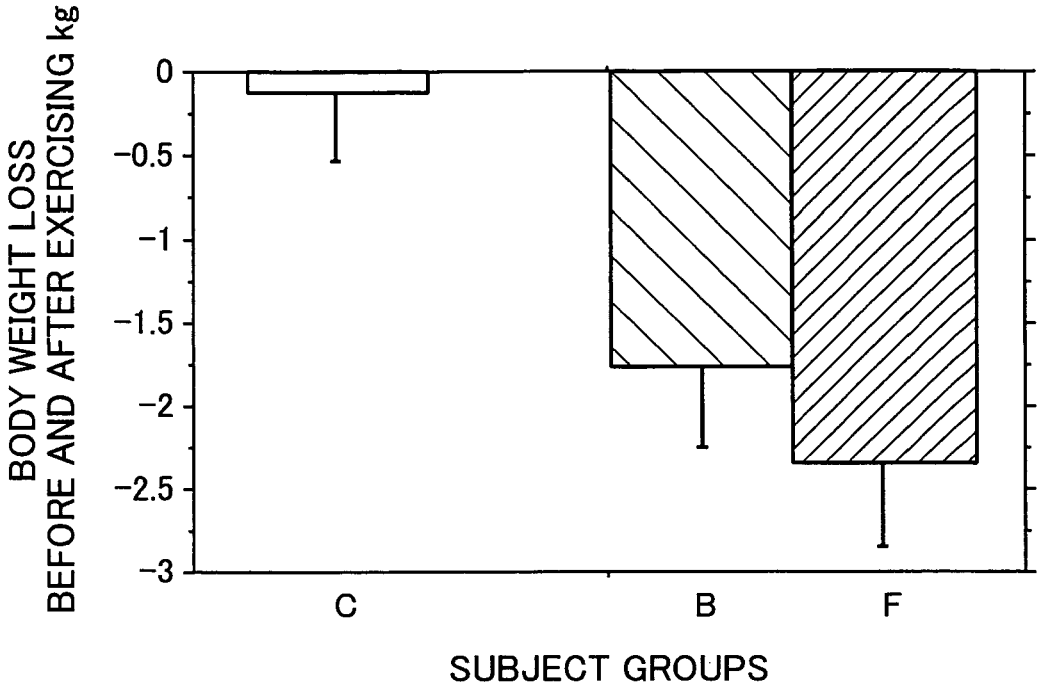
FIG. 45 is a bar graph on the experiment results conducted by the inventors showing the degree of body weight loss of the subjects.

FIG. 45 shows changes of body weight loss among the subject groups C, B, and F before and after the exercising. As shown in FIG. 45, whereas the control group C shows substantially no change in body weight loss, both the subject group F who intensively exercised the muscle of abdomen, and the subject group B who intensively exercised the muscle of back show remarkable body weight loss.

Figure 46:
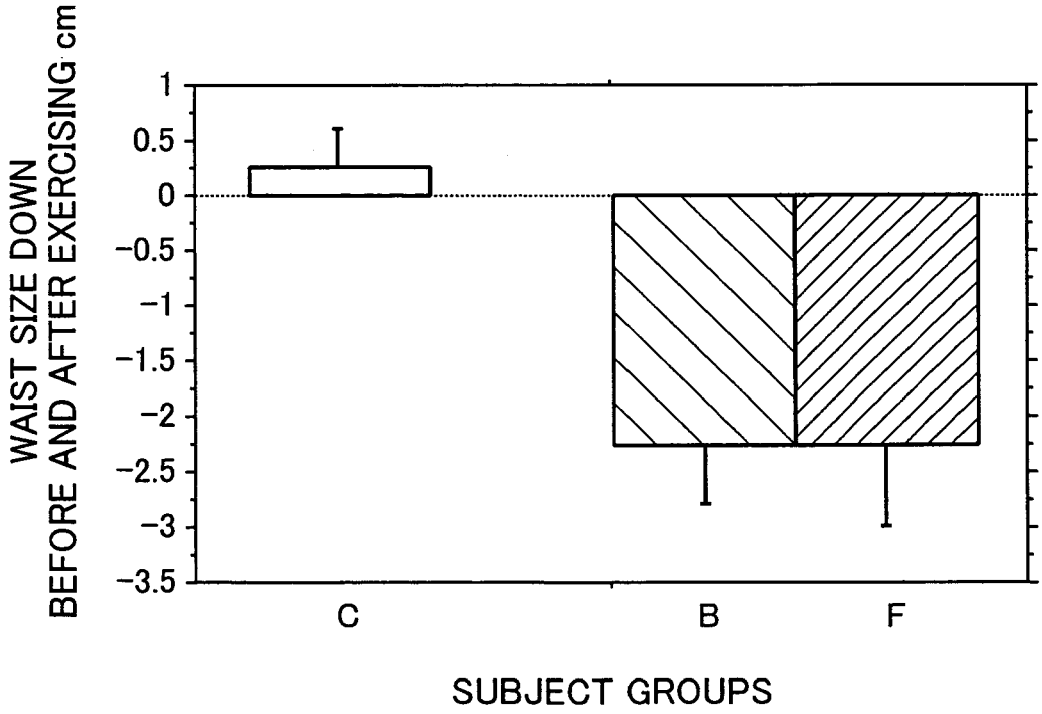
FIG. 46 is a bar graph on the experiment results conducted by the inventors showing the degree of waist size down of the subjects.

FIG. 46 shows changes in waist size among the subject groups C, B, and F before and after the exercising. The waist size is obtained by measuring a smallest circumference of the abdominal region. As shown in FIG. 46, the waist size is reduced by about 2 cm in average both in the subject group F who intensively exercised the muscle of abdomen, and in the subject group B who intensively exercised the muscle of back, whereas the control group C shows substantially no waist size down.

Figure 47:
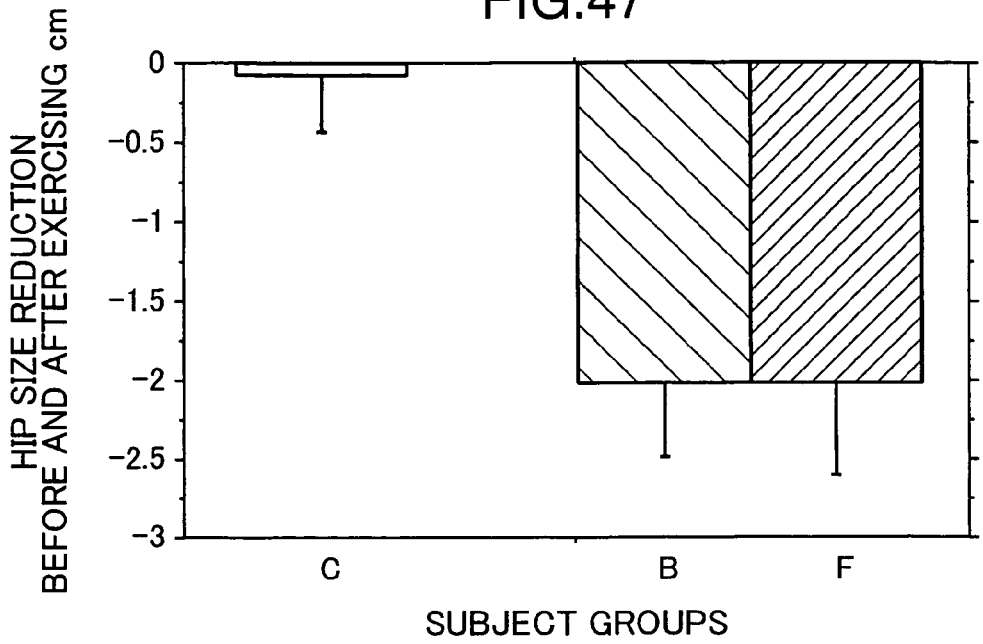
FIG. 47 is a bar graph on the experiment results conducted by the inventors showing the degree of hip size reduction of the subjects.

FIG. 47 shows changes in hip size among the subject groups C, B, and F before and after the exercising. The hip size is obtained by measuring a circumference of the buttocks at a highest position thereof viewed from a sideways direction. As shown in FIG. 47, the hip size is reduced by about 2 cm in average both in the subject group F who intensively exercised the muscle of abdomen, and in the subject group B who intensively exercised the muscle of back, whereas the control group C shows substantially no hip size reduction.

Figure 48:
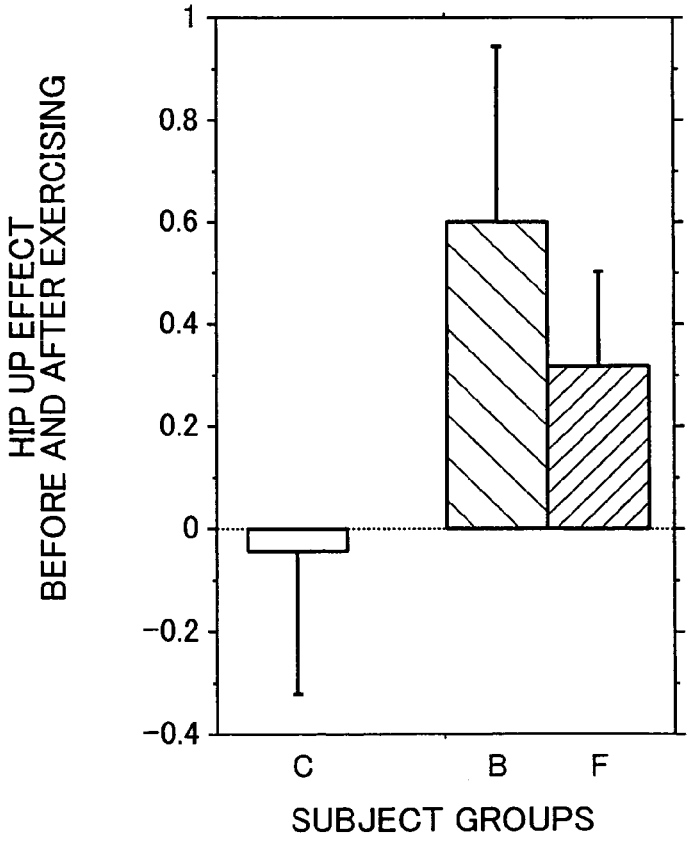
FIG. 48 is a bar graph on the experiment results conducted by the inventors showing hip-up effects of the subjects.

FIG. 48 shows hip-up effects among the subject groups C, B, and F before and after the exercising. The hip-up effect is evaluated by how high the highest position of the buttocks viewed from a sideways direction is raised before and after the exercising relative to the height of each subject. As shown in FIG. 48, both the subject group F who intensively exercised the muscle of abdomen, and the subject group B who intensively exercised the muscle of back show hip-up effects, whereas the control group C show substantially no hip-up effect. Particularly, the subject group B who intensively exercised the back muscle shows remarkably hip-up effects, wherein the height of the highest position of the buttocks is increased by 0.6% relative to the heights of the respective subjects.

As mentioned above, the exercising apparatus 111 provides versatile exercising menus by changing the position of the seat assembly 112 with time during a cycle of exercising. This arrangement keeps the user from getting bored with the exercising. Further, the memory 203*b* stores therein a plurality of variation patterns regarding change of the position of the seat assembly 112 with time, so that the user can select an intended pattern by manipulating one of the switches S8 through S10, which constitute a selecting section. In this arrangement, users can individually select the kind of exercise and the intensity of exercise each time the exercising apparatus 111 is used, which aids the users in properly obtaining intended exercising effects and in continuing the exercising.

Furthermore, in the automatic modes of strengthening the waist muscle and the hip muscles, the pattern of changing the position of the seat assembly 112 is cyclically changed between the forwardly inclined position and the rearwardly inclined position, with the horizontal position or the reference position being interposed therebetween, wherein the holding time of the forwardly inclined position and the holding time of the rearwardly inclined position are different from each other in the waist muscle strengthening mode and the hip muscles strengthening mode. In this arrangement, an exercising effect on a site of the body, which has a closer relation to one of the forwardly inclined position and the rearwardly inclined position whose holding time is longer than that of the other one of the forwardly inclined position and the rearwardly inclined position, can be increased. On the other hand, in the above pattern of cyclically changing the position of the seat assembly 112 between the forwardly inclined position and the rearwardly inclined position, with the reference position being interposed therebetween, setting the holding times of the forwardly inclined position and the rearwardly inclined position identical to each other enables to provide the exercising effects of strengthening the abdominal muscle and the back muscle substantially evenly. In other words, in such an altered arrangement, there is less likelihood that the abdominal muscle or the back muscle is exclusively strengthened. Further, in an arrangement that the inclined position of the seat assembly 112 is cyclically changed between the reference position and the forwardly inclined position, as in the automatic mode of strengthening the leg muscles, for instance, it is possible to raise the intensity of exercise in a specific direction. Thus, various exercising effects can be obtained by controllably changing the position of the seat assembly 112.

In the automatic modes of strengthening the waist muscle and the hip muscles, the inclined position of the seat assembly 112 is cyclically changed between the forwardly inclined position and the rearwardly inclined position, with the horizontal position or the reference position being interposed therebetween, and the seat assembly 112 is paused at the reference position for a certain period. This arrangement promptly notifies the user 33 of changeover of the inclined position of the seat assembly 112, e.g., from the forwardly inclined position to the rearwardly inclined position, which contributes to safe use of the exercising apparatus 111 while enhancing the intensity of exercise, as compared with an arrangement that a seat is not inclined during its use.

Furthermore, the memory 203*b* stores therein the speed level setting values, as well as the inclined position setting values, so that the rocking speed is changed with time. This arrangement provides the user with unique sensation of motions, which contributes to maintenance of motivation of the user without making him or her bored of the exercising.

Furthermore, the memory 203*b* stores therein a control table which is used at the time of starting and/or terminating the respective automatic modes, so that the operating speed of the exercising apparatus 111 is gradually increased at an initial stage of starting the exercising to allow the user to obtain warm-up effects, and the operating speed thereof is gradually decreased at a final stage of the exercising to allow the user to obtain cool-down effects, for instance. Further, it is possible to store a control table to be used at the time of terminating an exercising in the manual mode, as well as in the automatic modes. In such an altered arrangement, the user can properly straddle the seat assembly 112 in an astride position at the next time of exercising by returning the seat assembly 112 to the horizontal position where the seated surface is set horizontal, and retaining the seat assembly 112 at the horizontal position when the exercising is terminated. This arrangement enables to provide the user with exercising effects as expected.

In the exercising apparatus 111, the rocking mechanism 113 realizes complicated reciprocating motions analogous to the shape "∞" with the single motor 148. Alternatively, the following modes can be provided by increasing the number of motors or by providing means for engaging or disengaging power such as a clutch, so that the forward and backward rocking motions as shown by the arrows X, and the leftward and rightward rocking motions as shown by the arrows N can be individually generated.

For instance, in a mode of evenly strengthening the lateral muscles of the body, the lateral muscles of the user's body or the adductor muscles of the legs can be strengthened by evenly inclining the seat assembly 112 in sideways directions. It is often the case that the lateral muscle strength differs in the left side and the right side of the body. However, the lateral muscles can be strengthened evenly by inclining the seat assembly 112 in the sideways directions evenly. For instance, the seat assembly 112 cyclically changes its position in such a manner that the seat assembly 112 is set to the rightwardly inclined position, keeps its position for 45 seconds, is set to the reference position, keeps its position for 15 seconds, is set to the leftwardly inclined position, keeps its position for 45 seconds, is set to the reference position, keeps its position for 15 seconds, and then is returned to the rightwardly inclined position.

In a mode of strengthening the lateral muscles of the body, the lateral muscles of the body can be strengthened by increasing the ratio of rightward inclination of the seat assembly 112. For instance, the seat assembly 112 cyclically changes its position in such a manner that the seat assembly 112 is set to the rightwardly inclined position, keeps its position for 60 seconds, is set to the reference position, keeps its position for 15 seconds, is set to the leftwardly inclined position, keeps its position for 30 seconds, is set to the reference position, keeps its position for 15 seconds, and then is returned to the rightwardly inclined position.

In a mode of strengthening the muscles of the left leg and the right side of the body, the muscles of the left leg and the right side of the body can be strengthened by increasing the ratio of leftward inclination of the seat assembly 112. For instance, the seat assembly 112 cyclically changes its position in such a manner that the seat assembly 112 is set to the rightwardly inclined position, keeps its position for 30 seconds, is set to the reference position, keeps its position for 15 seconds, is set to the leftwardly inclined position, keeps its position for 60 seconds, is set to the reference position, keeps its position for 15 seconds, and then is returned to the rightwardly inclined position.

In a mode of advanced exercising by combination of leftward and rightward inclinations and forward and backward inclinations, the user is provided with advanced balance exercising and is encouraged to exhibit his or her muscle strength in an intensive manner by providing rocking mechanisms on left side and right side of the exercising apparatus, so that the reference position of the seat assembly can be inclined in the longitudinal directions and in the sideways directions of the sea assembly, and by combining the leftward and rightward inclinations and the forward and backward inclinations. Specifically, balanced responsiveness and enhancement of the muscle activity of the upper body with use of the muscles around the waist portion such as the abdominal muscle, the oblique abdominal muscle, and the back muscle can be effectively acquired by combination of the leftward and the rightward inclinations with the forward inclination, or combination of the leftward and the rightward inclinations with the rearward inclination, for instance.

In a mode of twisting the body trunk, the lateral muscles of the body and the adductor muscles of the legs can be strengthened by rocking the seat assembly 112 in conjunction with swivel rotation of the seat assembly 112 on a horizontal plane, as shown in FIG. 25. Specifically, a stress to the muscles around the waist portion such as the oblique abdominal muscle, and a demand for balancing skills of the upper body are increased by swivel rotation of the seat assembly 112 on a horizontal plane. The angle of twist is preferably in the range of ±30 degrees at most, considering a possible stress to the user's body. For instance, the seat assembly 112 cyclically changes its position in such a manner that the seat assembly 112 is rotated clockwise by 15 degrees, keeps its position for 30 seconds, is set to the reference position, keeps its position for 30 seconds, is rotated counterclockwise by 15 degrees, keeps its position for 30 seconds, is set to the reference position, keeps its position for 30 seconds, and then is rotated clockwise by 15 degrees.

In a mode of advanced exercising by combination of body trunk twist and inclination, the user is provided with advanced balance training, and is encouraged to exhibit his or her muscle strength in an intensive manner by inclining the seat assembly 112 with swivel rotation of the seat assembly 112 on a horizontal plane. For instance, balanced responsiveness and enhancement of the muscle activity of the upper body with use of the muscles around the waist portion such as the abdominal muscle, the oblique abdominal muscle, and the back muscle, and increase of the amount of muscle activity of the adductor muscles of the lower limbs can be effectively acquired by combination of a forward inclination with twist. Balanced responsiveness of the upper body, and increase of the amount of muscle activity of the buttocks can be effectively acquired by combination of a rearward inclination with twist, or combination of leftward and rightward inclinations with twist, for instance.

As described above, an inventive rocking type exercising apparatus comprises: a seat which is to be straddled by a user; a tilt provider which provides the seat with a predetermined inclination relative to a reference position; and a rocker which rocks the seat in the inclination to apply a stress of exercise to the user.

It may be preferable that the reference position includes a horizontal position where a seated surface of the seat is set horizontal.

With this construction, the exercising apparatus for applying the exercise stress simulating horseback riding to the user by rocking the seat which the user straddles by the rocker has the tilt provider which sets the seat to the predetermined inclined position relative to the reference position or reference angular position such as a horizontal position where the seated surface of the seat is set horizontal in an initial state of operation of the exercising apparatus. When the seat is set to the reference position, the user can straddle the seat in a relaxed manner, with the amounts of muscle activity of the abdominal muscle, the back muscle, and the lateral muscles of his or her body being substantially equal to each other. The tilt provider includes a tilting member which is attached underneath the seat, and a tilt adjusting unit comprised of a gear and a cam. Alternatively, if a rocker having a high latitude is used, it is possible to allow a rocking mechanism to set the seat to a predetermined inclined position in an initial state of operation of the exercising apparatus.

Setting the seat to the predetermined inclined position in the initial state of operation of the exercising apparatus when the user straddles the seat with his or her knee joint or hip joint being held at a certain angular position relative to the seat enables to change the site of the user's body to which the exercise stress is to be applied. For instance, the user can selectively and locally strengthen his or her abdominal muscle by setting the seat to a forwardly inclined position. Further, the user can selectively and locally strengthen his or her back muscle by setting the seat to a rearwardly inclined position. Further, the user can selectively and locally strengthen the lateral muscles of his or her body such as the oblique abdominal muscle, the gluteus medius, and the adductor muscle by setting the seat to a rightwardly inclined position or a leftwardly inclined position, and can exercise balance training which requires challenging balancing skills, as compared with an arrangement in which a seat is not inclined, namely, the seat is kept at the reference position or the horizontal position where the user straddles the seat in a relaxed manner. In this arrangement, the user can selectively and locally obtain an exercising effect onto a specific site of his or her body.

The exercising apparatus may be further provided with a memory for storing a pattern of changing the inclination of the seat. The tilt provider may be preferably made to change the inclination of the seat with time in response to an output from the memory in an exercising.

In the above arrangement, versatile exercising menus are realized by changing the inclination of the seat with time in the exercising cycle with use of the exercising apparatus, thereby keeping the user from getting bored of the exercising.

For instance, if, in the pattern of changing the inclination of the seat, the inclined position of the seat is cyclically changed between two different angular positions, with a reference position or a horizontal position being interposed therebetween, the horizontal position being such that the seated surface of the seat is set horizontal, the user can strengthen the lateral muscles of his or her body evenly. In other words, there is less likelihood that the abdominal muscle or the back muscle is exclusively strengthened, for instance.

Further, if, in the pattern of changing the inclination of the seat, the inclined position of the seat is cyclically changed between two different angular positions, with the reference position being interposed therebetween, and that the seat is retained at the reference position for a certain period, the user is promptly notified of changeover of the inclined position of the seat, e.g., from a forwardly inclined position to a rearwardly inclined position, which contributes to safe use of the exercising apparatus while enhancing the intensity of exercise, as compared with an arrangement that a seat is not inclined during use of the exercising apparatus.

Further, if, in the pattern of changing the inclination of the seat, the inclined position of the seat includes at least two different inclined positions, e.g., an inclined position A and an inclined position B, and the holding time of the inclined position A and the holding time of the inclined position B are different from each other, an exercising effect onto a specific site of the body, which has a closer relation to one of the inclined positions A and B whose holding time is longer than that of the other one of the inclined positions A and B, can be increased. In other words, various exercising effects can be controllably obtained. For instance, forward inclination enables the user to increase the amount of muscle activity of his or her abdominal muscle. Rearward inclination enables the user to increase the amount of muscle activity of his or her buttocks. Therefore, the user can intensively strengthen his or her abdominal muscle by sufficiently extending the holding time of the forwardly inclined position. If the user suffers backache and finds it difficult to straddle the seat in the forwardly inclined position, it is possible to extend the holding time of the rearwardly inclined position.

If, in the pattern of changing the inclination of the seat, the inclined position of the seat is cyclically changed between the reference position and a predetermined angular position, it is possible to raise the intensity of exercise in a specific direction.

The memory may preferably store a plurality of patterns of changing the inclination of the seat with time, and the exercising apparatus may further comprise a selecting section which outputs a signal to the memory to select a desired pattern of changing the inclination of the seat.

In the above arrangement, the users can individually select the kind of exercise and the intensity of exercise each time the exercising apparatus is used, which aids the users in properly obtaining intended exercising effects and in continuing the exercising.

The pattern of changing the inclination of the seat stored in the memory may preferably cause the seat to hold the horizontal position for a predetermined period when the seat is set to the horizontal position in changing the inclination of the seat with time.

In the above arrangement, for instance, in the pattern of cyclically changing the inclined position of the seat between the two different angular positions, with the horizontal position where the seated surface of the seat is set horizontal being interposed therebetween, or in the pattern of cyclically changing the inclined position of the seat between the horizontal position and the predetermined angular position, the horizontal position of the seat is retained for a predetermined period when the seat is set to the horizontal position in changing the inclination of the seat with time.

The above arrangement enables to promptly notify the user of the changeover of the inclined position of the seat, thereby raising the exercising effects.

The tilt provider may preferably return the seat to the horizontal position and retain the seat at the horizontal position when the exercising is terminated.

In the above arrangement, the user can properly straddle the seat in an astride position at a next time of exercise by returning the seat to the horizontal position where the seated surface of the seat is set horizontal, and retaining the seat at the horizontal position when the instant exercise is terminated. This arrangement enables the user to obtain exercising effects as expected.

The memory may preferably store a pattern of changing the rocking speed of the seat with time along with the pattern of changing the inclination of the seat.

In the above arrangement, since the rocking speed of the exercising apparatus can be changed in association with the change of the inclined position of the seat, the user is provided with unique sensation of motions, which contributes to maintenance of motivation of the user without making him or her bored of the exercising. Further, warm-up effects can be obtained by gradually increasing the operating speed of the exercising apparatus at an initial stage of starting the exercising, and cool-down effects can be obtained by gradually decreasing the operating speed thereof at a final stage of the exercising.

Preferably, the tilt provider may be provided with: a base member which is arranged between the seat and the rocking mechanism and is mounted on an upper surface of the rocking mechanism; a support member which is provided upright at one end portion of the base member in longitudinal directions of the seat; an link member which is attached to the support member and pivotally supports the seat at one end portion of the bottom surface of the seat about a horizontal axis; an elevating mechanism constructed such that an axially extending rib or an axially extending groove is formed on an outer surface of a lower end portion of an elevating member in the form of a solid or a hollow cylindrical shape, so that the rib or the groove is engageable with a counterpart groove or a counterpart rib formed on an inner surface of a hole formed in the base member to move the elevating member up and down in and out of the hole, with its rotation about the axis thereof being restrained, and a spiral rib or a spiral groove is formed on an outer surface of an upper end portion of the elevating member, the upper end portion of the elevating member being adapted to support the other end portion of the bottom surface of the seat; a gear which is formed with a groove or a rib on an inner surface thereof to be engageable with the counterpart spiral rib or the counterpart spiral groove formed on the outer surface of the upper end portion of the elevating member; a screw which is pivotally supported on the base member about a horizontal axis for drivingly rotating the gear; and a handle which is detachably attached to the screw.

In the above arrangement, the tilt provider which is provided between the seat and the rocking mechanism for inclining the seat in the longitudinal directions thereof is constructed such that the seat is supported by the support member which is provided upright on the one end portion of the base member in the longitudinal directions thereof, and by the elevating member which is movable up and down at the other end portion thereof The base member is mounted on the upper surface of the rocking mechanism. The inclined position of the seat in the longitudinal directions thereof is changeable depending on a protruding amount of the elevating member with respect to the base member.

Specifically, the seat is pivotally supported on the support member which is provided upright on the base member, by way of the link member such as a hinge at the one end portion of the bottom surface of the seat in the longitudinal directions thereof. On the other hand, the height level of the other end portion of the seat in the longitudinal directions thereof is changeable relative to the support member, namely, an inclined amount of the seat in the longitudinal directions thereof is controllable by the elevating mechanism comprised of the elevating member, the gear, and the screw.

In the elevating mechanism, the elevating member is in the form of a solid or a hollow cylindrical shape, and comprises the upper end portion and the lower end portion. The axially extending rib or the axially extending groove is formed on the outer surface of the lower end portion of the elevating member. The hole formed in the base member has the counterpart groove or the counterpart rib on the inner surface thereof, and the lower end portion of the elevating member is fitted in the hole of the base member. The rib (groove) of the elevating member and the counterpart groove (rib) formed in the hole of the base member engage with each other by fitting the lower end portion of the elevating member in the hole, whereby the elevating member is movable up and down in and out of the hole, with its rotation about the axis thereof being restrained. On the other hand, the spiral rib or the spiral groove is formed on the outer surface of the upper end portion of the elevating member, and engages the counterpart spiral groove or the counterpart spiral rib formed on the inner surface of the gear. The gear is drivingly rotated by attaching the handle to the screw.

In this arrangement, when the screw is drivingly rotated, the gear is drivingly rotated at a great reduction ratio. Then, the elevating member is moved upward and comes out of the hole in the base member by engagement of the spiral rib in the spiral groove. As a result, the height level of the other end portion of the seat which is supported by the elevating member is changed, thereby changing the inclination of the seat. This arrangement realizes a manual tilt provider for manually changing the inclination of the seat in the longitudinal directions thereof.

The exercising apparatus may be further provided with a base member. The rocker may be preferably provided with: a lateral rocking mechanism which is placed on the base member, and is adapted to rock the seat about an axis extending in a longitudinal direction of the seat; and a longitudinal rocking mechanism which is carried by the lateral rocking mechanism, and adapted to rock the seat in the opposite longitudinal directions of the seat, and includes a front link member and a rear link member that are pivotable in longitudinal directions. The tilt provider may be preferably provided with a driver for driving the rear link member of the longitudinal rocking mechanism.

In the above arrangement, with use of the rocking mechanism, the rocker for generating forward and backward rocking motions and leftward and rightward rocking motions, and the tilt provider for setting the seat to a predetermined inclined position relative to the reference position are realized.

The lateral rocking mechanism may be preferably provided with: a pair of front and rear pin support flange members which are arranged in the longitudinal direction and fixedly attached to the base member; a casing unit having a front plate, a rear plate, and a pair of side plates to define a space therein, the front plate and the rear plate being pivotally connected to the front and rear pin support flange members, respectively by pins; a motor provided in the casing; and a first shaft which is provided between the both side plates of the casing unit, and is formed with an eccentric pin passing one of the both side plates, and is driven by the motor so that the eccentric pin allows the passing side plate to move in vertical directions to thereby cause a lateral rocking movement of the seat about the pins. The longitudinal rocking mechanism may be further provided with: a second shaft which is provided between the both side plates and is driven by the motor, at least one end of the second shaft extending through the one side plate; an eccentric crank member which is attached to the one end of the second shaft; and an arm link member which connects the eccentric crank member with the front link member.

In the above arrangement, in response to driving of the motor, the seat connection member for holding the seat rocks in the forward and backward directions by the second shaft, the eccentric crank member, the arm link member, and the front link member, and also rocks in the leftward and rightward directions by the first shaft and the eccentric pin. Further, the seat connection member for supporting the seat is enabled to rock in a state that the seat is set to a forwardly inclined position or a rearwardly inclined position by contracting or extending the rear link member driven by the driver. This arrangement enables to rock the seat connection member for supporting the seat in a state that the seat is set to the forwardly inclined position or the rearwardly inclined position.

The exercising apparatus may be preferably provided with a base member including a leg table, and a leg portion extendable and contractible on the leg table; a pair of left and right stirrups which hang from a left side and a right side of the seat, respectively; and a rein attached to a front portion of the seat.

In the above arrangement, the user is provided with sensation simulating horseback riding.

The rein may be preferably set to an accommodated position when the user puts the rein down, and set to an upright position when the user raises the rein upward, the rein having such a construction that forward displacement with respect to the upright position is restrained during the use of the exercising apparatus.

It is highly likely that the user is forced to be forwardly inclined when the seat is set to a forwardly inclined position relative to the reference position by providing the tilt provider in the exercising apparatus. However, since the rein has such a construction that forward displacement with respect to the upright position of the rein is restrained, the user can properly support his or her body in an astride position on the seat.

Preferably, the exercising apparatus may be further provided with a rotation supplier for rotating the seat about a vertical axis to rock the seat by the rocker in an initial state of operation of the exercising apparatus in a state that the seat is set to the rotated position.

In the above arrangement, the exercising apparatus which is so constructed as to rock the seat which the user straddles in the predetermined position to apply the exercise stress to the user simulating horseback riding comprises the rotation supplier for rotating the seat about the vertical axis relative to a neutral position or a reference position where the user is seated forward to rock the seat in the initial state of operation of the exercising apparatus in a state that the seat is set to the rotated position. The rotation supplier is constructed by mounting a rotary disk on the seat connection member of the rocker, and by mounting the seat on the rotary disk. Alternatively, in a case where the rocker has a relatively high latitude, it is possible to cause the rocker to generate a rotating force at an initial state of operation of the exercising apparatus.

In this way, by rotating the seat in the initial state of operation of the exercising apparatus, a pattern of applying the stress of exercise to the user's body can be changed in rocking motions in a predetermined position. For instance, the user can locally and selectively strengthen the lateral muscles of his or her body by rotating the seat in rocking the seat in the forward and backward directions. Further, rotating the seat with time, for instance, quickly changing the rotated position of the seat enables to realize a twist exercise of the user's body trunk, and slowly changing the rotated position of the seat enables to change the direction of magnitude of rocking motions with time, whereby the user can shift the muscle group for which the user wishes to obtain an exercising effect. In this way, specific exercising effects are obtained with use of the exercising apparatus.

This application is based on Japanese Patent Application Nos. 2004-218151, and 2005-44579 respectively filed on Jul. 27, 2004 and Feb. 21, 2005 the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A rocking type exercising apparatus comprising:

a seat which is to be straddled by a user;

a tilt provider which provides the seat with a predetermined inclination angle relative to a reference position, said seat having the predetermined inclination angle as an initial state; and a rocker which provides a reciprocal rocking motion to the seat during use of the rocking type exercising apparatus with respect to the initial state thereof to apply a stress of exercise to the user, wherein said rocker includes a top surface on which said tilt provider is mounted, said tilt provider includes a top surface on which said seat is mounted, and said predetermined inclination angle of said seat at said initial state with respect to the top surface of the rocker is inclined from a horizontal plane and is maintained during the reciprocal rocking motion of said rocker.

2. The exercising apparatus according to claim 1, wherein the reference position includes a horizontal position where a seated surface of the seat is set horizontal.

3. The exercising apparatus according to claim 1, further comprising a memory which stores a pattern of changing the inclination angle of the seat, wherein the tilt provider changes the inclination angle of the seat with time in response to an output from the memory in an exercising.

4. The exercising apparatus according to claim 3, wherein the memory stores a plurality of patterns of changing the inclination angle of the seat with time, the exercising apparatus further comprising a selecting section which outputs a signal to the memory to select a desired pattern of changing the inclination angle of the seat.

5. The exercising apparatus according to claim 3, wherein the pattern of changing the inclination angle of the seat stored in the memory causes the seat to hold the horizontal position for a predetermined period when the seat is set to the horizontal position in changing the inclination angle of the seat with time.

6. The exercising apparatus according to claim 3, wherein the tilt provider returns the seat to the horizontal position and retains the seat at the horizontal position when the exercising is terminated.

7. The exercising apparatus according to claim 3, wherein the memory stores a pattern of changing the rocking speed of the seat with time along with the pattern of changing the inclination angle of the seat.

8. The exercising apparatus according to claim 1, further comprising:

a base member including a leg table, and a leg portion which is extendable and contractible on the leg table;

a pair of left and right stirrups which hang from a left side and a right side of the seat, respectively; and a rein which is attached to a front portion of the seat.

9. The exercising apparatus according to claim 8, wherein the rein is set to an accommodated position when the user puts the rein down, and is set to an upright position when the user raises the rein upward, the rein having such a construction that forward displacement with respect to the upright position is restrained during the use of the exercising apparatus.

10. The exercising apparatus according to claim 1, wherein said tilt provider includes an elevating member which varies a height of a rear end of the seat.

11. The exercising apparatus according to claim 1, wherein said tilt provider includes a wedge-shaped tilting member which is positioned underneath the seat so that the seat can be inclined forward or backward.

12. The exercising apparatus according to claim 1, wherein said tilt provider includes an eccentric rotary disk provided underneath the seat and in contact with the seat, and a motor which drives the eccentric rotary disk so that height of the seat can be varied.

13. A rocking type exercising apparatus comprising:

a seat which is to be straddled by a user;

a tilt provider which provides the seat with a predetermined inclination relative to a reference position;

a rocker which rocks the seat during use of the rocking type exercising apparatus with respect to the initial state thereof in the inclination to apply a stress of exercise to the user; and a base member, wherein the rocker includes:

a lateral rocking mechanism which is placed on the base member, and adapted to rock the seat about an axis extending in a longitudinal direction of the seat; and a longitudinal rocking mechanism which is carried by the lateral rocking mechanism, and adapted to rock the seat in the opposite longitudinal directions of the seat, and includes a front link member and a rear link member that are pivotable in longitudinal directions, wherein the tilt provider includes:

a driver which drives the rear link member of the longitudinal rocking mechanism, wherein the lateral rocking mechanism includes:

a pair of front and rear pin support flange members which are arranged in the longitudinal direction and fixedly attached to the base member;

a casing unit having a front plate, a rear plate, and a pair of side plates to define a space therein, the front plate and the rear plate being pivotally connected to the front and rear pin support flange members, respectively by pins;

a motor provided in the casing; and a first shaft which is provided between the both side plates of the casing unit, and is formed with an eccentric pin passing one of the both side plates, and is driven by the motor so that the eccentric pin allows the passing side plate to move in vertical directions to thereby cause a lateral rocking movement of the seat about the pins, and wherein the longitudinal rocking mechanism further includes:

a second shaft which is provided between the both side plates and is driven by the motor, at least one end of the second shaft extending through the one side plate;

an eccentric crank member which is attached to the one end of the second shaft; and an arm link member which connects the eccentric crank member with the front link member.

14. A rocking type exercising apparatus comprising:

a seat which is to be straddled by a user;

a tilt provider which provides the seat with a predetermined inclination relative to a reference position, said seat with the predetermined inclination comprising an initial state;

a rocker which provides a reciprocal rocking motion to the seat during use of the rocking type exercising apparatus with respect to the initial state thereof to apply a stress of exercise to the user; and a base member, wherein the rocker includes:

a lateral rocking mechanism which is placed on the base member, and adapted to rock the seat about an axis extending in a longitudinal direction of the seat; and a longitudinal rocking mechanism which is carried by the lateral rocking mechanism, and adapted to rock the seat in the opposite longitudinal directions of the seat, and includes a front link member and a rear link member that are pivotable in longitudinal directions, wherein the tilt provider includes:

a driver which drives the rear link member of the longitudinal rocking mechanism, and wherein the lateral rocking mechanism includes:

a pair of front and rear pin support flange members which are arranged in the longitudinal direction and fixedly attached to the base member;

a casing unit having a front plate, a rear plate, and a pair of side plates to define a space therein, the front plate and the rear plate being pivotally connected to the front and rear pin support flange members, respectively by pins;

a motor provided in the casing; and a first shaft which is provided between the both side plates of the casing unit, and is formed with an eccentric pin passing one of the both side plates, and is driven by the motor so that the eccentric pin allows the passing side plate to move in vertical directions to thereby cause a lateral rocking movement of the seat about the pins;

wherein the longitudinal rocking mechanism further includes:

a second shaft which is provided between the both side plates and is driven by the motor, at least one end of the second shaft extending through the one side plate;

an eccentric crank member which is attached to the one end of the second shaft; and an arm link member which connects the eccentric crank member with the front link member.

* * * * *